US007916878B2

(12) United States Patent
Bank et al.

(10) Patent No.: US 7,916,878 B2
(45) Date of Patent: Mar. 29, 2011

(54) ACOUSTIC DEVICE AND METHOD OF MAKING ACOUSTIC DEVICE

(75) Inventors: Graham Bank, Huntingdon (GB); Neil Harris, Huntingdon (GB)

(73) Assignee: New Transducers Limited, Huntingdon (GB)

( * ) Notice: Subject to any disclaimer, the term of this patent is extended or adjusted under 35 U.S.C. 154(b) by 1155 days.

(21) Appl. No.: 11/578,256

(22) PCT Filed: Apr. 8, 2005

(86) PCT No.: PCT/GB2005/001352

§ 371 (c)(1),
(2), (4) Date: Nov. 29, 2006

(87) PCT Pub. No.: WO2005/101899

PCT Pub. Date: Oct. 27, 2005

(65) Prior Publication Data

US 2007/0278033 A1 Dec. 6, 2007

Related U.S. Application Data

(60) Provisional application No. 60/563,472, filed on Apr. 20, 2004, provisional application No. 60/563,475, filed on Apr. 20, 2004, provisional application No. 60/563,476, filed on Apr. 20, 2004, provisional application No. 60/587,495, filed on Jul. 14, 2004.

(30) Foreign Application Priority Data

| | | |
|---|---|---|
| Apr. 16, 2004 | (GB) | 0408464.6 |
| Apr. 16, 2004 | (GB) | 0408499.2 |
| Apr. 16, 2004 | (GB) | 0408519.7 |
| Jul. 13, 2004 | (GB) | 0415631.1 |
| Nov. 25, 2004 | (GB) | 0425921.4 |
| Nov. 25, 2004 | (GB) | 0425923.0 |
| Jan. 6, 2005 | (GB) | 0500161.5 |

(51) Int. Cl.
*H04R 25/00* (2006.01)

(52) U.S. Cl. ..... 381/152; 381/423; 381/431

(58) Field of Classification Search ..... 381/152, 381/337, 396, 423, 424, 425, 426, 431, 353, 381/354; 181/157, 166
See application file for complete search history.

(56) References Cited

U.S. PATENT DOCUMENTS 3,943,388 A 3/1976 Massa
(Continued)

FOREIGN PATENT DOCUMENTS

EP 0 281 774 A2 9/1988
(Continued)

*Primary Examiner* — Huyen D Le
(74) *Attorney, Agent, or Firm* — Roylance, Abrams, Berdo & Goodman, LLP; Alan I. Cantor

(57) ABSTRACT

An acoustic device comprising a diaphragm (10) having an area and having an operating frequency range and the diaphragm (10) being such that it has resonant modes in the operating frequency range, an electromechanical transducer having a drive part coupled to the diaphragm (10) and adapted to exchange energy with the diaphragm, and at least one mechanical impedance means (20,22,24) coupled to or integral with the diaphragm, the positioning and mass of the drive part (26) of the transducer and of the at least one mechanical impedance means (20,22,24) being such that the net transverse modal velocity over the area of the diaphragm (10) tends to zero.

A method of making an acoustic device having a diaphragm having an area and having an operating frequency range which includes the piston-to-modal transition, comprising choosing the diaphragm parameters such that it has resonant modes in the operating frequency range, coupling a drive part of an electro-mechanical transducer to the diaphragm to exchange energy with the diaphragm, adding at least one mechanical impedance means to the diaphragm, and selecting the positioning and mass of the drive part of the transducer and the positioning and parameters of the at least one mechanical impedance means so that the net transverse modal velocity over the area tends to zero.

89 Claims, 60 Drawing Sheets

U.S. PATENT DOCUMENTS

| | | | | |
|---|---|---|---|---|
| 5,304,746 | A | 4/1994 | Purvine | |
| 6,332,029 | B1 * | 12/2001 | Azima et al. | 381/152 |
| 6,839,444 | B2 * | 1/2005 | Ellis et al. | 381/152 |
| 2001/0048751 | A1 * | 12/2001 | Ellis | 381/431 |

FOREIGN PATENT DOCUMENTS

| | | | |
|---|---|---|---|
| EP | 0 969 691 | A1 | 1/2000 |
| GB | 2 114 397 | A | 8/1983 |
| JP | 56032900 | A | 4/1982 |
| JP | 57083995 | A | 5/1982 |
| JP | 60128799 | A | 7/1985 |
| JP | 61113399 | A | 5/1986 |
| SU | 1034620 | A3 | 8/1983 |
| SU | 1434565 | A1 | 10/1988 |
| WO | WO 95/01080 | A1 | 1/1995 |
| WO | WO 9501080 | A1 | 1/1995 |
| WO | WO 00/13464 | A1 | 3/2000 |
| WO | WO 00/15000 | A1 | 3/2000 |
| WO | WO 01/03467 | A2 | 1/2001 |
| WO | WO 0103467 | A2 | 11/2001 |
| WO | WO 02/46460 | A2 | 6/2002 |
| WO | WO 0245460 | A2 | 6/2002 |
| WO | WO 02/078391 | A2 | 10/2002 |

* cited by examiner 356
dB
358
Hz
a 360
dB
Hz
b

Fig. 40a
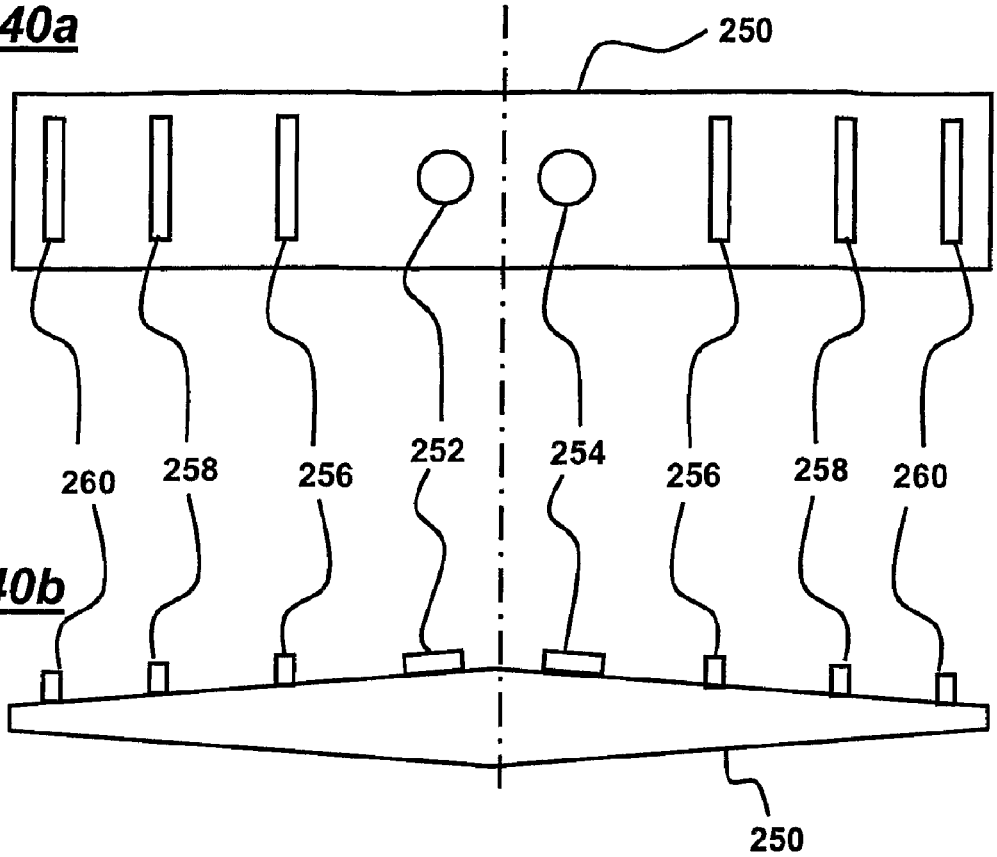
Fig. 40b
Fig. 41a
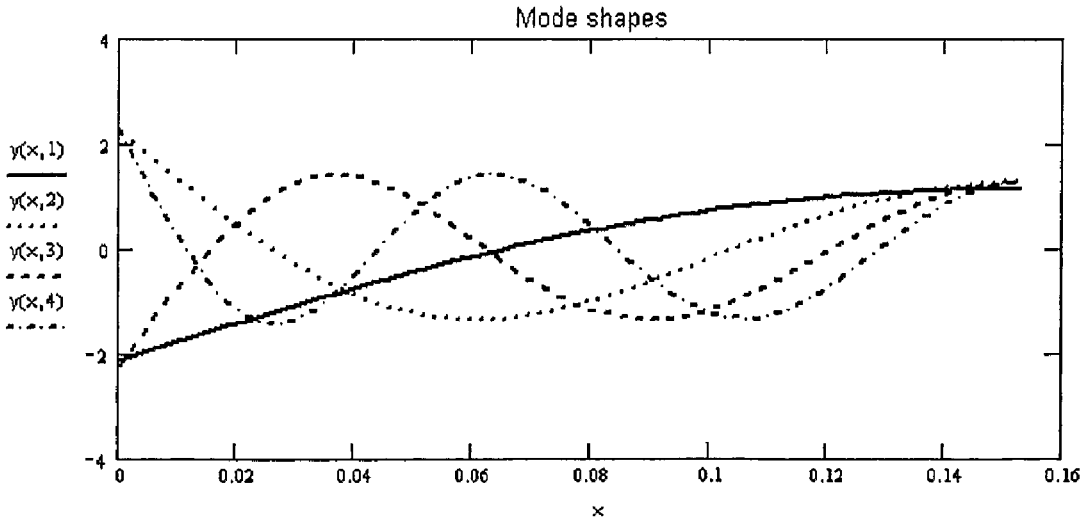

Figure 55c
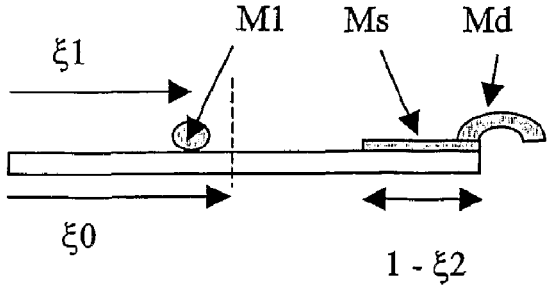
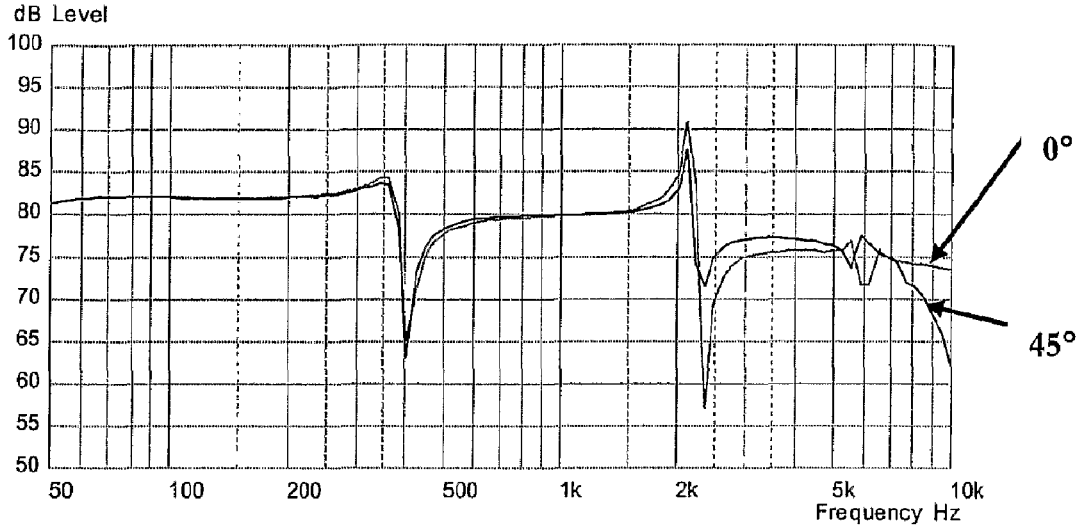
Figure 56a
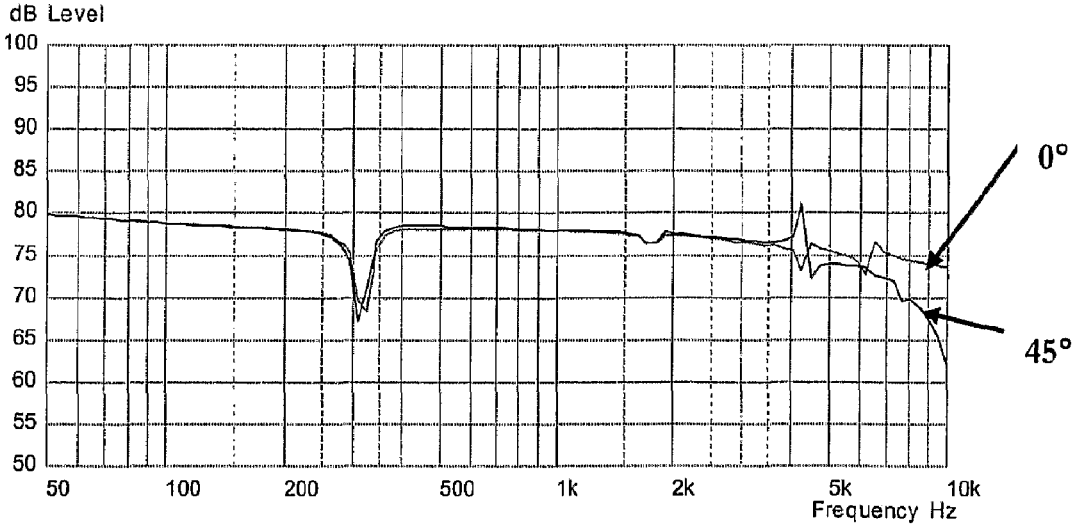
Figure 56b

ACOUSTIC DEVICE AND METHOD OF MAKING ACOUSTIC DEVICE

CROSS-REFERENCE TO RELATED APPLICATIONS

This application claims the benefit of U.S. provisional application Nos. 60/563,472, 60/563,475, and 60/563,476, all filed on Apr. 20, 2004; and of U.S. provisional application No. 60/587,495, filed on Jul. 14, 2004.

TECHNICAL FIELD

The invention relates to acoustic devices, such as loudspeakers and microphones, more particularly bending wave devices.

BACKGROUND ART

From first principles, a point force applied to a pistonic loudspeaker diaphragm will provide a naturally flat frequency response but a power response which falls at higher frequencies. This is due to the radiation coupling changing as the radiated wavelength becomes comparable with the length l of the diaphragm, or the half diameter or radius a for a circular diaphragm, i.e. where ka is greater than 2 or kl is greater than 4 (k is the wave number frequency). However for a theoretical, free mounted bending wave panel speaker, a pure force, i.e. mass-less point drive, will provide both flat sound pressure and flat sound power with frequency.

A practical bending wave panel will however be supported on a suspension, and have an exciter with a complex driving point impedance including a mass. Such an object will demonstrate an uneven frequency response compared with the theoretical expectation. This is due to the various masses and compliances now present unbalancing the panel's modal behaviour. Where the modal density is high enough, the system may be designed so that the modes are beneficially distributed over frequency for a more even acoustic response. But this distributed mode method may not be so effective at the lower bending frequencies where modes are sparse and generally insufficient to construct a satisfactory frequency response.

The objective of flat pressure and power response down to the lowest bending frequency, so bridging the gap to the pistonic or whole body range, requires that the theoretical condition of modal balance be re-established. If this can be achieved, the adjusted modal balance restores the acoustic action of the practical panel to the desired theoretical condition. This would provide a new class of loudspeaker radiator and where the radiated response, in terms of power or frequency, is independent of drive point mass.

The goal for the designer of transducers and loudspeakers employing practical diaphragms and drive methods is to obtain an operation essentially independent of frequency. Once that primary objective is realised, other desired characteristics may be engineered by the designer.

DISCLOSURE OF INVENTION

According to the invention, there is provided an acoustic device comprising a diaphragm having an area and having an operating frequency range and the diaphragm being such that it has resonant modes in the operating frequency range, an electromechanical transducer having a drive part coupled to the diaphragm and adapted to exchange energy with the diaphragm, and at least one mechanical impedance means coupled to or integral with the diaphragm, the positioning and mass of the drive part of the transducer and of the at least one mechanical impedance means being such that the net transverse modal velocity over the area tends to zero.

According to a second aspect of the invention, there is provided a method of making an acoustic device having a diaphragm having an area and having an operating frequency range, comprising choosing the diaphragm parameters such that it has resonant modes in the operating frequency range, coupling a drive part of an electro-mechanical transducer to the diaphragm to exchange energy with the diaphragm, adding at least one mechanical impedance means to the diaphragm, and selecting the positioning and mass of the drive part of the transducer and the positioning and parameters of the at least one mechanical impedance means so that the net transverse modal velocity over the area tends to zero.

The mechanical impedance Z(ω) of the at least one mechanical impedance means is defined by $$Z(\omega)=j\cdot\omega\cdot M(\omega)+k(\omega)/(j\cdot\omega)+R(\omega)$$

where ω is the frequency in radians per second.,
M(ω) is the mass of the element,
k(ω) is the stiffness of the element, and
R(ω) is the damping of the element The at least one mechanical impedance means may be a discrete element, e.g. mass or a suspension, which is coupled to the diaphragm. Alternatively, the diaphragm may have mass, stiffness and/or damping which varies with area to provide the at least one mechanical impedance means at the selected position. In this way the mechanical impedance means is integral with the diaphragm. For example, the diaphragm may be formed with varying thickness, including ridges or projections out of plane on one or both faces of the diaphragm, e.g. by a moulding process. The ridges or projections may act as the mechanical impedance means.

The net transverse modal velocity over the area may be quantified by calculating the rms (root mean square) transverse displacement which is not affected by phase cancellation. By way of example, for a circular diaphragm, rms transverse displacement may be calculated from $$\Psi_{rms}=\sqrt{\frac{1}{R}\int_0^R r\Psi^2\,dr}$$

Where R is the radius of the diaphragm and
ψ(r) is the mode shape.

A measurement of the merit of a particular acoustic device may be calculated from Relative mean displacement $\Psi_{rel}=\Psi_{mean}/\Psi_{rms}$.

Where, for the circular diaphragm $$\text{Mean transverse displacement } \Psi_{mean}=\frac{1}{R}\int_0^R r\Psi\,dr$$

The mean transverse displacement should be low for best balancing. If the net transverse modal velocity over the area is zero, the relative mean displacement will also be zero. In the worst case, the relative mean displacement will equal one. To achieve net transverse modal velocity over the area tending to zero, the relative mean displacement may be less than 0.25 or less than 0.18. In other words, net transverse modal velocity over the area tending to zero may be achieved when the relative mean displacement is less than 25%, or preferably less than 18% of the rms transverse velocity.

For zero net transverse modal velocity, the modes of the diaphragm need to be inertially balanced to the extent, that except for the "whole body displacement" or "piston" mode, the modes have zero mean displacement (i.e. the area enclosed by the mode shape above the generator plane equals that below the plane). This means that the net acceleration, and hence the on-axis pressure response, is determined solely by the pistonic component of motion at any frequency.

There is a wide class of objects for which all the non-pistonic modes have zero mean displacement, e.g. plates of uniform mass-per-unit area with free edges driven by point sources. However, such objects represent theoretical acoustic devices because in practice point drive and free edges are not achievable.

Net transverse modal velocity tending to zero may be achieved by mathematically mapping the nodal contours and hence modes and velocity profile of the practical acoustic device above to those of the ideal theoretical device (e.g. freely vibrating diaphragm). In mathematics, mapping is a rule which relates each element x of one set X to a unique element y in another set Y. The mapping is expressed as a function, f, thus: $y=f(x)$. There can only be said to be a mapping from X to Y if no elements are left unmapped from X, and if each value of x is assigned to only one value of y.

One method for achieving this is to calculate the locations where the drive point impedance Zm is at a maximum or the admittance Ym is at a minimum for the modes of an ideal theoretical acoustic device and mounting the drive part and/or at least one mechanical impedance means at these locations. The admittance is the inverse of the impedance ($Zm=1/Ym$).

For example, for the circular case, the locations may be calculated by varying the drive diameter of the diaphragm between its centre and its periphery, calculating the mean drive point admittance as the drive diameter is varied, and adding mechanical impedances at the positions given by the admittance minima.

The impedance Zm and the admittance Ym are calculated from a modal sum and thus their values depend on the number of modes included in the sum. If only the first mode is considered, the location lies on or quite near a nodal line of that mode. More generally, the locations will tend to be near the nodes of the highest mode considered, but the influence of the other modes means that the correspondence may not be exact. Nevertheless, the locations of the nodal lines of the highest mode chosen for a design solution may be acceptable. The solution from the first three modes is not an extension of the solution from the first two modes and so on. The positions may be considered to be average nodal locations and thus the drive part of the transducer and/or the at least one mechanical impedance means may be positioned at an average nodal position of modes in the operating frequency.

As an alternative to using the admittance, the locations for the mechanical impedance means may be calculated by defining a model in which the mechanical impedance means is an integral part of the system and optimising the model to provide net volume displacement tending to zero. For example for a circular diaphragm, the model may be defined as a disc comprising concentric rings of identical material, with circular line masses at the junction of the rings. The net volume displacement may be calculated from:

$$\int_0^R r\psi(kr)\,dr$$

where R is the radius of the diaphragm and $\psi(r)$ is the mode shape.

Alternatively, the locations for the mechanical impedance means may be calculated by defining a model in which the mechanical impedance means is an integral part of the system and optimising the model to provide relative mean displacement tending to zero.

Combinations of the different methods may also be used, for example a mechanical impedance means may be mounted at a nodal line of the third mode and optimisation may be used to address the first two modes.

The transducer location is a position of average low velocity, i.e. admittance minimum. The standard teaching for a standard distributed mode loudspeaker is to mount the transducer(s) at the location(s) having the smoothest impedance so as to couple to as many modes as possible, as equally as possible. Accordingly, from one viewpoint, the above invention differs from that of distributed mode.

The diaphragm parameters include shape, size (aspect ratio), bending stiffness, surface area density, shear modulus, anisotropy and damping. The parameters may be selected to optimise performance for different applications. For example, for a small diaphragm, e.g. 5 to 8 cm in length or diameter, the diaphragm material may be chosen to provide a relatively stiff, light diaphragm which has only two modes in the desired upper frequency operating range. Since there are only two modes, good sound radiation may be achieved at relatively low cost by balancing these modes. Alternatively, for a large panel, e.g. 25 cm in length or diameter, which has good low frequency power in the pistonic range, the diaphragm material and thickness may be chosen to place the first mode in the mid band, e.g. above 1 kHz. A sequence of modes up the seventh or more may then be balanced to achieve a wide frequency response with good power uniformity, and well maintained off-axis response with frequency.

In design the relative effect of variations in parameters is relevant and the balance of modal radiation is more dependent on uniformity of surface area density than bending stiffness. For example, for a simple circular diaphragm, anisotropy of bending stiffness of up to 2:1 has only a moderate effect on performance and up to 4:1 is tolerated. High shear may be exploited to produce a reduction in efficiency at higher frequencies.

The transducer may be adapted to move the diaphragm in translation. The transducer may be a moving coil device having a voice coil which forms the drive part and a magnet system. A resilient suspension may couple the diaphragm to a chassis. The magnet system may be grounded to the chassis. The suspension may be located at an average nodal position of modes in the operating frequency range. The position at which the voice coil is coupled to the diaphragm may be a different position to that at which the said suspension is coupled to the diaphragm.

The operating frequency range may include the piston-to-modal transition. The diaphragm parameters may be such that there are two or more diaphragm modes in the operating frequency range above the pistonic range.

The diaphragm may have a circular periphery and a centre of mass. The parameters of the diaphragm may be such that the first diaphragm mode is below $ka=2$, where k is the wave number and a is the diaphragm radius measured in metres (m) and the unit for k is $m^{-1}$. For example, this may be achieved by selecting panel material having an appropriate stiffness.

The stiffness of the panel material may also be used to position the coincidence frequency to help control the directivity.

The diaphragm may be isotropic as to bending stiffness. Moderate diaphragm anisotropy of bending stiffness may be designed for by rms (root mean square) averaging the resultant mode locations. For an elliptical diaphragm of (by way of example), x=2y the pure circular equivalent modal result may be achieved with a corresponding stiffness ratio of 16:1. In this way, the diaphragm may be elliptical and may be anisotropic as to bending stiffness so that it behaves like a circular diaphragm of isotropic material.

Anisotropy, for example for the circular case, will alter the actual frequencies of the resonant modes but the circular modal behaviour is strong and asserts itself on the diaphragm. As set out above, moderate anisotropy of up to 4:1 is tolerated.

The at least one mechanical impedance means may be in the form of an annular mass which may be circular or elliptical. Several annular masses may be coupled to or integral with the diaphragm at average nodal positions of modes in the operating frequency range. The masses may reduce in weight towards the centre of the diaphragm. The or each annular mass may be formed by an array of discrete masses. More than three such masses may be enough and six such masses is sufficient to be equivalent to a continuous annular mass. The masses and/or the mass of the suspension may be scaled to the voice coil mass.

Damping means may be located on or integral with the diaphragm at a location of high panel velocity whereby a selected mode is damped. For the circular or elliptical panel, the damping means may be in the form of a pad located at an annulus of high panel velocity. In a bending wave device, regions of high panel velocity are regions of maximum curvature of the panel. Damping (whether constrained-layer or unconstrained-layer) is most effective when it is subject to maximum strain by bending to the maximum degree possible.

For all frequencies, there is maximum bending curvature at the centre and edge of the panel and thus it is known to use central and/or edge damping, although central damping is preferred. However, for different mode orders there are also regions of high panel velocity at different diameter ratios in between the central and edge areas. Accordingly, use of damping only at central and/or edge areas gives a correctly damped on-axis response but the off-axis contribution from the un-damped high velocity regions means that there is not adequate damping of the off-axis response. Placing the damping pad at an annulus of high panel velocity addresses this problem.

The mode may be selected because it causes an unwanted peak in the acoustic response and the effect of the damping pad is to reduce or eliminate this peak. Damping is not additive and different modes require the damping to be in different places. A damping pad may be mounted at more than one location, for example, if more damping accuracy is required. However, applying an overall damping layer covering the whole panel is to be avoided.

By damping only a selected mode or selected modes, the need to damp the whole panel is avoided and thus there is no loss in sensitivity. The whole of the selected mode may be damped, i.e. on-axis and off-axis are both damped. Furthermore lower frequency modes are not significantly damped and thus the behaviour of the loudspeaker below the damped mode is preserved.

The damping pad may be a continuous annular pad or may be segmented whereby small pieces of non-circular damping are used. Alternatively, only parts of the annulus may be damped, depending on the magnitude of the response peak which needs to be damped.

For circular and elliptical shapes, there are two types of modes, radial modes having nodal lines which are concentric with the diaphragm perimeter and axial modes having nodal lines on the diaphragm radii. The axial modes are secondary modes and are generally not acoustically important. Nevertheless, if required they may be attenuated, damped or even minimised by cooperative adjustment of the mechanical impedance means. For example, providing stiffness in the plane of the diaphragm will reinforce the diaphragm with respect to the axial modes, without affecting the balancing of the radial modes. Axial modes are also called 'bell' modes in some texts.

The diaphragm parameters may be selected so that there are two diaphragm radial modes in the operating frequency range. The annular masses may be disposed substantially at any or all of the diameter ratios 0.39 and 0.84, whereby these two modes are balanced. If a third radial mode is in the operating frequency range, damping pads may be disposed at any or all of the diameter ratios 0.43 and 0.74. Alternatively, the annular masses may be disposed substantially at any or all of the diameter ratios 0.26, 0.59 and 0.89, whereby the first three modes are balanced.

If a fourth radial mode is in the frequency range, the damping pads may be disposed at any or all of the diameter ratios 0.32, 0.52 and 0.77, whereby the fourth mode is damped. Alternatively, the annular masses may be disposed substantially at any or all of the diameter ratios 0.2, 0.44, 0.69 and 0.91 whereby the first four modes are balanced.

If a fifth radial mode is in the frequency range, the damping pads may be disposed at any or all of the diameter ratios 0.27, 0.48, 0.63 and 0.81 whereby the fifth mode is damped. Alternatively, the annular masses may be disposed substantially at any or all of the diameter ratios 0.17, 0.35, 0.54, 0.735 and 0.915. If there are additional modes in the frequency range, greater numbers of modes may be chosen for balancing following the basic strategy which has been outlined.

The diaphragm may be annular. The tables below show the possible annular locations of the masses and voice coil for hole sizes ranging from 0.05 to 0.35 of the radius of the panel. The innermost location is most affected by the hole size.

Locations if two radial modes are considered:

| Hole size | Diameter ratios | |
|---|---|---|
| 0 | 0.4 | 0.835 |
| 0.05 | 0.395 | 0.835 |
| 0.1 | 0.4 | 0.845 |
| 0.15 | 0.41 | 0.84 |
| 0.2 | 0.435 | 0.845 |
| 0.25 | 0.46 | 0.85 |
| 0.3 | 0.49 | 0.86 |
| 0.35 | 0.52 | 0.865 |

Locations if three radial modes are considered:

| Hole size | Diameter ratios | | |
|---|---|---|---|
| 0 | 0.265 | 0.595 | 0.89 |
| 0.05 | 0.265 | 0.59 | 0.89 |
| 0.1 | 0.275 | 0.595 | 0.89 |
| 0.15 | 0.3 | 0.605 | 0.895 |
| 0.2 | 0.335 | 0.625 | 0.9 |

-continued

| Hole size | Diameter ratios | | |
|---|---|---|---|
| 0.25 | 0.37 | 0.645 | 0.905 |
| 0.3 | 0.41 | 0.665 | 0.91 |
| 0.35 | 0.45 | 0.685 | 0.915 |

Locations if four radial modes are considered:

| Hole size | Diameter ratios | | | |
|---|---|---|---|---|
| 0 | 0.2 | 0.44 | 0.69 | 0.915 |
| 0.05 | 0.2 | 0.44 | 0.69 | 0.915 |
| 0.1 | 0.22 | 0.455 | 0.695 | 0.92 |
| 0.15 | 0.25 | 0.475 | 0.71 | 0.92 |
| 0.2 | 0.29 | 0.5 | 0.725 | 0.925 |
| 0.25 | 0.33 | 0.53 | 0.74 | 0.93 |
| 0.3 | 0.385 | 0.56 | 0.755 | 0.93 |
| 0.35 | 0.43 | 0.59 | 0.77 | 0.93 |

For example, the diaphragm may comprise a hole of diameter ratio 0.20 and annular masses may be disposed substantially at any or all of the diameter ratios 0.33, 0.62 and 0.91 whereby three modes are balanced. Alternatively, annular masses may be disposed substantially at any or all of the diameter ratios 0.23, 0.46, 0.7 and 0.92 whereby four modes are balanced.

The diaphragm may be generally rectangular and have a centre of mass. The parameters of the diaphragm may be such that the first diaphragm mode is below kl=4, where k is the mode number (unit is $m^{-1}$) and l the panel length measured in meters (m).

The suspension, drive part of the transducer and/or the at least one mechanical impedance means may be located at opposed positions away from the centre of mass and periphery of the diaphragm. If the diaphragm is of uniform mass per unit area, these opposed positions may be equidistant from the centre of mass. The mechanical impedance means may be in the form of a pair of masses which are located at opposed positions spaced from the centre of mass of the diaphragm.

The diaphragm may be beam-like or beam-shaped, i.e. have an elongate rectangular surface area, and the modes may be along the long axis of the beam. The transducer, pairs of masses and/or suspension may be coupled to the diaphragm along the long axis of the beam.

If there are two modes in the operating frequency range, the pairs of masses may be disposed substantially at any or all of the ratios from the centre of mass 0.29 and 0.81. The pairs of masses may be disposed substantially at any or all of the ratios from the centre of mass 0.19, 0.55 and 0.88 where three modes are to be balanced. Alternatively, where four modes are to be balanced, the pairs of masses may be disposed substantially at any or all of the ratios from the centre of mass 0.15, 0.4, 0.68 and 0.91. Alternatively, where five modes are to be balanced, the pairs of masses may be disposed substantially at any or all of the ratios from the centre of mass are 0.11, 0.315, 0.53, 0.74 and 0.93. In design greater numbers of modes may be chosen for balancing following the basic strategy which has been outlined.

For beam-like diaphragms, there are two types of modes, modes having nodal lines which are parallel to the short axis of the beam and cross-modes having nodal lines which are parallel to the long axis of the beam. The cross-modes are secondary modes and are generally not acoustically important except at high frequencies. The ratio of transducer diameter to panel width may have a value of about 0.8 whereby the lowest cross-mode may be beneficially suppressed.

Where the beam is of variable thickness, the ratio concept described above can be replaced by distances related to the average nodal regions determined by the stiffness variation. For a symmetric distribution of stiffness, the use of the centre as a reference is relevant, in a sense equivalent to radii from the centre, but when the beam has an asymmetric distribution of stiffness, the locations for drive and masses are referred to one end of the beam.

In each of the above embodiments, the transducer voice coil may be coupled to the diaphragm at one of the said ratios. For a circular or annular diaphragm, the voice coil may be concentrically mounted on the diaphragm.

For a rectangular panel, a pair of transducers may be mounted at opposed positions each having the same ratio or at two opposed positions having different ratios. Alternatively, a single transducer may be mounted so that its drive part drives two opposed positions each having the same ratio. Alternatively, a transducer and a balancing mass may be mounted at opposed positions each having the same ratio, the mass dynamically compensates the diaphragm for the pistonic range. It will, however, be appreciated that if pistonic operation of the diaphragm is not required, then such mass compensation to avoid diaphragm rocking is not a constraint.

The loudspeaker may comprise a size adapter in the form of a lightweight rigid coupler, which adapts the size of a voice coil which has been chosen to fit a suitable convenient economic frame so that the drive is at an averagely nodal position. The coupler may be coupled to the transducer at a first diameter and is coupled to the diaphragm at a second diameter. The second diameter may be an annular location which is a first average nodal position of modes in the operating frequency range.

The coupler may be frusto-conical. The first diameter may be larger than the second diameter whereby a large coil assembly may be adapted to a smaller driving locus by an inverted coupler and a smaller coil assembly to a large locus by fixing the smaller end of a frusto-conical coupler to the voice coil assembly and the larger end to the diaphragm.

Additional benefits might be had with the possible use of oversize voice coil assemblies for high power capacity and efficiency while preserving the power response to the higher frequencies expected from a small coil drive. Conversely small voice coil assemblies, which are often of moderate cost, may now be adapted to a larger driving circle. In this case the first diameter may be smaller than the second diameter. For example for wider directivity to the highest frequencies for a circular diaphragm the designer would choose a smaller voice driving circle, whether directly driven or via a reducing coupler. Alternatively where higher efficiency and maximum sound level is required a larger voice coil adapted to a larger driving circle, for example a larger radius average nodal line on the diaphragm.

The suspension may be coupled to the diaphragm substantially at any of the outer ratios. Suitable materials for the suspension include moulded rubber or elastic polymer cellular foamed plastics. The effective mass of the suspension may move slightly with frequency and the mass itself may vary with frequency. This is because the composition and geometry of suspensions may result in a complex mechanical impedance where the behaviour changes with frequency.

In design, the physical position of the suspension on the panel may be adjusted to find the best overall match in the operating frequency range. Additionally or alternatively the behaviour of the suspension may be modelled, e.g. with FEA to ascertain the effective centre of mass, damping and stiffness and thus facilitate its location on the panel.

Tolerances of between +/−5% to +/−10% on the locations of the mechanical impedance means may be acceptable depending on diaphragm properties. Tolerances of between +/−5% to +/−10% on the mass of the mechanical impedance means may also be acceptable. In general, the tolerance for changing mass is greater than that for changes in location.

The diaphragm is preferably rigid in the sense of being self-supporting. The diaphragm may be monolithic, layered or a composite. A composite diaphragm may be made from materials having a core sandwiched between two skins, Suitable cores include paper cores, honeycomb cores or corrugated plastic cores, and the core may be longitudinally or radially fluted. Suitable skins include paper, aluminium and polymer plastics. One suitable composite material is Correx®. The materials used may be reinforced isotropically or anisotropically by woven or by uni-directional stiffening fibres.

The diaphragm may be planar or may be dished. The term "dished" is intended to cover all non-planar diaphragms whether dished, arched or domed, including cone sections and compound curves whether circular or elliptical. A dished form may have a planar section at the centre. The diaphragm may have a thickness or width which varies with length.

The loudspeaker may comprise an aperture. A second diaphragm may be mounted in the aperture. The second diaphragm may be similar in operation to the first diaphragm, for example may have a transducer coupled to a first average nodal position and at least one mass coupled at a second average nodal position. Alternatively, the second diaphragm may be operated pistonically or as a bending mode device.

A sealing member may be mounted in the aperture whereby the aperture is substantially acoustically sealed to prevent leakage of acoustic output. The ratio of the radius of the sealing to the outer radius of the diaphragm is an additional parameter which may be adjusted to achieve a desired acoustical response.

The acoustic device may be mounted in an enclosure and the acoustic properties of the enclosure may be selected to improve the performance of the acoustic device.

The acoustic device may be a loudspeaker wherein the transducer is adapted to apply bending wave energy to the diaphragm in response to an electrical signal applied to the transducer and the diaphragm is adapted to radiate acoustic sound over a radiating area. Alternatively, the acoustic device may be a microphone wherein the diaphragm is adapted to vibrate when acoustic sound is incident thereon and the transducer is adapted to convert the vibration into an electrical signal.

The method and acoustic device of the present invention thus concerns the exploitation of bending wave modes. By contrast the piston and cone related prior art has sought to discourage modal behaviour, for example by using damping or specific structural and drive coupling aspects. However, the acoustic device of the present invention concerns the lowest bending frequencies. It does not require these modes to be densely or evenly distributed. The modes that are addressed are encouraged to radiate but their on-axis contribution is radiation balanced by mounting the transducer, the suspension and/or masses at the average nodal positions of modes in the operating frequency range.

The invention utilizes the principle of sound radiated by a simple free plate, that is the diaphragm, driven into bending by a theoretical pure point force with no associated mass. This cannot be achieved in practice as the force has to be applied by a mechanism which will inevitably involve a mass, e.g. that due to a voice coil assembly of an electro-dynamic transducer or exciter. Also, a practical force will generally also be presented to the plate not at a single point, but along a line, as in a circular coil former.

The designer of the acoustic device has the freedom within the principle of the invention to tune the performance for varying situations and applications by adjusting the net transverse modal velocity, globally, or selectively with frequency. For example, a different frequency characteristic may be required at different frequencies or a different angle of radiation for certain applications, e.g. in a vehicle, the listener is off-axis.

The following aspects of the invention also utilize the same principle and have the same subsidiary features.

According to another aspect of the invention, there is provided an acoustic device having an operating frequency range comprising a diaphragm having a circular periphery and a centre of mass and the diaphragm being such that it has resonant modes in the operating frequency range, and a transducer coupled to the diaphragm and adapted to apply bending wave energy thereto in response to an electrical signal applied to the transducer, the transducer being coupled to the diaphragm at a first average nodal position of modes in the operating frequency range, and at least one mass coupled to or integral with the diaphragm at a second average nodal position of modes in the operating frequency range.

According to another aspect of the invention, there is provided a loudspeaker having an operative frequency range comprising a diaphragm having a centre of mass and the diaphragm being such that it has resonant modes in the operating frequency range, transducer means coupled to the diaphragm and adapted to apply bending wave energy thereto in response to an electrical signal applied to the transducer, the transducer means being coupled to the diaphragm at opposed positions spaced from the centre of mass of the diaphragm, and at a first average nodal position of modes in the operating frequency range, and at least one pair of masses integral with, or coupled to, the diaphragm at opposed positions spaced from the centre of mass of the diaphragm and located at a second average nodal position of modes in the operating frequency range.

From yet another aspect, the invention is a method of making a loudspeaker having an operating frequency range and having a planar diaphragm with a circular periphery and a centre of mass, comprising choosing the diaphragm parameters to be such that it has resonant modes in the operating frequency range, coupling a transducer to the diaphragm and concentrically with the centre of mass of the diaphragm, to apply bending wave energy thereto in response to an electrical signal applied to the transducer, and coupling a resilient suspension to the diaphragm concentrically with the centre of mass of the diaphragm and away from its periphery and located at an annulus at an average nodal position of modes in the operating frequency range.

From a further aspect, the invention is a method of making a loudspeaker having an operating frequency range and having a planar diaphragm with a circular periphery and a centre of mass, comprising choosing the diaphragm parameters to be such that it has resonant modes in the operating frequency range, coupling a transducer to the diaphragm to apply bending wave energy thereto in response to an electrical signal applied to the transducer at a first average nodal position of modes in the operating frequency range and adding at least one mass to the diaphragm at a second average nodal position of modes in the operating frequency range.

BRIEF DESCRIPTION OF DRAWINGS

The invention is diagrammatically illustrated, by way of example, in the accompanying drawings, in which:—

FIG. 40*a* is a plan view of another embodiment of the present invention;

FIG. 40*b* is a cross-sectional view along line AA of FIG. 40*a;*

FIG. 41*a* is a graph of the first four mode shapes for the diaphragm of the embodiment of FIG. 40*a;*

FIG. 55*c* is a side view of the quarter diaphragms of FIGS. 55*a* and 55*b;*

FIGS. 56*a* and 56*b* shows the variation of on-axis sound pressure and sound pressure at 45° with frequency for a loudspeaker without and with suspension balancing masses respectively;

BEST MODES FOR CARRYING OUT THE INVENTION

Figure 1A:
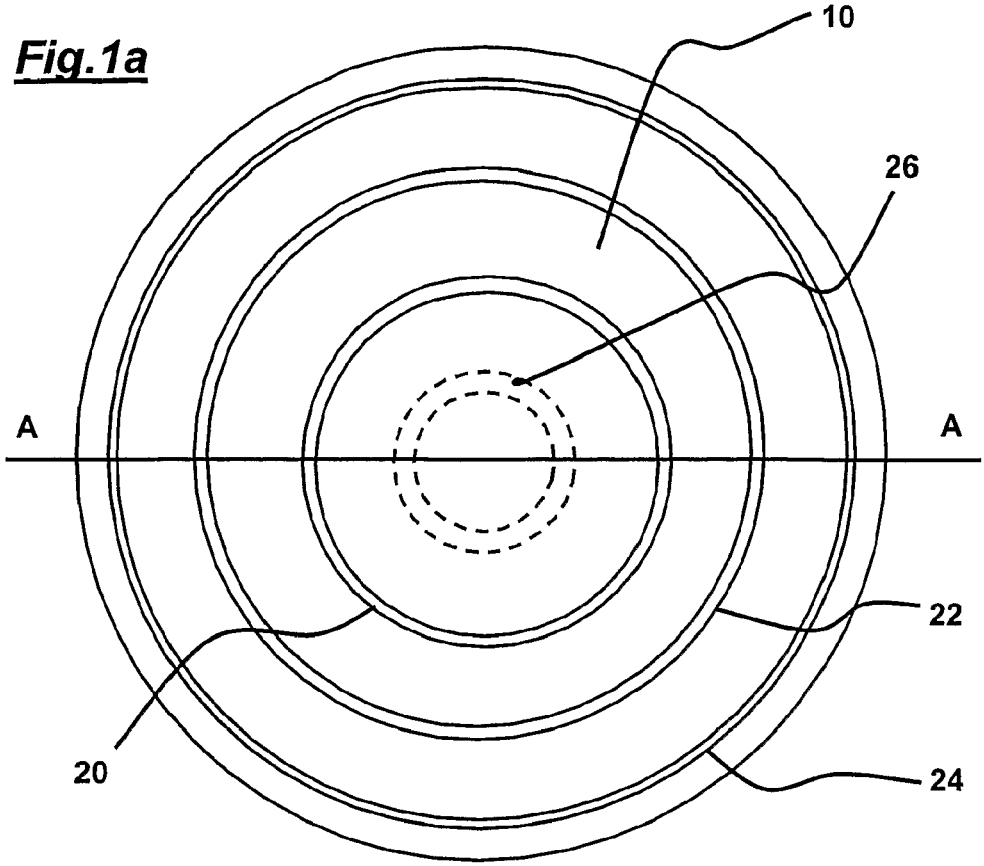
FIG. 1*a* is a plan view of a first embodiment of the present invention.
Figure 1B:
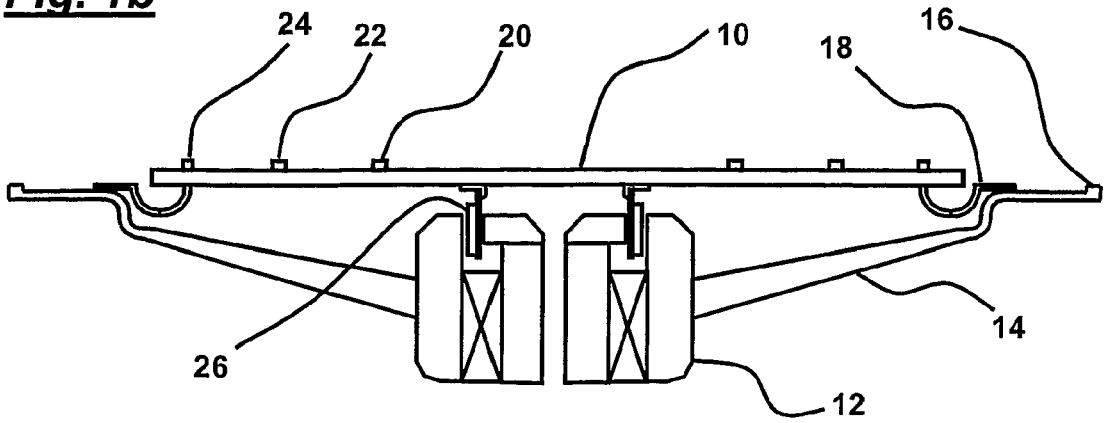
FIG. 1*b* is a cross-sectional view along line AA of FIG. 1*a;*

FIGS. 1*a* and 1*b* show a loudspeaker comprising a diaphragm in the form of a circular panel 10 and a transducer 12 having a voice coil 26 concentrically mounted to the panel 10. Three ring-shaped (or annular) masses 20,22,24 are concentrically mounted to the panel 10 using adhesive tape. The voice coil and masses are each located at annular positions which may be termed positions 1 to 4 with position 1 being the innermost location and position 4 the outermost.

The panel and transducer are supported in a circular chassis 14 which comprises a flange 16 to which the panel 10 is attached by a circular suspension 18. The flange 16 is spaced from and surrounds the periphery of panel 10 and the suspension 18 is attached at an annulus spaced from the periphery of the panel 10. In this way, the panel edge is free to move which is important since there is an anti-node at this location. Similarly, there are no masses located at the centre of the panel since there is also an anti-node at this location. The transducer 12 is grounded to the chassis 14.

The panel 10 is made from an isotropic material, namely 5 mm thick Rohacell™ (expanded poly methylimide) and has a diameter of 125 mm. The masses are brass strip and are 1 mm thick. The locations of the voice coil 26, each mass and the suspension are average nodal positions of the modes of the panel which appear in the operating frequency range and are calculated as described in FIGS. 7*a* to 10.

The values of the masses are scaled relative to their location and the mass of the voice coil as described in FIGS. 11*a* to 11*e*. The values are set out in the table below:

| Component | Ratio of component diam. to panel diam. | Diameter (mm) of component | Mass (g) of component |
|---|---|---|---|
| Voice coil 26 | 0.2 | 25 | 1.4 |
| Mass 20 at position 2 | 0.44 | 55 | 3.1 |
| Mass 22 at position 3 | 0.69 | 86 | 4.6 |
| Mass 24 at position 4 | 0.91 | 114 | 2.2 |
| Suspension 18 | 0.91 | 114 | 4.0 |

Figure 2A:
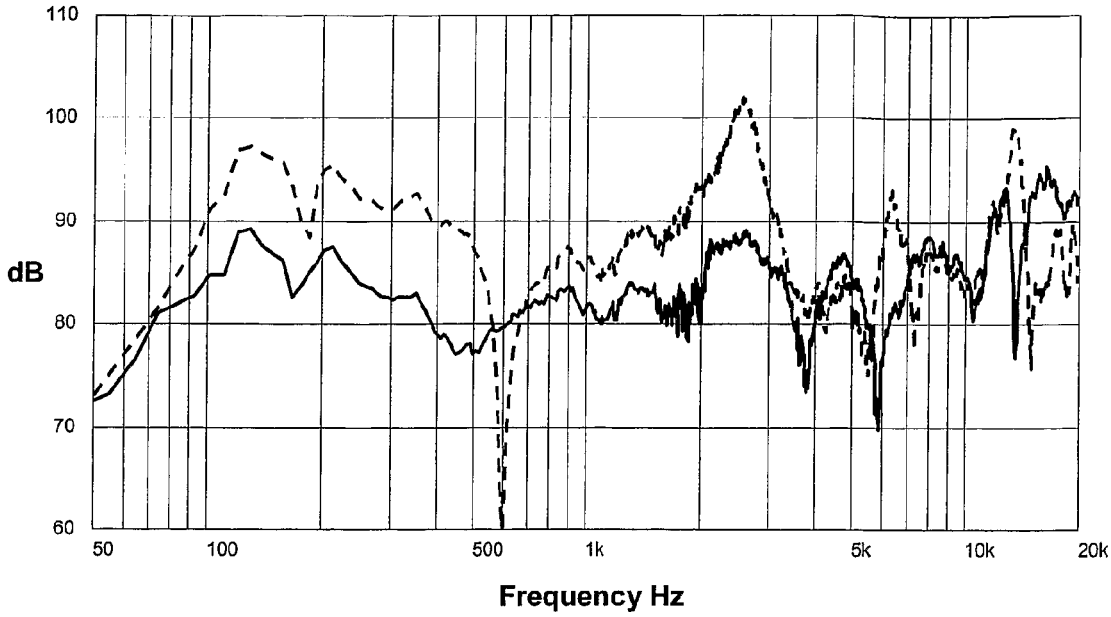
FIG. 2*a* is a graph showing the variation of on-axis sound pressure with frequency for the device of FIG. 1*a* with and without masses.
Figure 2B:
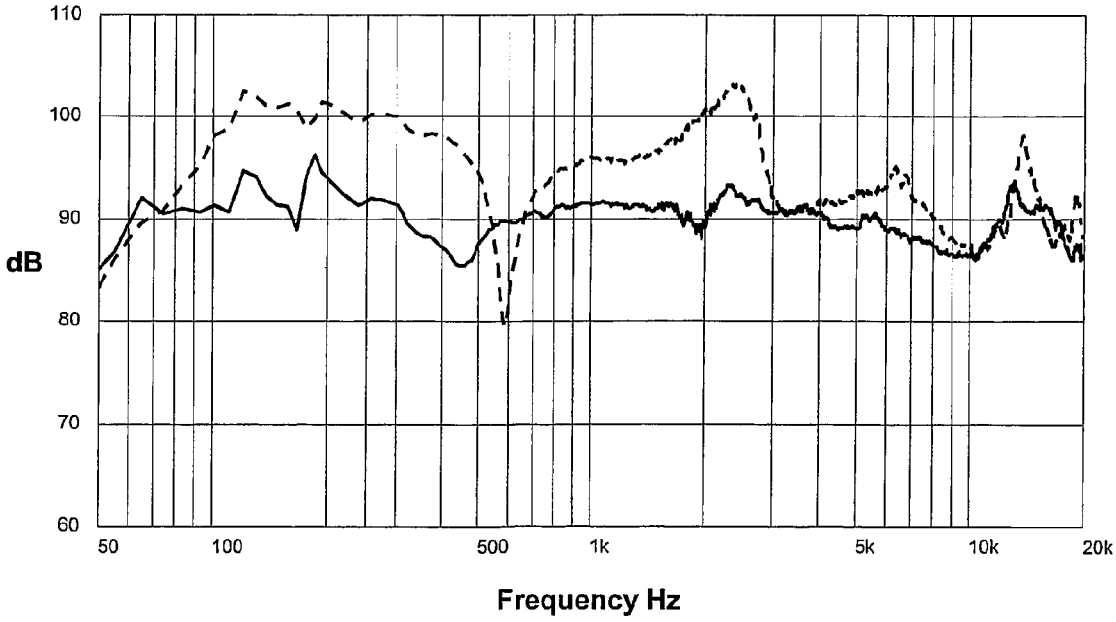
FIG. 2*b* is a graph showing the variation of the half space power (i.e. integrated acoustic power over the hemisphere in front of the embodiment) with frequency for the device of FIG. 1*a* with and without masses.

FIGS. 2*a* and 2*b* show the on-axis pressure and half space power for the loudspeaker with the three ring masses (solid line) and without the masses (dashed line). The loudspeaker with the masses has an extended off-axis frequency response and has improved sound quality and intelligibility over the listening region. Another advantage is that the device with masses is coherent with no significant delay with frequency. Accordingly, accurate stereo images may be formed.

Figure 3:
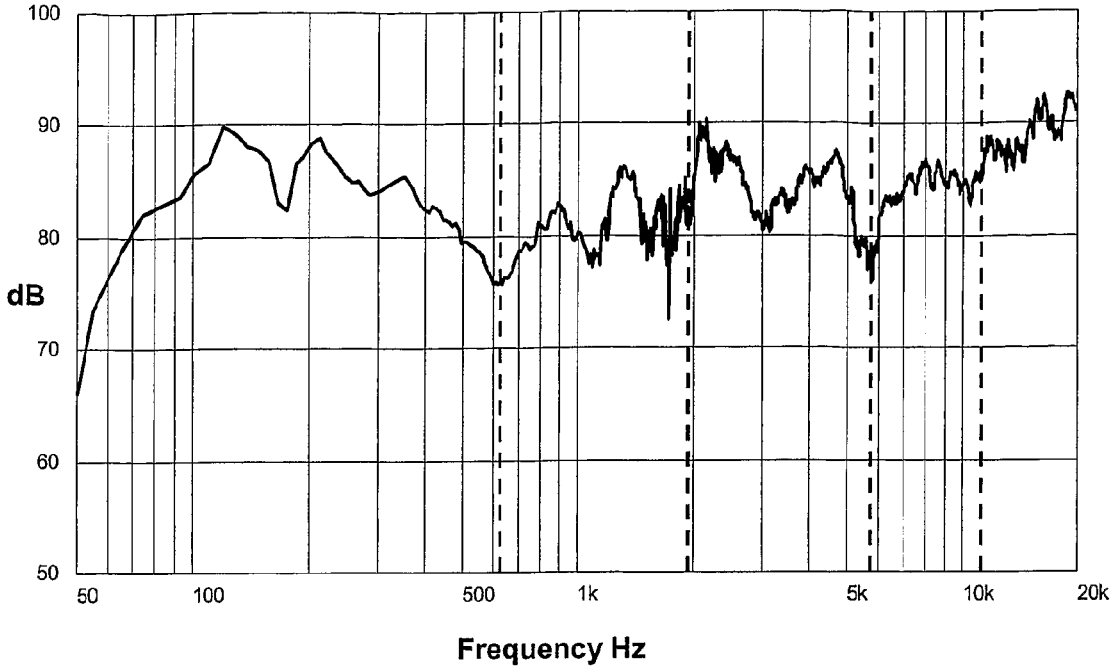
FIG. 3 is a graph showing the variation of voltage sensitivity with frequency for the device of FIG. 1*a* divided into bands associated with each mass.

The mass of the loudspeaker diaphragm assembly without masses is 11.8 g and the masses add an extra 10.8 g. As is shown in FIGS. 2*a* and 2*b* this particular design leads to a loss of approximately 6 dB in the piston region (i.e. below 600 Hz). As shown in FIG. 3, the frequency range of the device may be split into bands (shown by the dashed lines) by the modes of the panel as determined by finite element analysis (FEA). Each band has a particular mass associated therewith and increasing the mass reduces the sensitivity of that band and vice versa. The sensitivity of the piston region is controlled by the mass at the outermost position. There is a decrease in the mechanical impedance of the panel towards the periphery and thus less mass may be required at the outermost position.

Figure 4A:
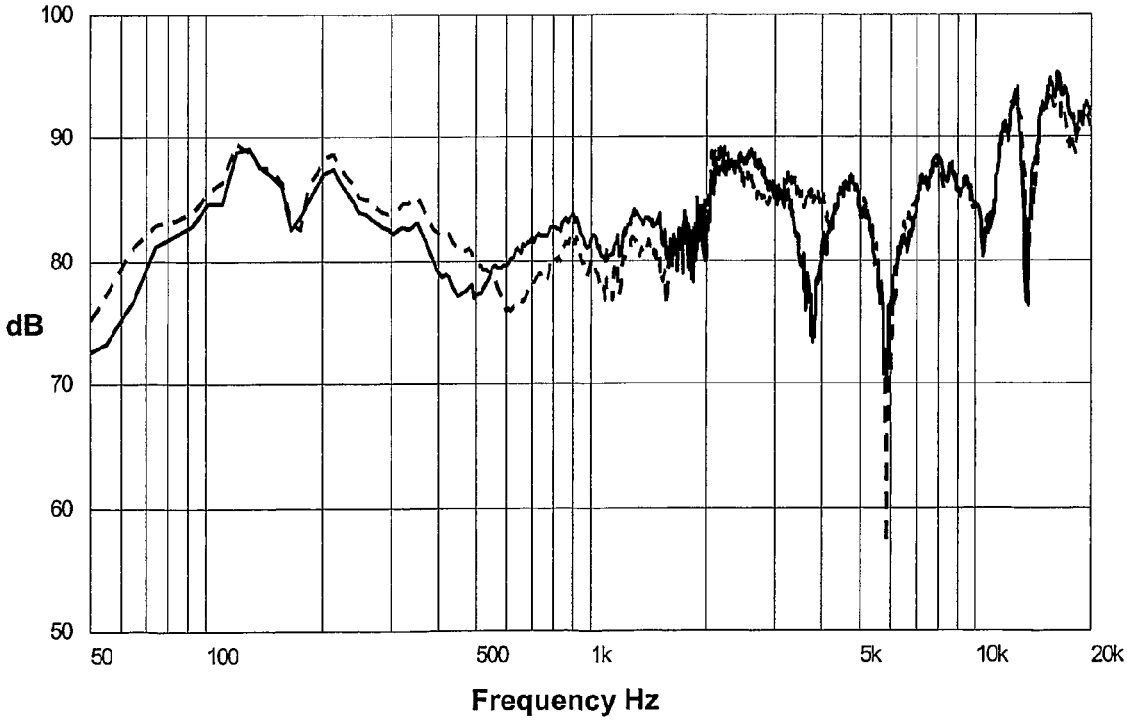
FIG. 4*a* is a graph showing the variation of voltage sensitivity with frequency for the device of FIG. 1*a* with two different masses at the outermost position.

FIG. 4*a* shows the effect of reducing the overall mass at position 4 by 1.25 g. The dashed line shows the response for the reduced mass and the solid line, the higher mass. There is an increase in sensitivity from 150 to 600 Hz as expected. However, there is a decrease in sensitivity in the mid-band which suggests that the mass at the outermost position affects the frequency response up to 4 kHz. The sensitivity below 150 Hz is unchanged. The mass contribution of the suspension may vary with frequency and the mass contribution was determined at 85 Hz which may be a source of error in respect of precisely balancing modes at higher frequencies.

Figure 4B:
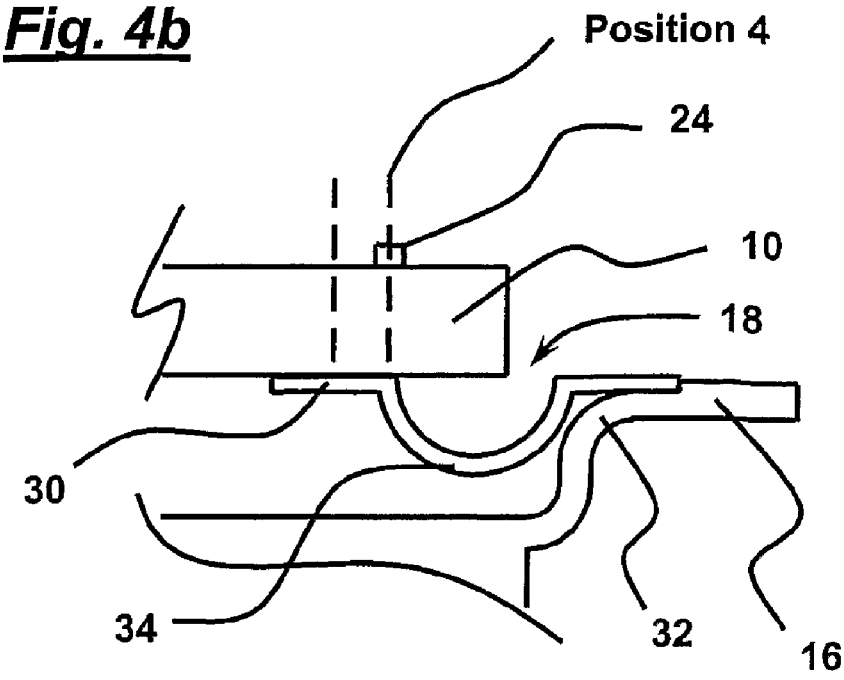
FIGS. 4*b* and 4*c* are cross-sectional views of the outer section of the devices measured in FIG. 3*a;*
Figure 4C:
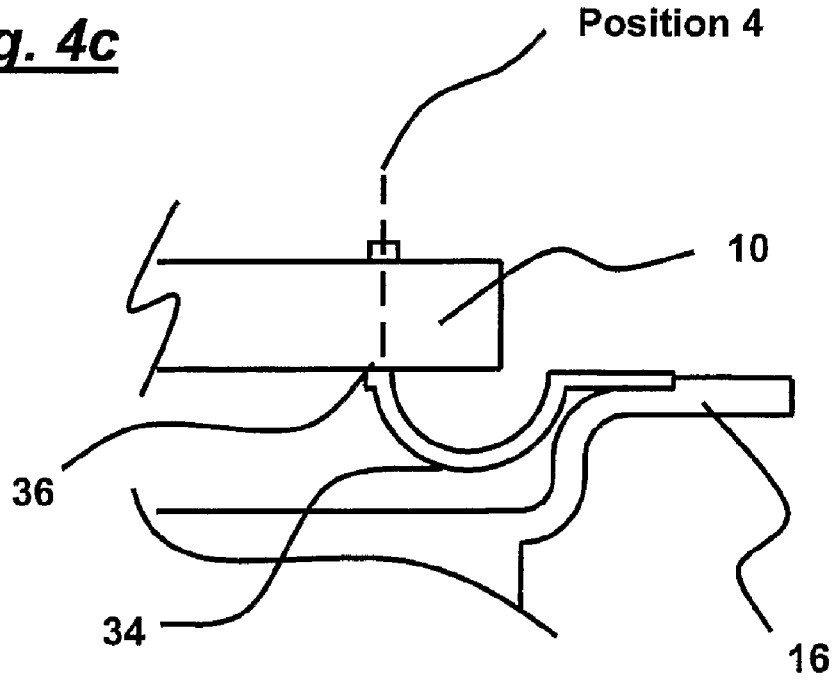

FIGS. 4*b* and 4*c* show how the reduction in mass at the outermost position is achieved. The suspension 18 used in the device of FIG. 4*b* (and FIG. 1*a*) has a symmetrical cross-section comprising two equal sized flanges 30,32 extending either side of a semi-circular section 34. The flanges 30,32 are attached to the panel 10 and the flange 16 of the chassis respectively. In FIG. 4*c*, the majority of the flange 36 attached to the panel 10 has been removed to reduce the suspension mass by 0.25 g. The mass 40 has also been reduced to 1 g to provide the overall reduction of 1.25 g.

Figure 5A:
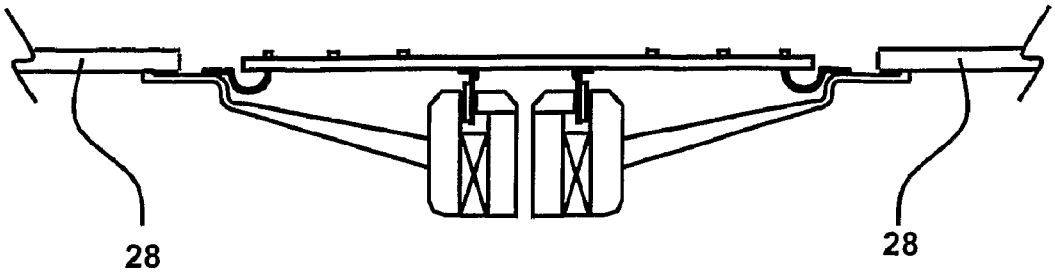
FIG. 5*a* is cross-sectional view of the device of FIG. 1*a* mounted in a baffle.
Figure 5B:
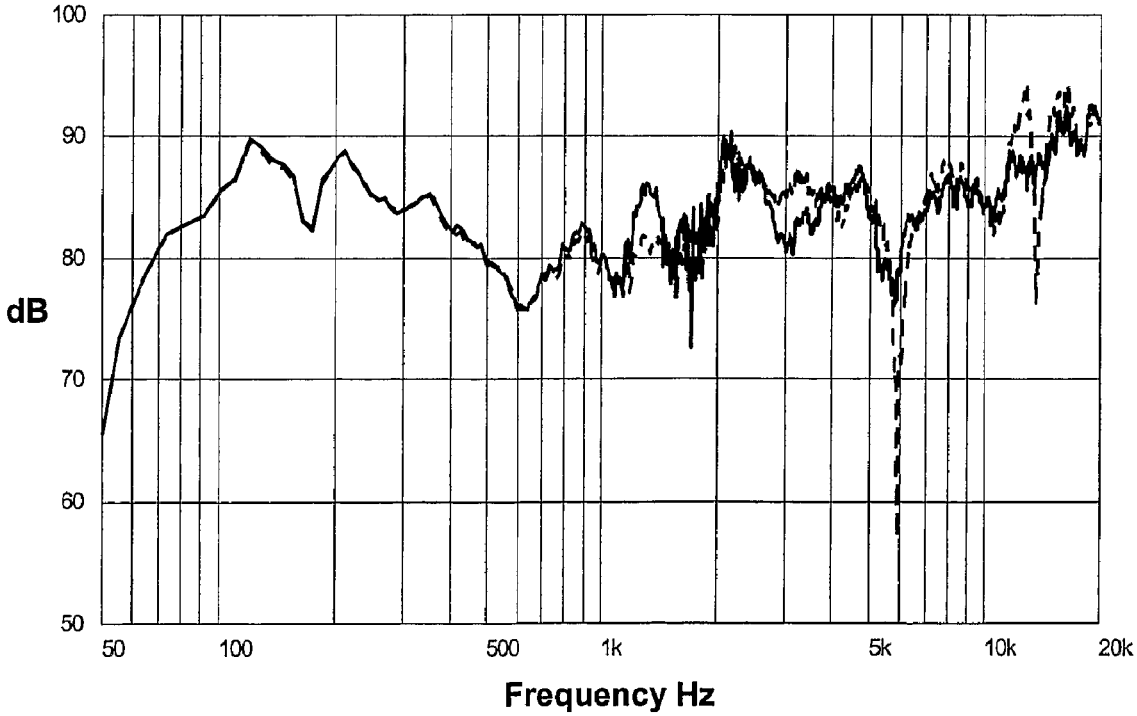
FIG. 5*b* is a graph showing the variation of voltage sensitivity with frequency for the device of FIG. 1*a* mounted in a stepped baffle and a flush-fitted baffle.

FIGS. 2*a* and 2*b* suggest there is diffraction from the panel edges. FIG. 5*a* shows the device of FIG. 1*a* mounted in a baffle 28. FIG. 5*b* shows a simulation of the sensitivity of the device with a baffle (solid line) and without a baffle (dashed line). Flush mounting the device in a baffle smoothes the interference pattern seen at high frequencies.

In a second embodiment, the panel material was changed to 1 mm thick aluminium and the table below compares the material properties and mode values.

| Material | Rohacell ™ | Aluminium |
|---|---|---|
| Mode 1 (Hz) | 735 | 615 |
| Mode 2 (Hz) | 3122 | 2628 |
| Mode 3 (Hz) | 7120 | 6000 |
| Mode 4 (Hz) | 12,720 | 10,723 |
| Mode 5 (Hz) | 19,921 | 16,797 |
| Coincidence (Hz) | 10,200 | 11,180 |
| Plate thickness (mm) | 5 | 1 |
| Plate mass (g) | 6.0 | 28.7 |
| Arial density (kg/m^2) | 0.55 | 2.71 |
| Bending stiffness (Nm) | 1.85 | 7.62 |

The aluminium panel has a significantly higher bending stiffness. This does not significantly change the on-axis pressure or sound power but does change the frequency of the modes. Thus in general the stiffness may be chosen or adjusted to ensure that the panel is modal soon enough relative to the panel diameter to provide good sound power with the benefit of high frequency extension and smoothness. Furthermore, although the frequency of the modes is different for each panel stiffness, the ratio of the frequency of each mode to the first mode is the same and is set out below. Thus the annular positions for the voice coil, masses and suspension remain the same. Furthermore, since the frequency of the fifth mode is 27 times that of the first mode, by addressing the first five modes, coverage of approximately 6 octaves of modal balancing may be achieved to be added to the piston range.

| Mode number | Relative frequency |
|---|---|
| 1 | 1.000 |
| 2 | 4.246 |
| 3 | 9.683 |
| 4 | 17.299 |
| 5 | 27.092 |

Figure 6A:
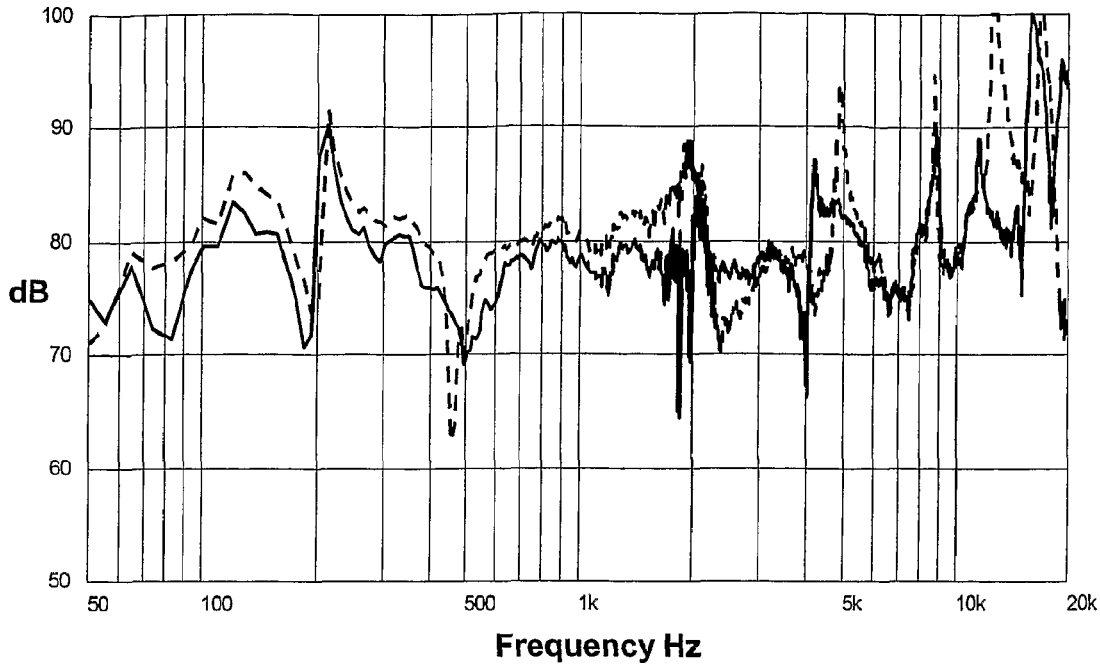
FIGS. 6*a* and 6*b* are graphs showing the variation of on-axis sound pressure and half space power with frequency, respectively for a second embodiment of the invention with and without masses.
Figure 6B:
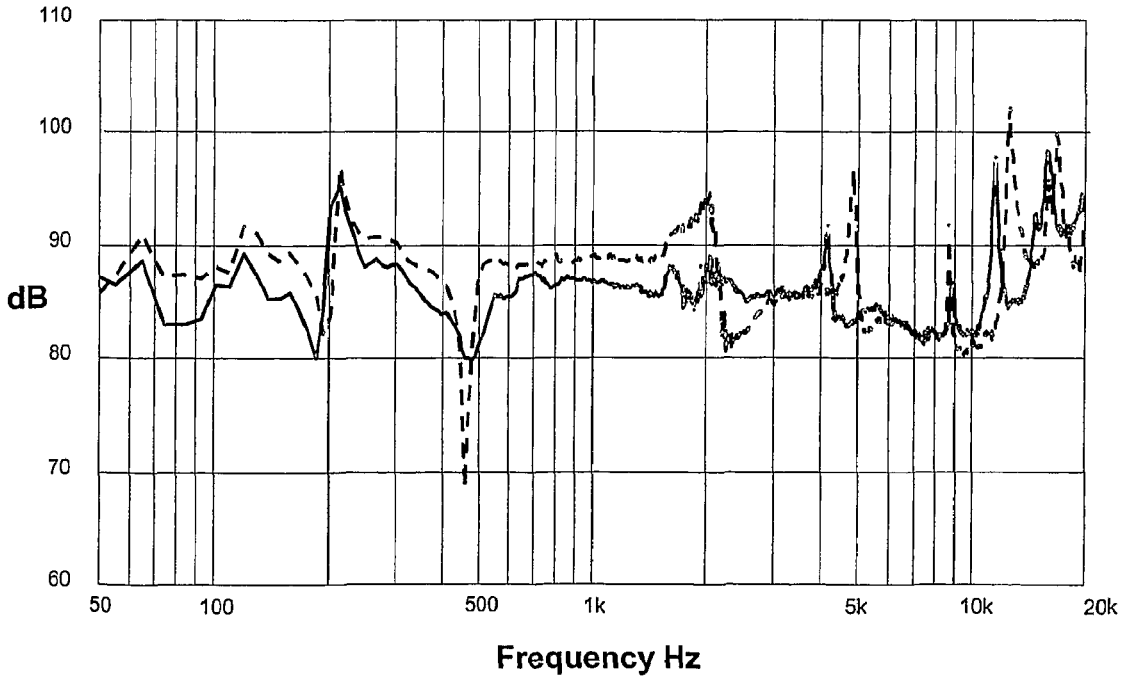

FIGS. 6*a* and 6*b* show the on-axis sound pressure and 180 power for the device using an aluminium panel. The solid line shows the device with masses and the dashed line without masses. As shown, the device without masses is unusable while the addition of the three masses gives significant performance improvements. The greatest improvement is shown in the mid-band, particularly around the frequency of the second mode, namely 2.6 kHz. The improvement is not as marked as for the embodiment using a Rohacell™ panel since the aluminium panel is significantly heavier and has lower damping. Accordingly, the ratio of added masses to panel mass is reduced and the overall sensitivity loss is reduced. The large peak at 16 kHz appears to be unaffected by the addition of the masses shown, perhaps because it is due to the sixth mode.

Figure 7A:
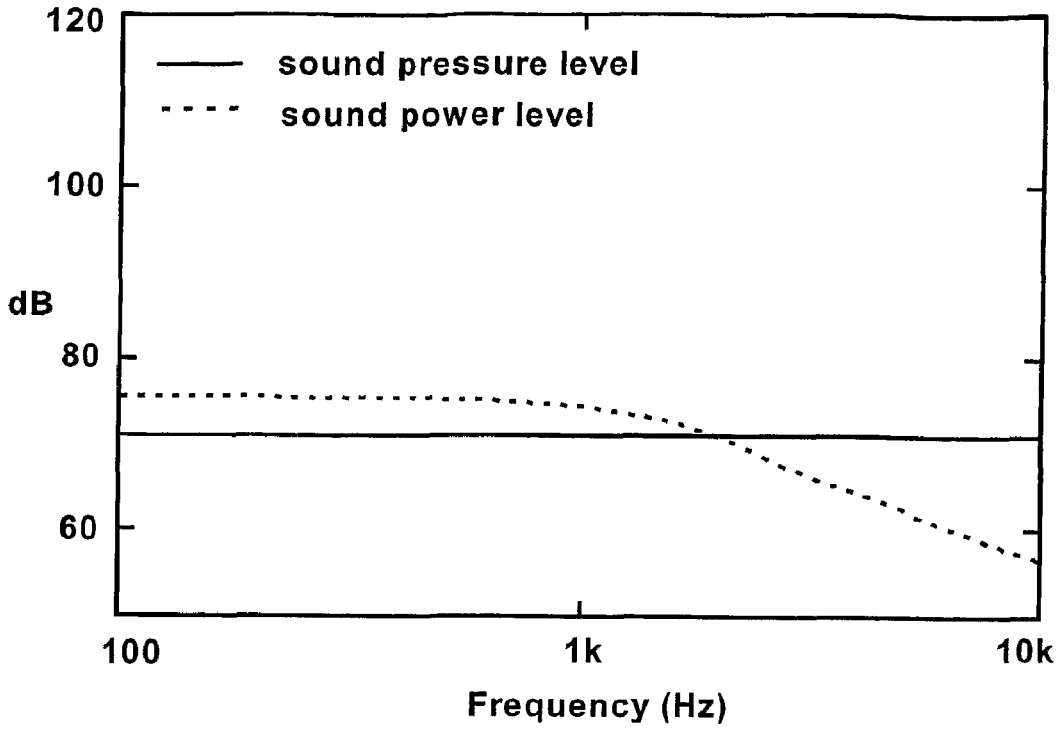
FIGS. 7*a*, 7*b* and 7*c* are graphs showing the variation of on-axis sound pressure and half space power with frequency for two theoretical loudspeakers and a practical loudspeaker respectively.

FIGS. 7*a* to 10 illustrate a method for choosing the annular positions of the masses and suspension and the drive location for the devices of FIGS. 1*a* and 6*a*. FIG. 7*a* shows the sound pressure and sound power levels for a theoretical pistonic loudspeaker comprising a free circular, flat, rigid panel driven by a mass-less point force applied at the panel centre. The sound pressure is constant with frequency while the sound power is constant until approximately 1 kHz and thereafter it falls away gradually with increasing frequency. [ka>2]

Figure 7B:
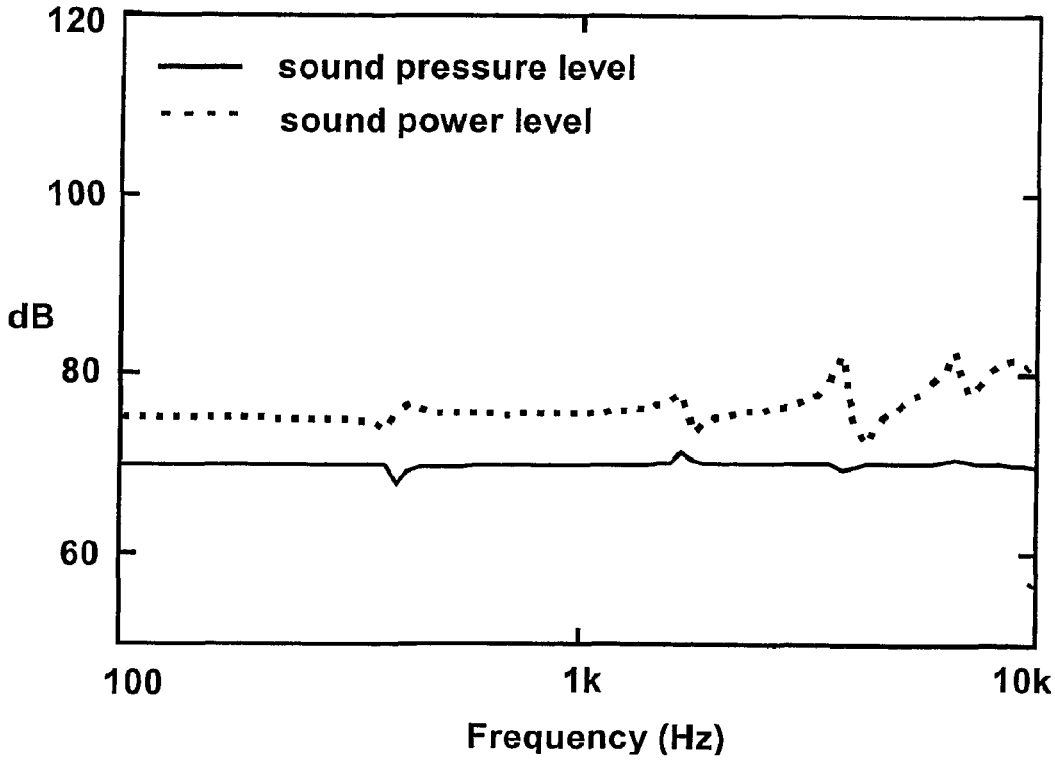

FIG. 7*b* shows the sound pressure and sound power levels for a theoretical loudspeaker comprising a free, resonant circular panel driven by a mass-less point force applied at the panel centre. The sound pressure is still substantially constant with frequency but now the fall-off in sound power has been significantly improved compared to that shown in FIG. 7*a*. Panel modes are now visible on the analysis since the model uses no electromechanical damping. If the modes were invisible the free resonant circular panel delivers constant on-axis sound pressure, as well as substantially constant sound power.

Figure 7C:
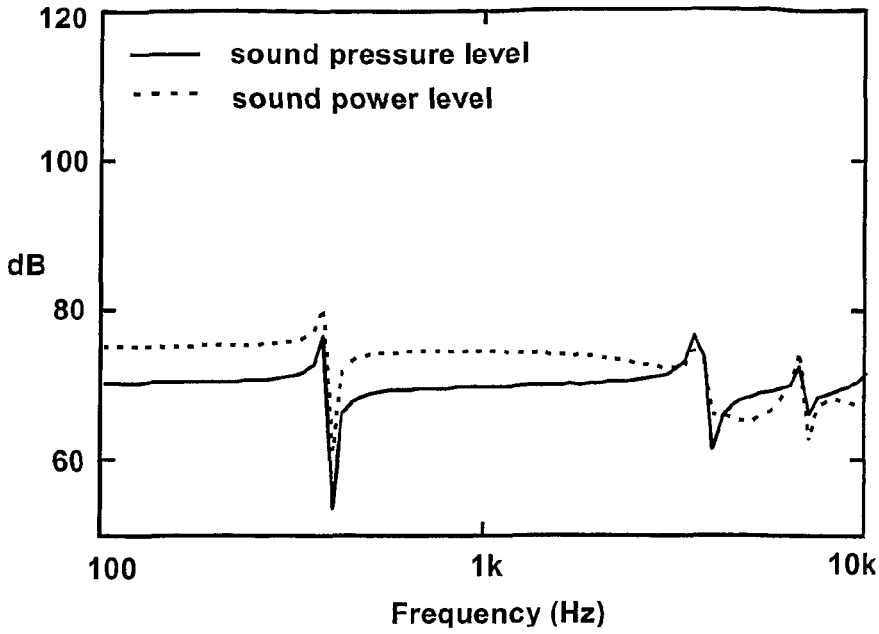

FIG. 7*c* shows the sound pressure and sound power levels for a practical loudspeaker similar to that of FIG. 7*b* but driven by a transducer with a voice coil having a 25 mm diameter and a finite mass which is dependent upon the design of the voice coil (materials, turns, etc.). The fall-off in sound power with frequency is still improved compared to that in FIG. 7*a*. However, now both the on-axis pressure and sound power are no longer constant with frequency.

Figure 8:
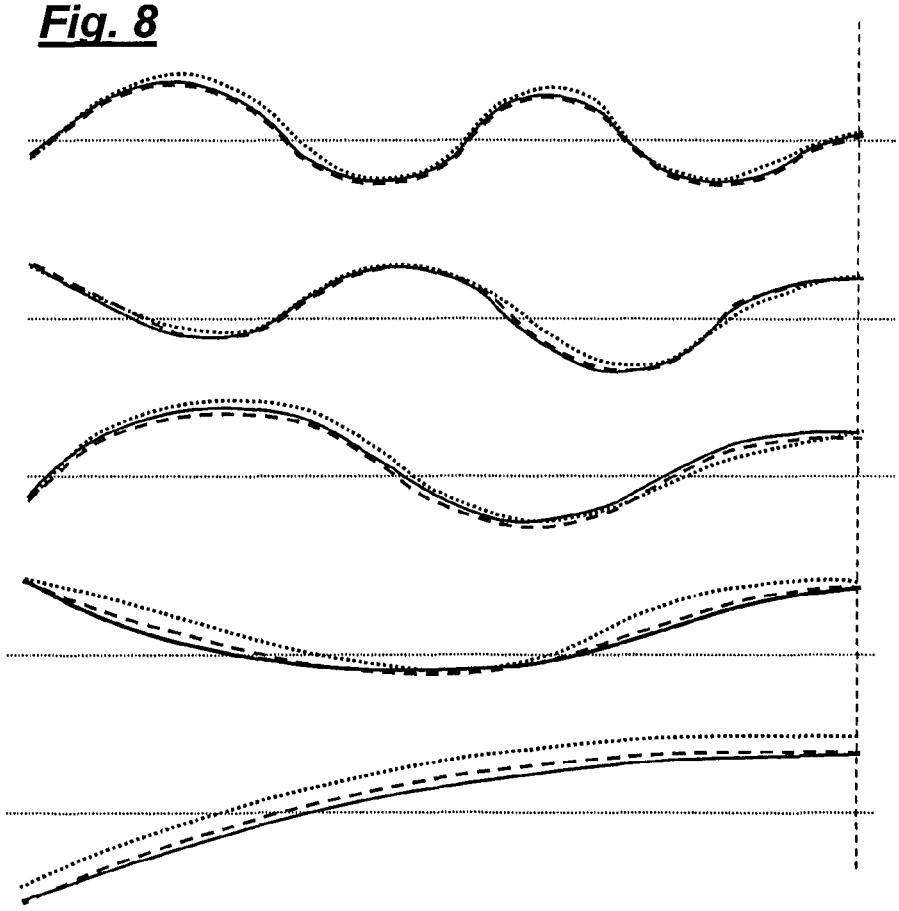
FIG. 8 shows part of the velocity profiles for the loudspeakers of FIGS. 7*b* and 7*c;*

Since the loudspeakers are axisymmetric, simple modelling may be used for the modes. FIG. 8 shows the velocity profiles for the first five modes in the generator plane of the loudspeakers of FIGS. 7*b* and 7*c*. The straight dashed line represents the axis of symmetry and the dotted line is generator plane. There is a poor fit between the two sets of modes. The modes of the theoretical ideal of FIG. 7*b* are inertially balanced to the extent, that except for the "whole body displacement" or "piston" mode, they all have zero mean displacement (i.e. the area enclosed by the mode shape above the generator plane equals that below the plane).

In contrast, the modes of the practical loudspeaker of FIG. 7*c* are not balanced. However, this behaviour may be addressed by mathematically mapping the nodal contours and hence modes and velocity profile of the practical loudspeaker to those of the ideal theoretical loudspeaker. This may be achieved by calculating the locations where the admittance Ym is at a minimum for the modes of the theoretical loudspeaker and mounting the voice coil, suspension and/or masses at these locations.

The dashed curved line in FIG. 8 corresponds to the corrected situation using the mean admittance minima or nodes. As shown in FIG. 8, the dashed line set of modes is a better fit to the solid line set of modes (i.e. the theoretical ideal) than the dotted line set. In FIG. 8, the vertical dashed line represents the axis of symmetry and the horizontal dotted line is the generator plane.

The impedance Zm and real part of the admittance Ym are calculated from a modal sum and thus their values depend on the number of modes considered. The admittance Ym and its logarithmic mean $\mu(\rho)$ as it varies with radius $\rho$ are calculated using the equations below:

$$Ym(N, \omega, \rho) := j \cdot \omega \cdot \sum_{i=0}^{N} \frac{y(i, \rho)^2}{(\lambda_i)^4 - \omega^2 + j \cdot 5 \cdot \% \cdot \omega \cdot (\lambda_i)^2}$$

$$S := \int_{0.3}^{2.3} 10^{\phi}\, d\phi \quad \mu(\rho) := \frac{1}{S} \cdot \int_{0.3}^{2.3} 10^{\phi} \cdot \log(\mathrm{Re}(Ym(3, 10^{\phi}, \rho)))\, d\phi$$

N=Number of nodes.

S Scaling factor over the operative frequency range.

$\lambda_i$=eigenvalue≈$(n-\frac{1}{2})\cdot\pi/(1-\rho_0)$; $\rho_0=0.2$ $\omega$=frequency.

$\gamma(i, \rho)$=mode shape of $i^{th}$ mode.

FIGS. 9*a* to 9*e* show the variation in Ym with panel diameter for one to five modes respectively. The minima are tabulated below:

| FIG. | Number of modes considered | Minima |
|---|---|---|
| 9a | 1 | 0.68 |
| 9b | 2 | 0.39, 0.84 |
| 9c | 3 | 0.26, 0.59, 0.89 |
| 9d | 4 | 0.2, 0.44, 0.69, 0.91 |
| 9e | 5 | 0.17, 0.35, 0.54, 0.735, 0.915 |

In the case of a panel with little damping, the width of each minimum is quite narrow. This suggests that mounting at the annular locations may be quite critical and that the tolerance may be as low as 2%. This particularly true for the first mode taken alone. For a panel with typical damping, such as a polymer film skinned foam core panel, the tolerance may increase to as much as 10%, as can be seen in FIGS. 9*d* and 9*e* and also in later similar Figures e.g. FIGS. 36*e* and 36*f*.

It should be noted that as the average is taken over an operative frequency range, modes at frequencies outside this range will not affect the result. This, in part, explains why modes five and higher generally have less effect than their predecessors. Thus, the higher order modes may be satisfactorily mapped if the first four modes are mapped when the higher modes are out of the frequency band of interest, and the panel is reasonably stiff in shear. When this is not true, then higher orders of modal balancing are possible The method is flexible enough to allow a designer to map only particular modes. The annular locations calculated for the first four or five modes correspond to the positions of the masses and voice coil in the devices of FIGS. 1*a* and 6*a*.

Figure 9A:
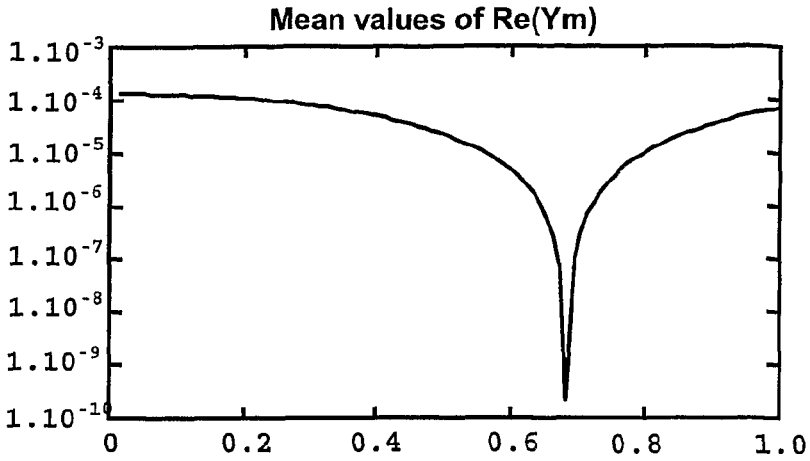
FIGS. 9*a* to 9*e* show the variation of the mean value of the real part of the admittance Ym with panel diameter for the first mode to the first five modes respectively.
Figure 9B:
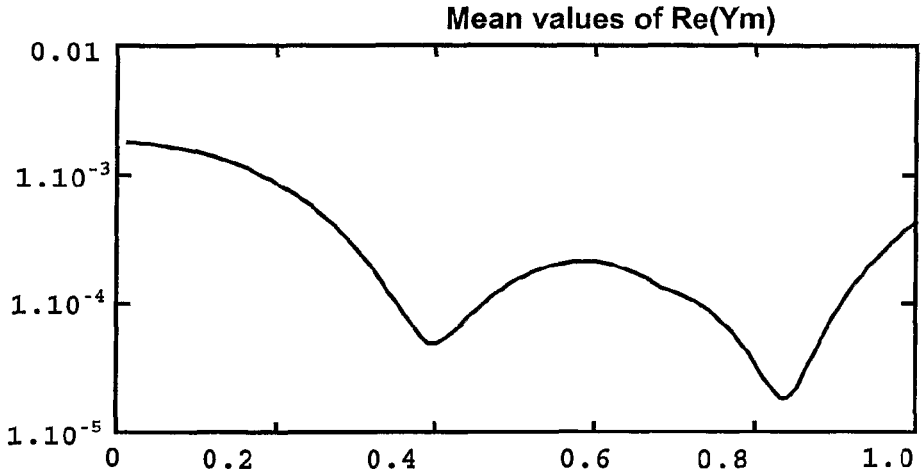
Figure 9C:
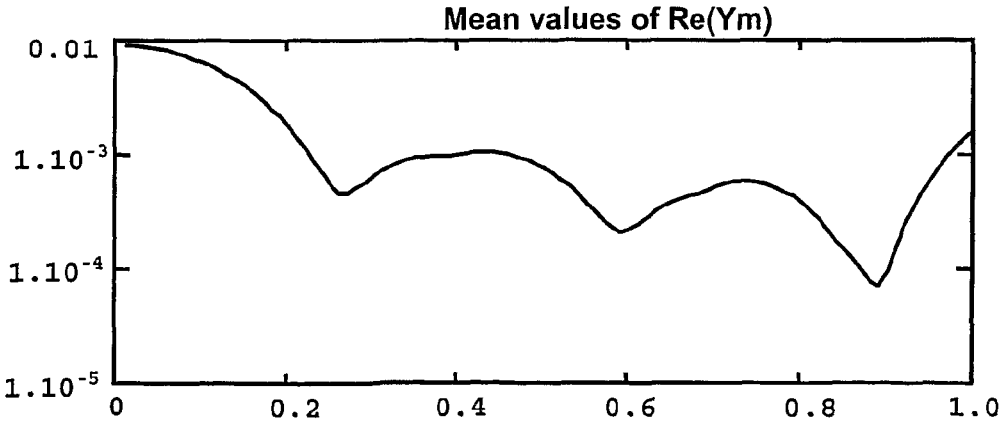
Figure 9D:
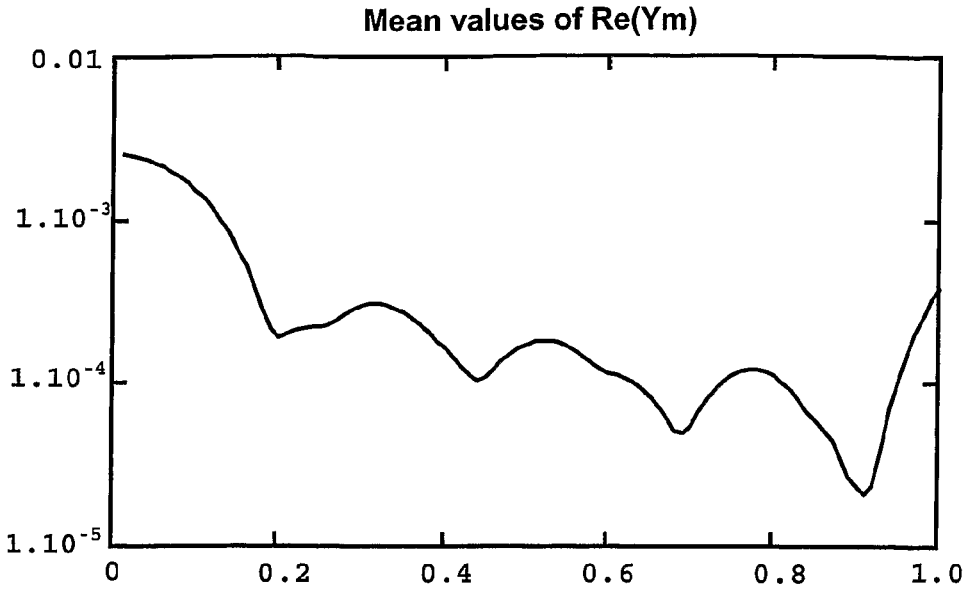
Figure 9E:
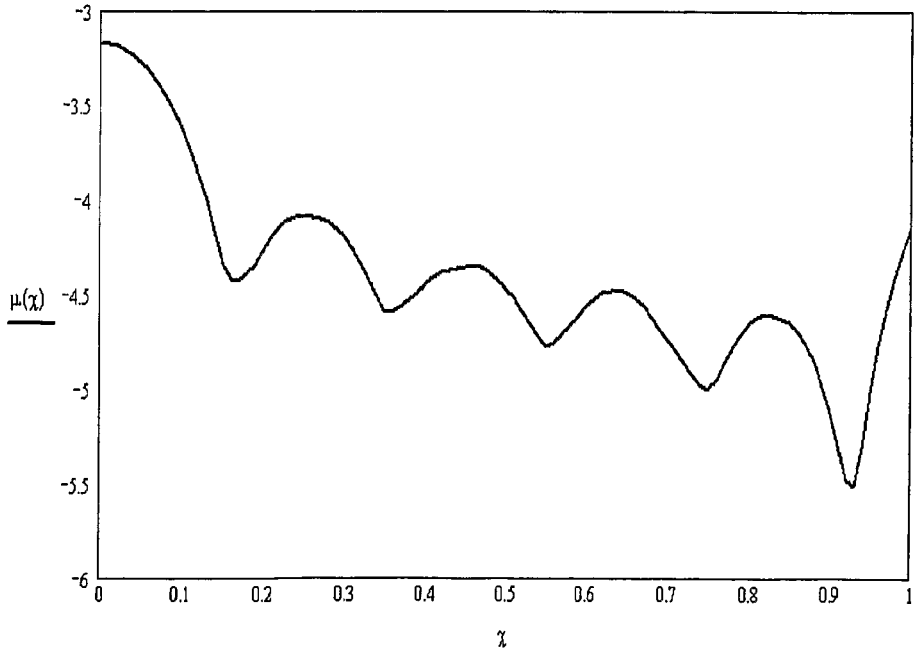
Figure 9F:
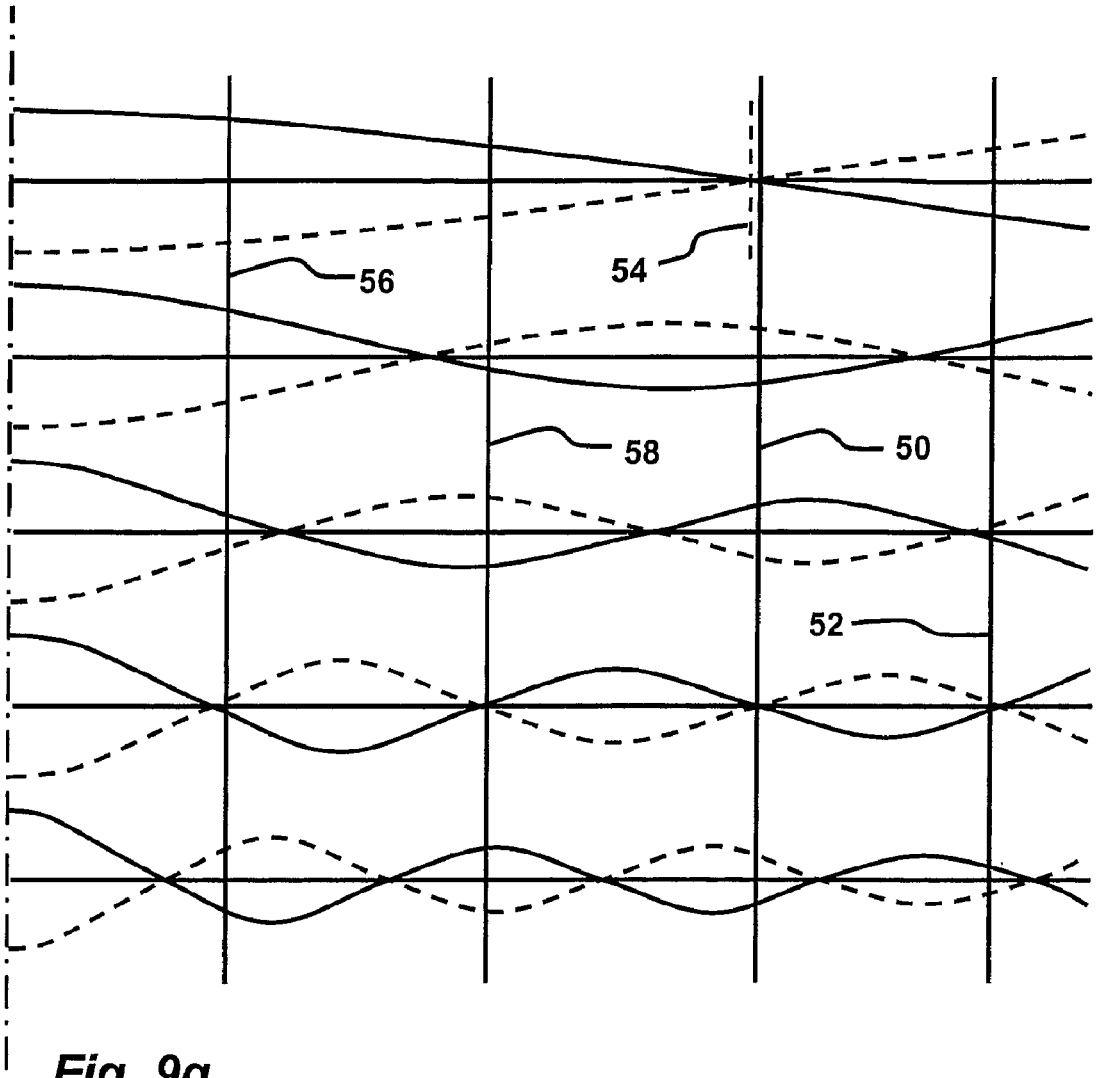
FIG. 9*f* shows the mode shapes for the first five modes and the annular locations.

FIG. 9*f* compares the annular locations with the mode shapes of the theoretical loudspeaker. At the first mode there are two annular locations 50,52 inboard of the nodal line 54 and two outboard 56,58. As the mode order increases there are annular locations disposed on opposite sides of the nodal lines 54.

Figure 9G:
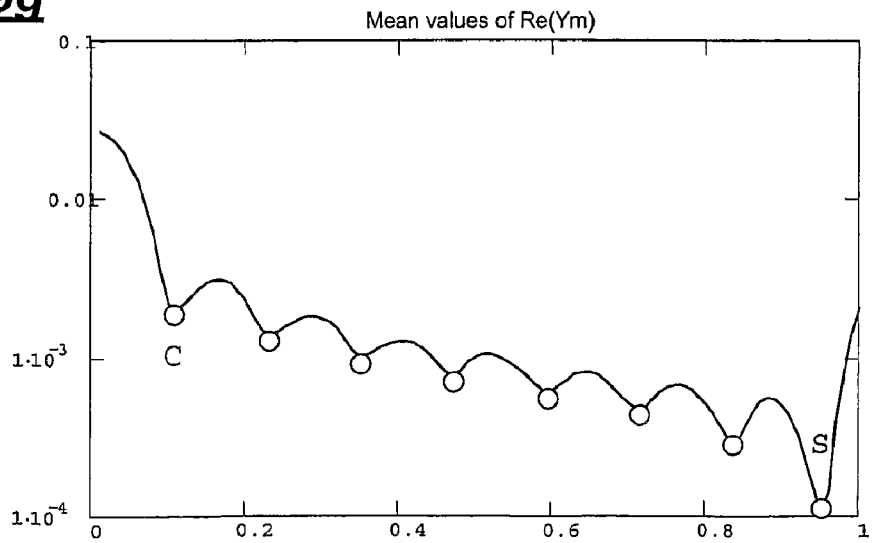
FIGS. 9*g* and 9*h* shows the variation of the mean value of the real part of the admittance Ym with panel diameter for the first eight mode modes with discrete and extended masses.

FIG. 9*g* shows that as the number of modes to be fixed increases (in this case to eight), there does seem to be, by observation, a pattern in the admittance curve which looks to be asymptotic. The ratios of inner and outer minima start to settle down to values of around 0.13 and 0.95 respectively. Also, with increasing mode order, the minima in the impedance become ever closer together which tends towards a continuum.

Figure 9H:
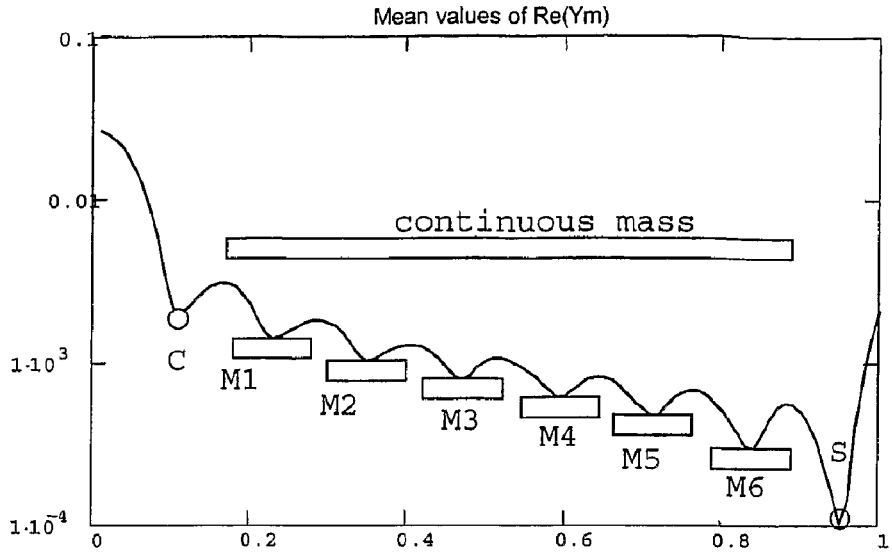

The masses to be mounted at the minina are still small and discrete and are shown as discrete circles. The location of the voice coil and the suspension are indicated by a C and S, respectively. In practice the masses may well be of extended size, and could be represented as shown in FIG. 9*h*. Here the discrete masses have been shown as extended rectangles and are almost touching. The discrete masses may be replaced by a single continuous mass, provided that this mass does not stiffen the panel.

Figure 9I:
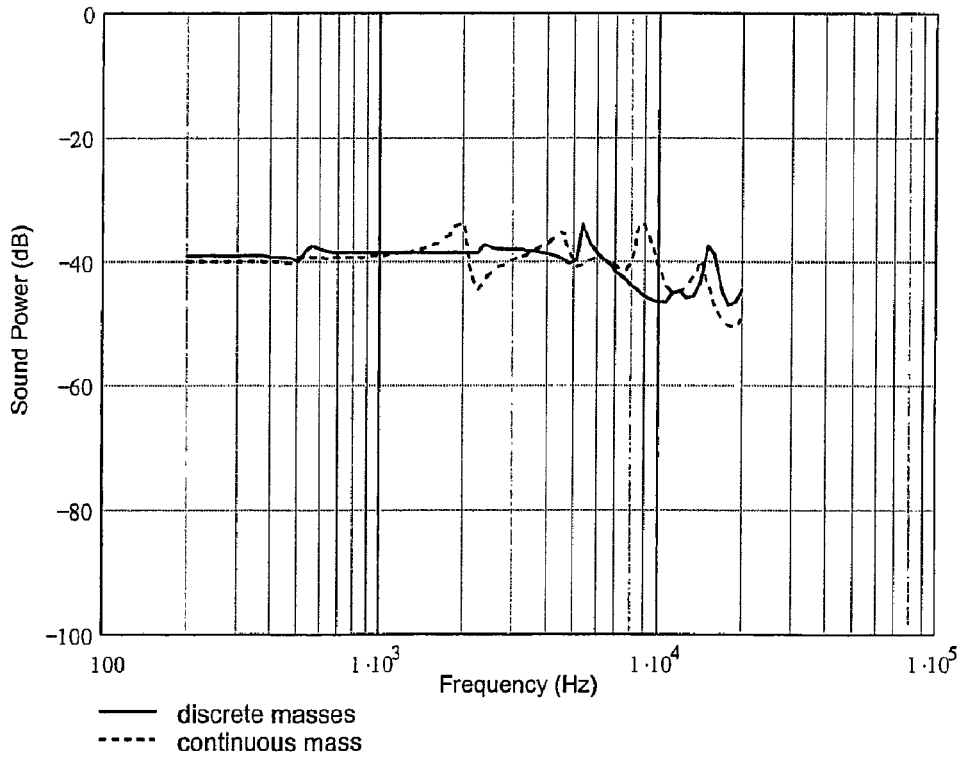
FIGS. 9*i* and 9*j* show the sound pressure level and sound power level varying with frequency for a four mode solution using discrete and continuous masses respectively.
Figure 9J:
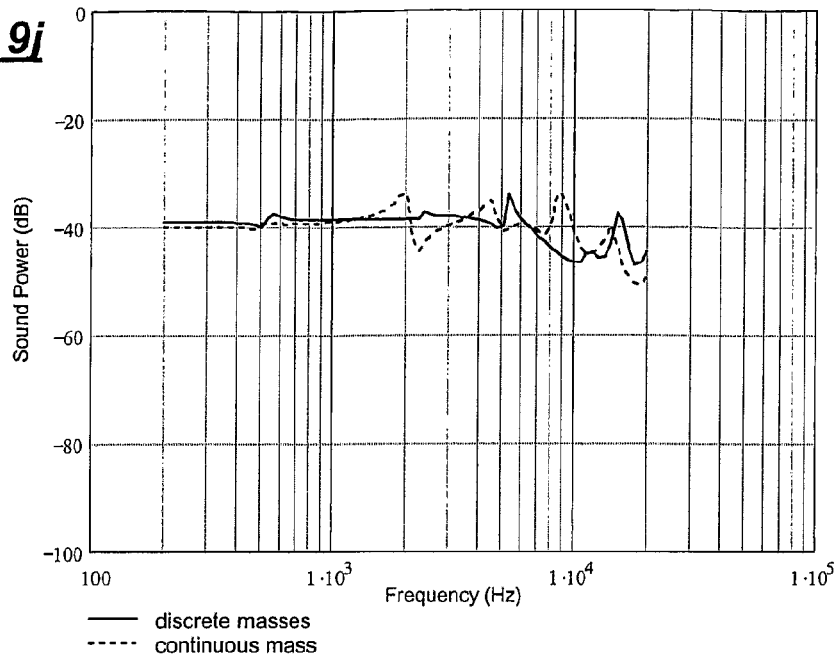

FIGS. 9*i* and 9*j* show the acoustic sound pressure and acoustic sound power for a loudspeaker using discrete masses M1 and M2 (solid line) and a loudspeaker using a continuous mass (dotted line). The solutions have a small amount of structural damping applied (5%).

Locations for masses in the discrete solution were:

| component | ratio |
|---|---|
| coil | 0.2 |
| M1 | 0.44 |
| M2 | 0.69 |
| suspension | 0.91 |

Locations for the continuous mass solution were:

| component | ratio |
|---|---|
| coil | 0.11 |
| mass start | 0.17 |
| mass finish | 0.88 |
| suspension | 0.95 |

The continuous mass was modelled as a very flexible thin shell with suitable density but very low Young's Modulus, thus avoiding any stiffening of the diaphragm. Although FIGS. 9*i* and 9*j* show that the responses of the loudspeakers are not identical, the continuous mass solution gives an acceptable result. There seems to be a small penalty in overall sensitivity and the continuous mass alternative may be simpler to implement. Nevertheless, the discrete mass solution is still preferred particularly since the design of the continuous mass solution is more limited, since the asymptotic values for coil and suspension position must be used.

It may be possible to reduce in amplitude some of the unwanted peaks in the continuous mass solution, if the continuous mass had a small amount of intrinsic damping. This may be achieved by using a material such as flexible rubber sheet, or the like, which gives the correct mass and a small amount of additional damping.

As an alternative to using admittance, net transverse modal velocity tending to zero may be achieved by optimisation as follows. First a model is defined, e.g. for a circular diaphragm consider a disc comprising concentric rings of identical material, with circular line masses at the junctions of the rings, the modal frequencies and mode shapes are solved from:

N—mode fix; μl=as per unit length of ring masses section 0 $\psi_0=A_0\cdot J0(k\cdot r)+C_0\cdot 10(k\cdot r)$ section n=1 . . . N $\psi_n=A_n\cdot J0(k\cdot r)+B_n\cdot Y0(k\cdot r)+C_n\cdot 10(k\cdot r)+D_n\cdot K0(k-r)$ Boundaries continuity $\psi(k\cdot r_n)_n=\psi(k\cdot r_n)_{n-1}$ $\psi(k\cdot r_n)_n=\psi(k\cdot r_n)_{n-1}$ $MR(k\cdot r_n)_n=MR(k\cdot r_n)_{n-1}$ $MR(k\cdot R)=0$ force balances $$QR(k\cdot r_n)_n = QR(k\cdot r_n)_{n-1} + \alpha_n\cdot\mu l\cdot\frac{\omega^2}{k^3\cdot B}\cdot\psi(k\cdot r_n)_{n-1}$$

$$\alpha_n = \begin{cases} 0.8 \text{ if } n = N \\ 1 \text{ otherwise} \end{cases}$$

$$QR(k\cdot R) = 0$$

where $\psi_0$ is the mode shape of the circular central section $\psi_n$ is the mode shape of the nth ring k is the wave number r is the radius μl is the mass pet unit length of the ring masses N is the number of the highest mode to be addressed J(0) is a Bessel function of the first kind, order 0

Y(0) is a Bessel function of the second kind, order 0

I(0) is a modified Bessel function of the first kind,

K(0) is a modified Bessel function of the second kind $A_n$, $B_n$, $C_n$ and $D_n$ are constants MR is the radial component of bending moment QR is the radial component of shear force α are the ratios of mass pet length of the ring masses to a reference mass per length, typically that of the voice-coil, and α=1 for all rings except the outermost ring, typically.

The net volume displacement is calculated from:

$$\int_0^R r\psi(kr)\,dr$$

Optimising the outermost $\alpha_N$ for fixed values of r so that the net volume displacement tends to zero gives values of $\alpha_N$ between about 0.75 and 0.80, depending on the exact values of $r_n$. The average nodal positions calculated using the admittance method described above give optimal values of $\alpha_N$ of about 0.79 to 0.80. If the actual nodal positions for the last mode are used, values of $\alpha_N$ of about 0.74 to 0.76 appear optimal.

As an example, the optimisation method is used to design a 92 mm diameter panel driven by a transducer having a 32 mm voice coil. The two mode solution calculated using the admittance method gives radial locations of 0.4 and 0.84 for the voice coil. However, the ratio of coil diameter to panel is 0.348.

Assuming, B=7 Nm, μ=0.45 kg/m$^2$, ν=1/3, R=0.046 m, Coil mass=1.5 gm, and by varying the position and mass of the outer ring in the optimisation method for two modes, i.e. N=2, by, we get;

$$r_N=0.816764\ \alpha_N=0.915268\ \sqrt{Err0}=4.578\times10^{-10}$$

Figure 9K:
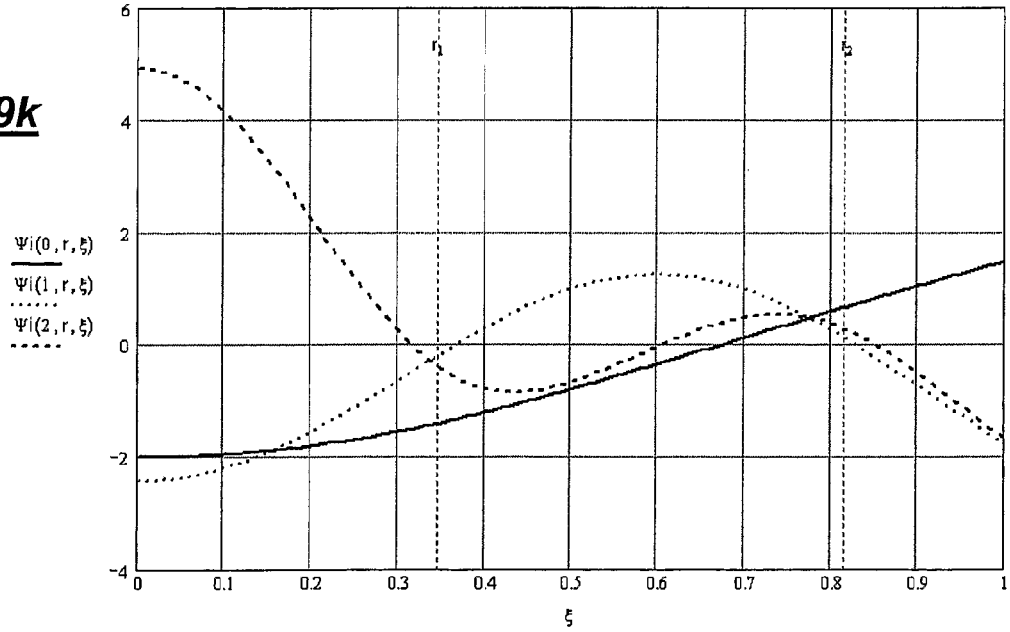
FIG. 9*k* shows the first three modes for a panel after the optimisation method.

Accordingly, by mounting a ring of diameter 75.14 mm (0.816764×2R=0.816764×92 mm) and of mass 3.224 gm (0.915268×75.14/32×1.5 gm) to the panel driven by the selected transducer, the modal residual volume displacements for the first two modes have all but vanished as shown in FIG. 9*k*. The third mode is still unbalanced.

As a second example, a mass is placed at each nodal line of the third mode, the values of the masses to balance the first two modes are then determined using optimisation. The results are:

Locations (ratio of radius): 0.257, 0.591 and 0.893

The optimised masses per unit length are also scaled as set out below in the following ratios 1, 0.982 and 0.744.

In the first two embodiments of the invention, the panel is driven at the innermost annular position (0.2). However, since the other annular positions are also average nodal lines, the panel may be driven at one or more of these positions with annular masses at the remaining locations to balance the mass of the transducer(s). The balancing action of the masses is related to the relative distance from the drive point and/or centre of the panel. For example, for a single 8 gram transducer mounted at the 0.91 drive point, the value of the masses to a good approximation at the other locations may be derived as follows:

| diameter ratios | relative ratios | relative mass | actual mass (gm) |
|---|---|---|---|
| 0.91 | 1.00 | 1.00 | 8.00 |
| 0.69 | 0.76 | 0.76 | 6.06 |
| 0.44 | 0.48 | 0.48 | 3.86 |
| 0.20 | 0.22 | 0.22 | 1.76 |

Figures 10A, 10B, 10C, 10D:
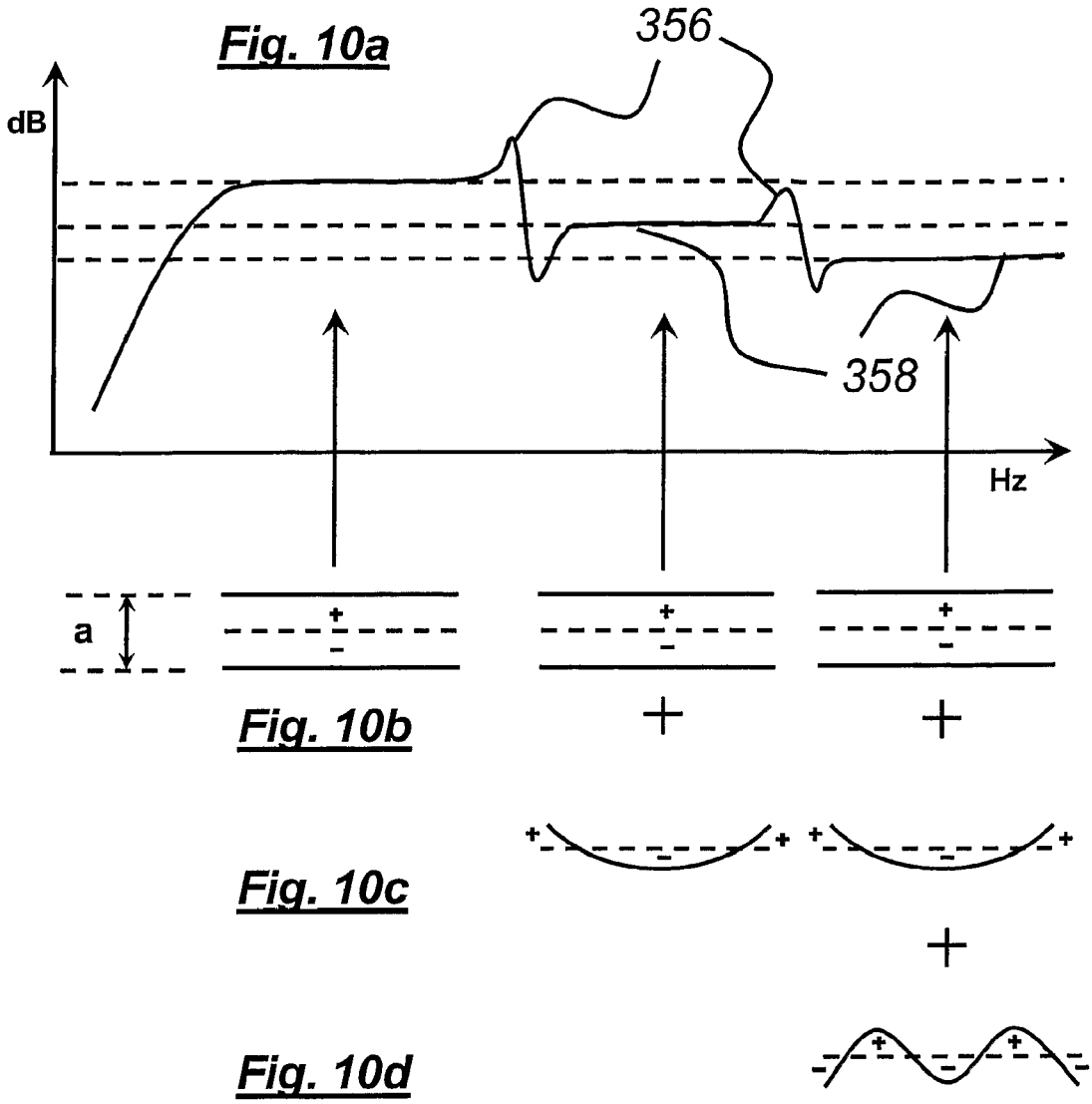
FIG. 10*a* shows the frequency responses below the first mode, for the first mode to the second mode and for the second mode and above respectively, for a loudspeaker comprising a circular diaphragm.
FIG. 10*b* shows the piston displacement for the loudspeaker in the ranges of FIG. 10*a;*
FIGS. 10*c* and 10*d* show the modal displacement for the loudspeaker in the ranges of FIG. 10*a;*

FIG. 10*a* shows the frequency responses for three different ranges for a loudspeaker comprising a circular diaphragm. FIG. 10*a* shows the pistonic range below the first mode, the range from the first mode to the second mode and the range for the second mode and above. The response at any frequency may be considered a linear sum of modal and pistonic contributions. All the modes within the operating frequency contribute to the acoustic response.

FIG. 10*b* shows the piston displacement for the loudspeaker of FIG. 10*a* at each range. The piston displacement is equal and common to each of these ranges. FIG. 10*c* show the modal displacement of the first mode for each range. Below the first mode in the pistonic range, there is no modal displacement. The mode is not balanced and has an excess negative contribution which results in a peak 356 and a drop in the level 358 in the response, both of which are audible. Similarly, FIG. 10*d* shows that the displacement shape for the second mode is not balanced. Once again there is an excess negative contribution which results in a peak 356 and a drop in the level 358 in the response, both of which are audible.

Figures 10E, 10F, 10G, 10H:
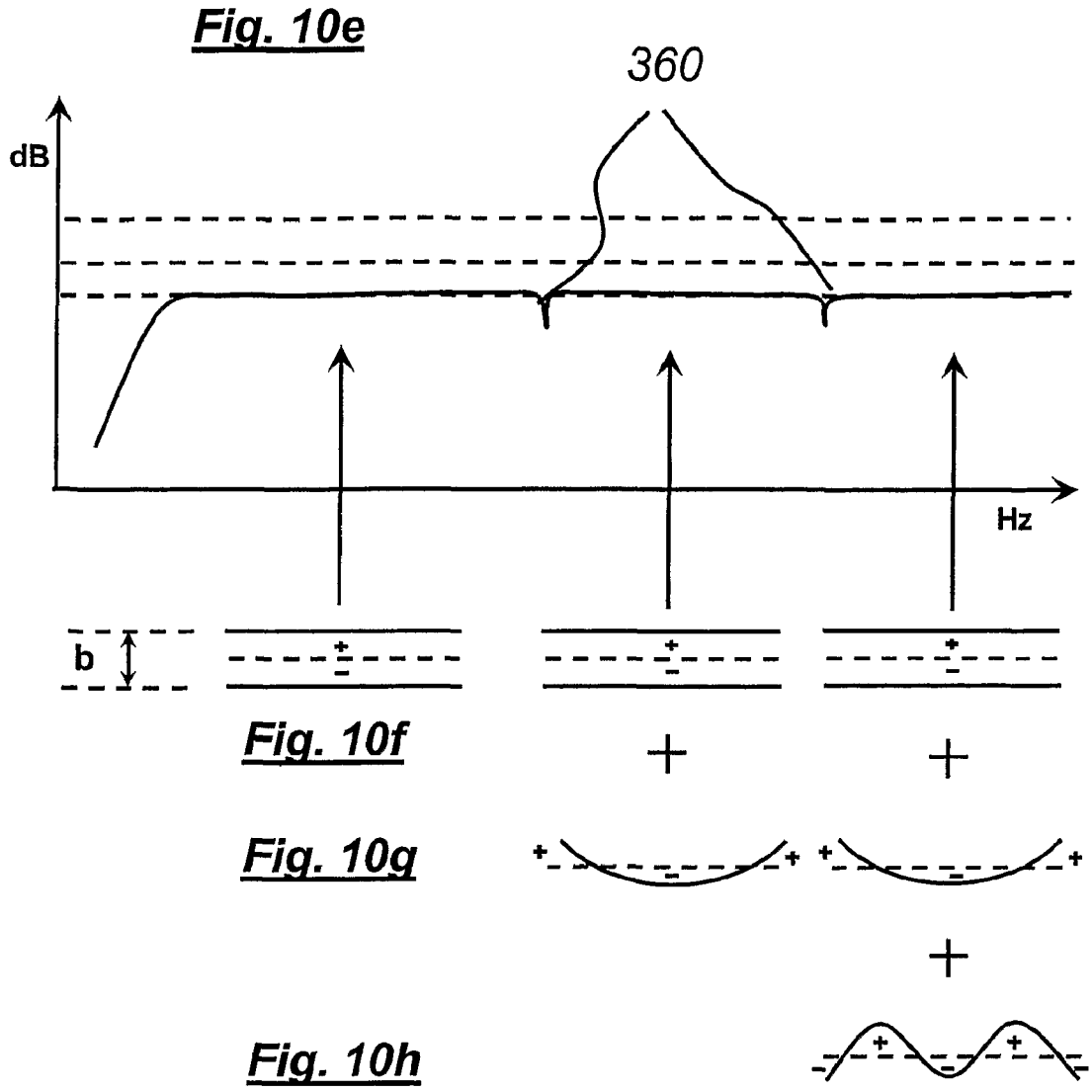
FIG. 10*e* shows the frequency responses below the first mode, for the first mode to the second mode and for the second mode and above respectively, for the loudspeaker of FIG. 10*a* with both modes balanced.
FIG. 10*f* shows the piston displacement for the loudspeaker in the ranges of FIG. 10*e;*
FIGS. 10*g* and 10*h* show the modal displacement for the loudspeaker in the ranges of FIG. 10*e;*

FIG. 10*e* show the frequency responses for the three different ranges for the loudspeaker in which the first and second mode are balanced. FIG. 10*f* shows the piston displacement for the loudspeaker at each range. As with FIG. 10*b*, the piston displacement is equal and common to each of these ranges.

FIGS. 10*f* and 10*g* show the modal displacement for the first and second mode for each range. In the pistonic range, there is no modal displacement. Each mode is balanced, i.e. the sum of the mean transverse displacement for each tends to zero, and thus its net contribution is balanced. Accordingly, there is no level change in the response. A simple, sharp notch 360 remains but this is psychoacoustically benign.

Figure 10I:
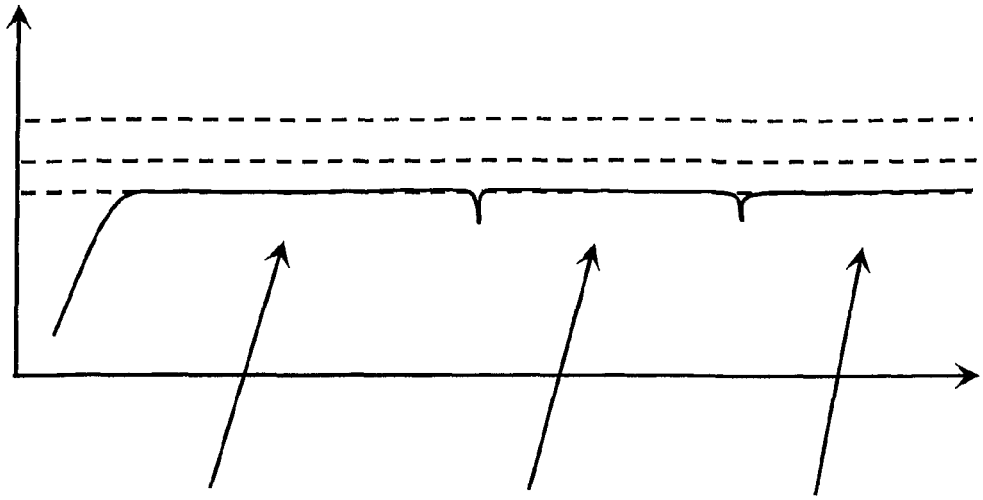
FIG. 10*i* shows the frequency responses below the first mode, for the first mode to the second mode and for the second mode and above respectively, for the loudspeaker of FIG. 10*e;*
Figure 10J:
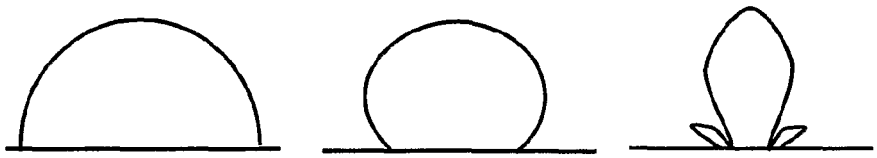
FIG. 10*j* shows the piston directivity for the loudspeaker of FIG. 10*i;*
Figure 10K:
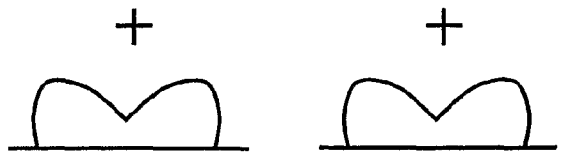
FIG. 10*k* and 10*l* show the modal directivities for the loudspeaker in the ranges of FIG. 10*i;*
Figure 10L:
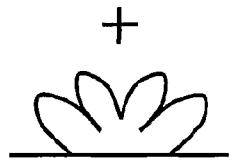

FIG. 10*i* corresponds to FIG. 10*e*. FIGS. 10*j* to 10*l* show the polar responses in the three ranges. As shown in FIG. 10*j*, at low frequencies there is the expected hemispherical output of a simple piston. At mid-range frequencies the directivity of the piston component is beginning to narrow due to source size. As shown in FIG. 10*k*, the first mode radiation also appears, and is added to the output from the piston range, thus usefully widening the directivity. At still higher frequencies, the piston component is a narrow lobe, aided by the component from the first bending mode and now augmented by the additional contribution of the second mode with still wider radiation angle which is shown in FIG. 10*l*. Thus the modal contributions have a beneficial effect on maintaining a wide directivity over the frequency range.

Figure 11A:
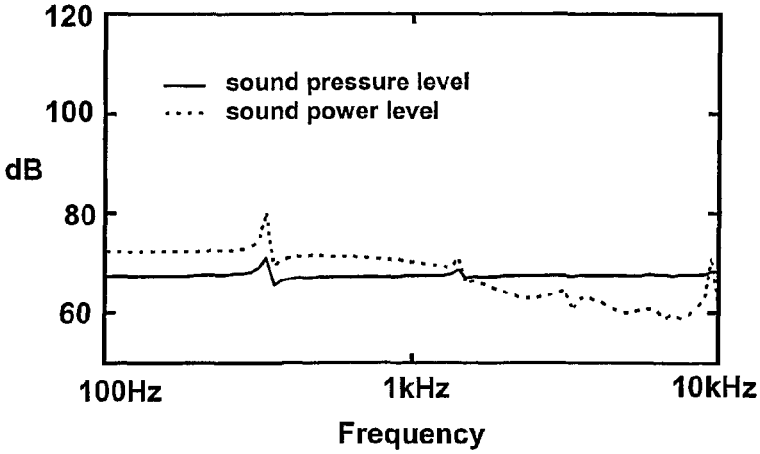
FIGS. 11*a* to 11*d* are simulations of the variations of sound pressure and power with frequency for a loudspeaker having a circular panel driven at four different annular positions.
Figure 11B:
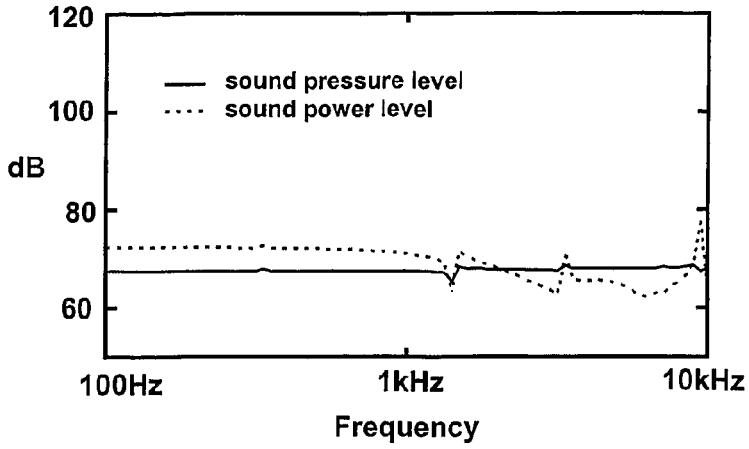
Figure 11C:
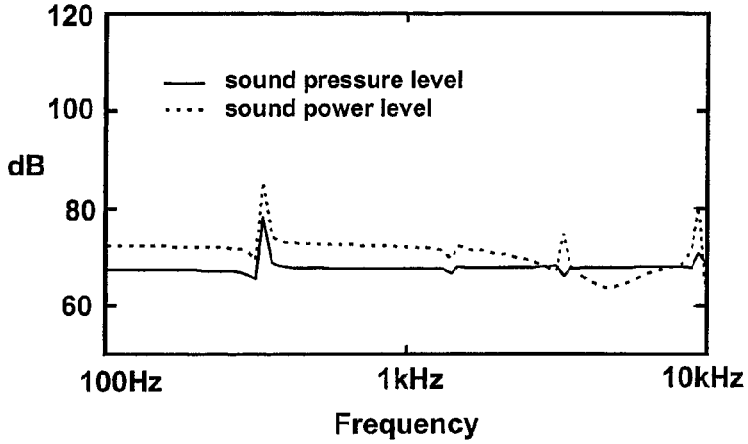
Figure 11D:
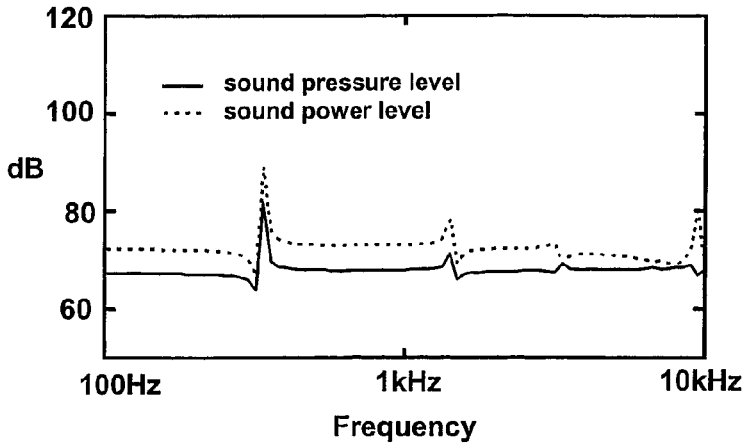
Figure 11E:
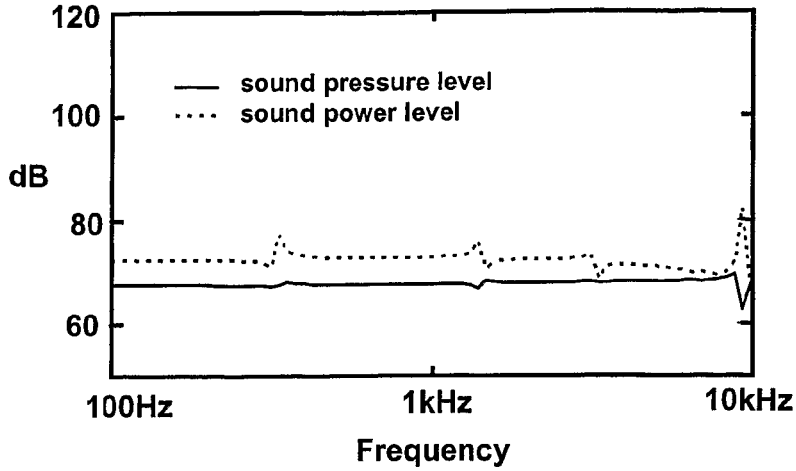
FIG. 11*e* is a simulation of the variations of sound pressure and power with frequency for a loudspeaker having a circular panel driven at the annular position used in FIG. 11*d* with a lighter outer mass.

FIG. 11*a* shows the sound pressure and power variation with frequency for a circular panel driven by a transducer having a mass of 8 g at the 0.91 ratio with the balancing masses set out above. FIGS. 11*b*, 11*c* and 11*d* show the sound pressure and power variation with frequency for the same panel driven at ratio 0.69, 0.44 and 0.2 with transducers of masses 6.06 g, 3.864 g and 1.76 g respectively. Masses of the values set out above are mounted at each annular position which is not driven. Each of the simulations is calculated without any structural damping. The smaller voice coil restores the power to high frequencies but the lower modes are not as well balanced. By dropping the outer mass to 7 g, the performance is improved as shown in FIG. 11*e*.

Figure 12A:
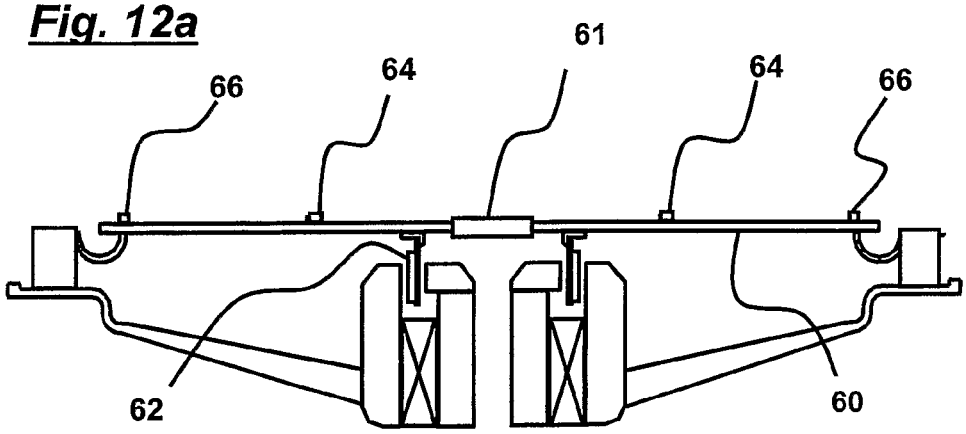
FIGS. 12*a* and 12*b* are cross-sectional views of other embodiments of the present invention.

FIG. 12*a* shows an alternate embodiment of the present invention which is similar to that of FIG. 1*a* except that the circular panel diaphragm has been replaced with an annular panel 60. The annular panel 60 has an inner radius which is 0.2 of the outer radius. A compliant acoustic seal 61 is mounted within the central aperture of the panel. The voice coil 62 of the transducer is mounted at an annular location which is 0.33 of the radius and ring masses 64, 66 are located at annular locations at 0.62 and 0.91 of the radius. The ring mass 64 at the 0.62 location and the voice coil 62 have equal mass and the ring mass 66 at the 0.91 location is ¾ of the mass of the voice coil 62.

Figure 12B:
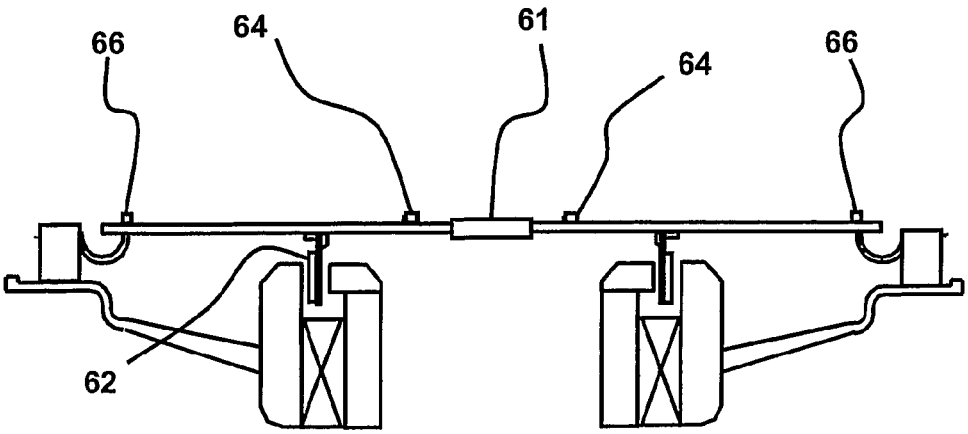

FIG. 12*b* shows a variation on FIG. 12*a* in which the voice coil 62 is mounted at the annular location which is 0.62 of the radius and ring masses 64,66 are mounted at the 0.33 and 0.91 locations. The relative masses of the voice coil and ring masses are unchanged.

Figure 12C:
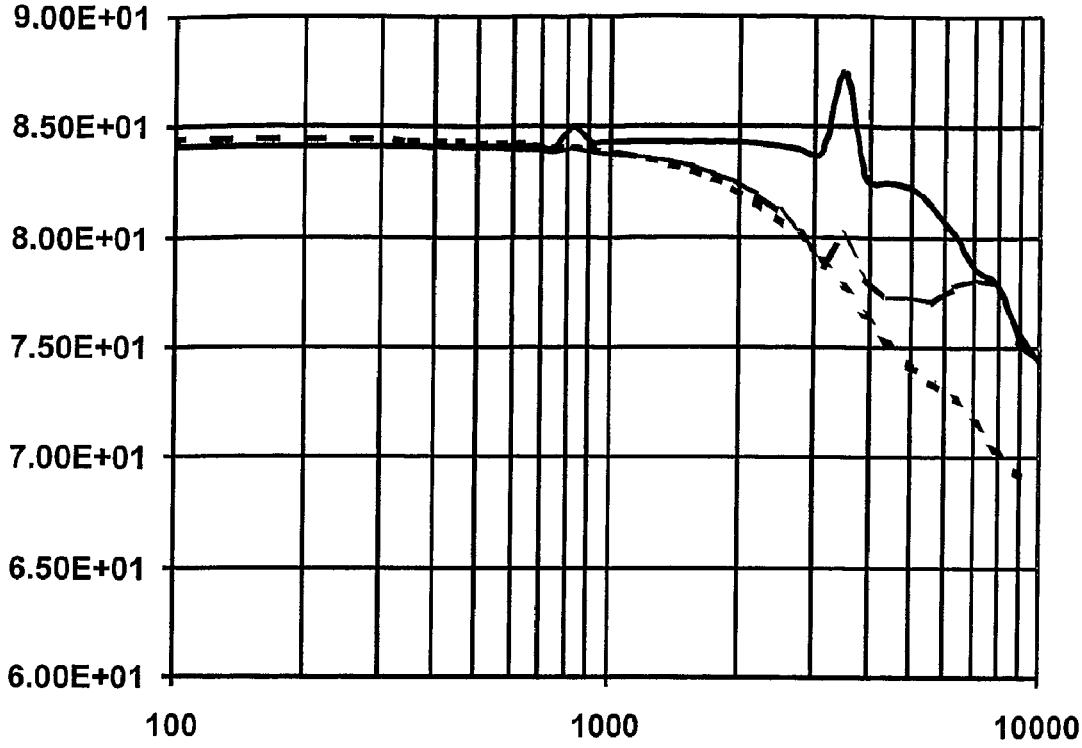
FIG. 12*c* is a graph of power response against frequency for the embodiments of FIGS. 12*a* and 12*b;*

FIG. 12*c* compares the variation in the power response for the devices of FIGS. 12*a* and 12*b* (dashed line and solid line respectively) with that of a pistonic annular radiator of the same size (dotted line). The second case has a partially suppressed first mode so its power response follows the piston under the second mode. Since central drive is not possible, flat power is not achievable. However, above the second mode, both cases radiate more acoustic power than the piston.

The annular locations of the masses and voice coil are calculated in a similar manner to and using the equation for impedance outlined above.

Figure 13:
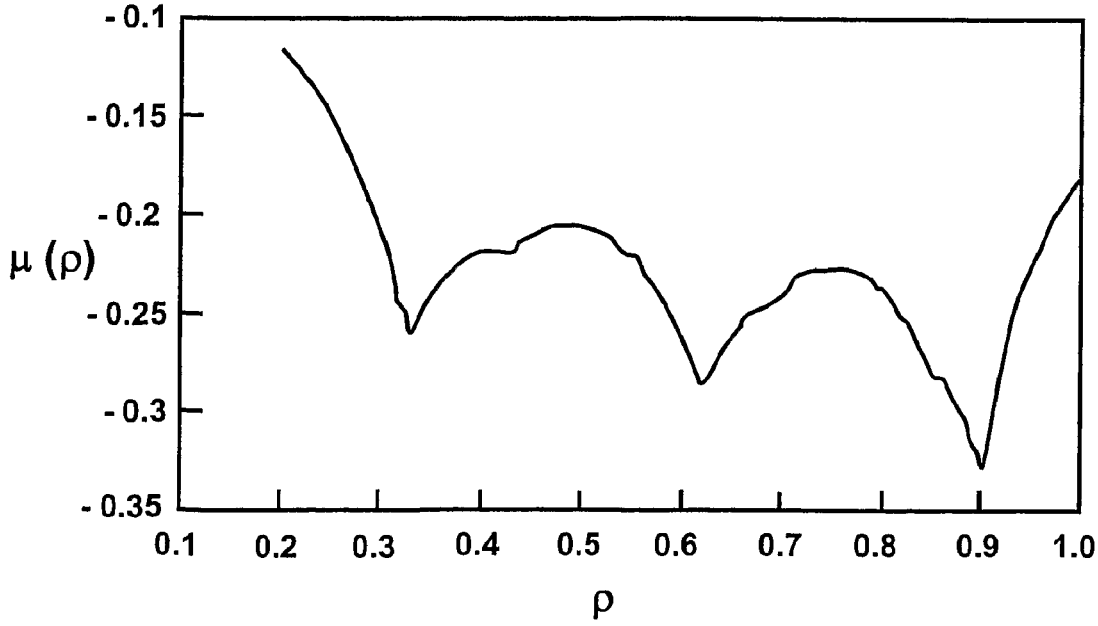
FIG. 13 is a graph of the logarithmic mean of the response of the first three modes of the panels of FIGS. 12*a* and 12*b* against radius.

FIG. 13 shows the logarithmic mean of the response of the first three modes (N=3) of the panels of FIGS. 12*a* and 12*b* as it varies with the radius of the panel. For the calculation, an arbitrary material is chosen for the panel so that the first mode occurs at 400 Hz and the fourth at about 9.6 kHz. Since the first four modes of an annular panel have frequencies in the ratio 1:5:12:23, addressing the first three modes means that the devices can cover quite a wide bandwidth. The mimina occur at 0.33, 0.62 and 0.91 of the radius and thus the voice coil and/or masses are placed at these locations. The outermost annular location corresponds to that for the circular panel of FIG. 1*a*.

Figure 14:
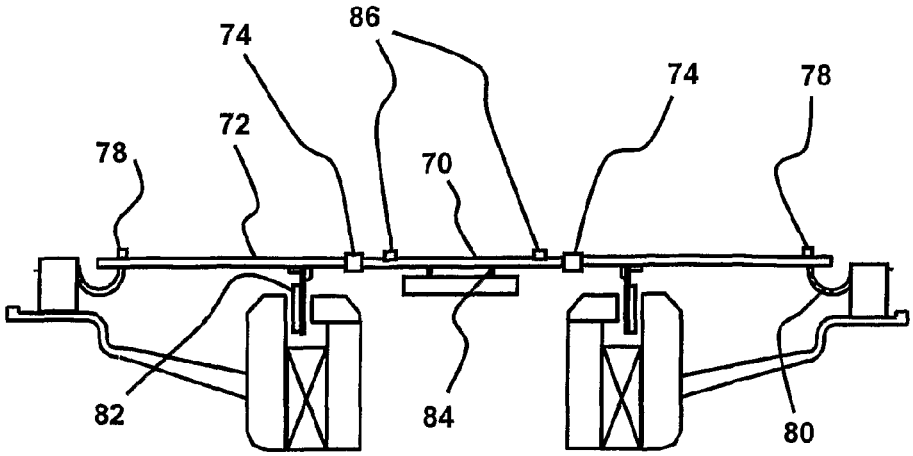
FIG. 14 is a view of another embodiment of the invention.

FIG. 14 shows a device which comprises an annular panel 72 having an inner radius which is 0.20 of the outer radius and a circular panel 70 mounted concentrically within the aperture of the annular panel 72. The circular panel 70 is mounted to the annular panel 72 by a compliant suspension 74 which acts as an acoustic seal.

The annular panel 72 is driven by a concentrically mounted transducer which has a voice coil 82 mounted at 0.62 of the radius of the panel. A ring mass 78 is mounted to the annular panel at an annular location of 0.91 of the radius. The annular panel 72 is mounted to a chassis as in FIG. 1*a* by an annular suspension 80 mounted at the 0.91 annular location.

The circular panel 70 is driven by a concentrically mounted transducer which has a voice coil 84 mounted at 0.62 of the radius of the panel. A ring mass 86 is concentrically mounted to the circular panel at an annular location of 0.91 of the radius.

Figure 15:
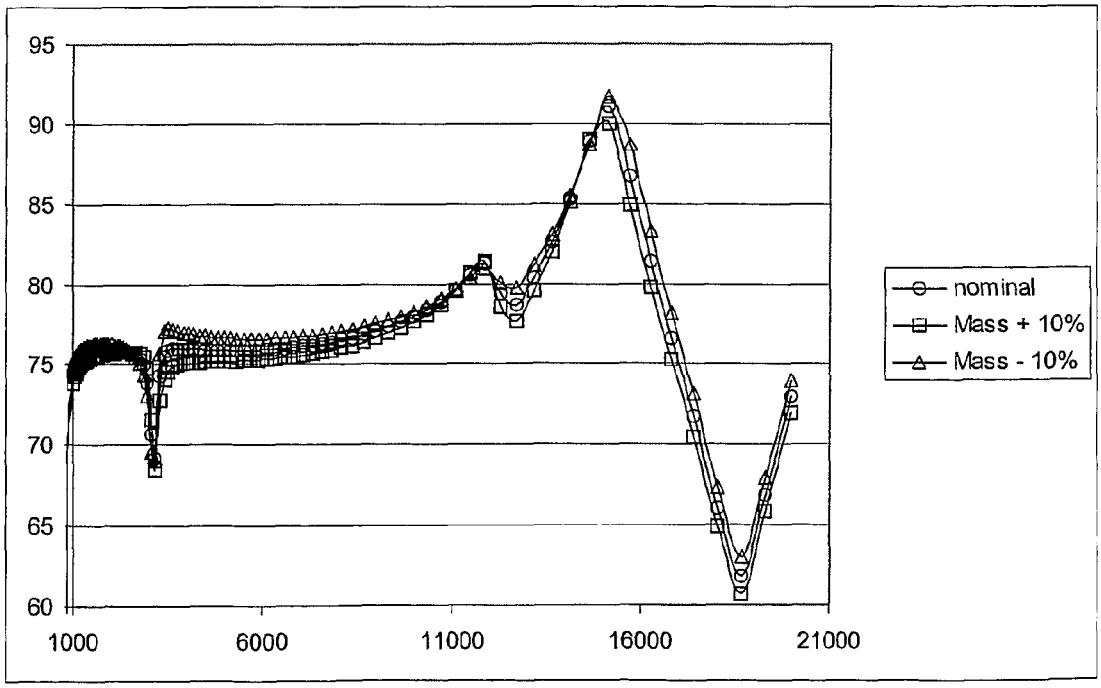
FIGS. 15 and 16 are graphs of the sound pressure against frequency showing the effect of 10% variations in mass and annular location, respectively for the innermost annular location.
Figure 16:
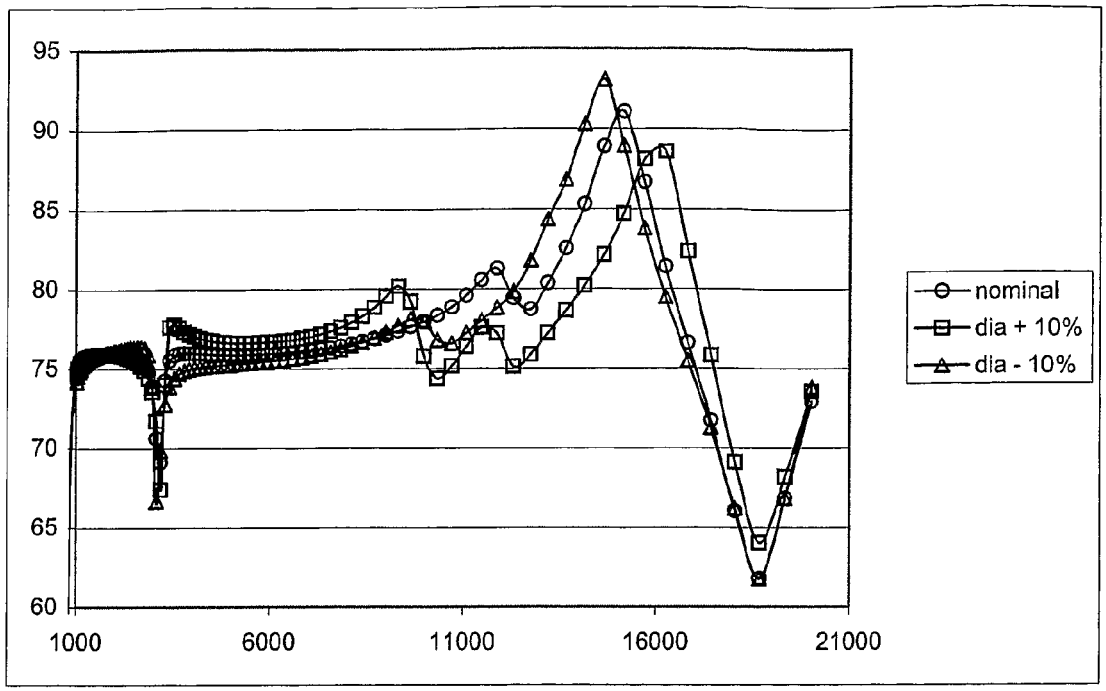
Figure 17A:
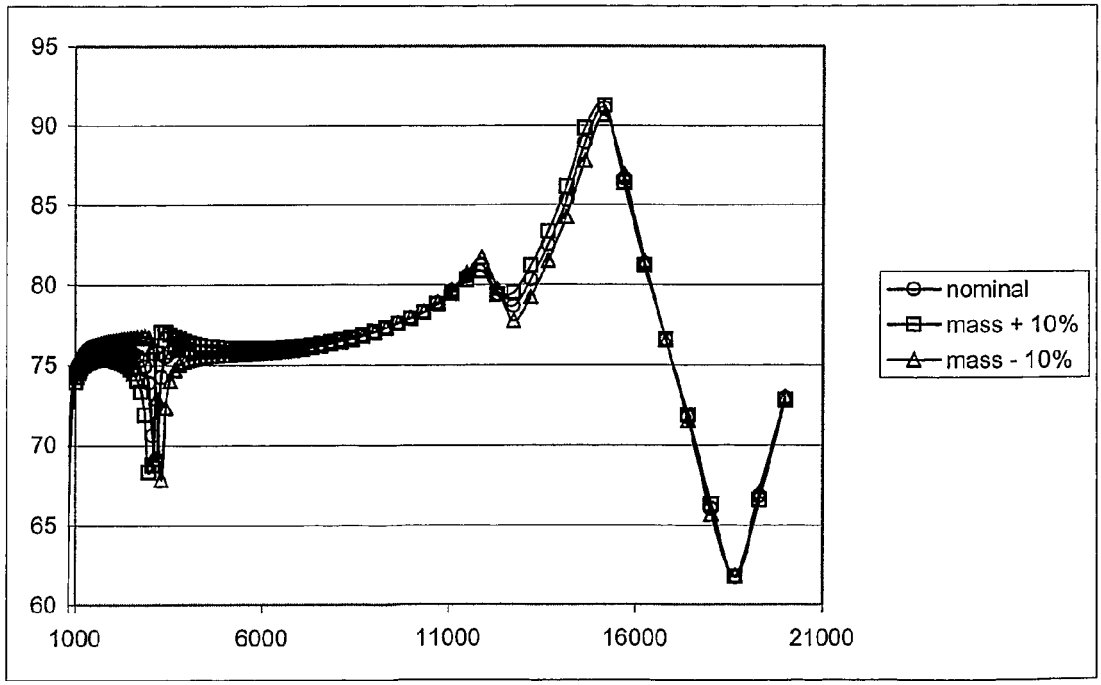
FIGS. 17*a* and 17*b* are graphs of the sound pressure against frequency showing the effect of 10% variations in mass and annular location, respectively for the middle annular location.
Figure 17B:
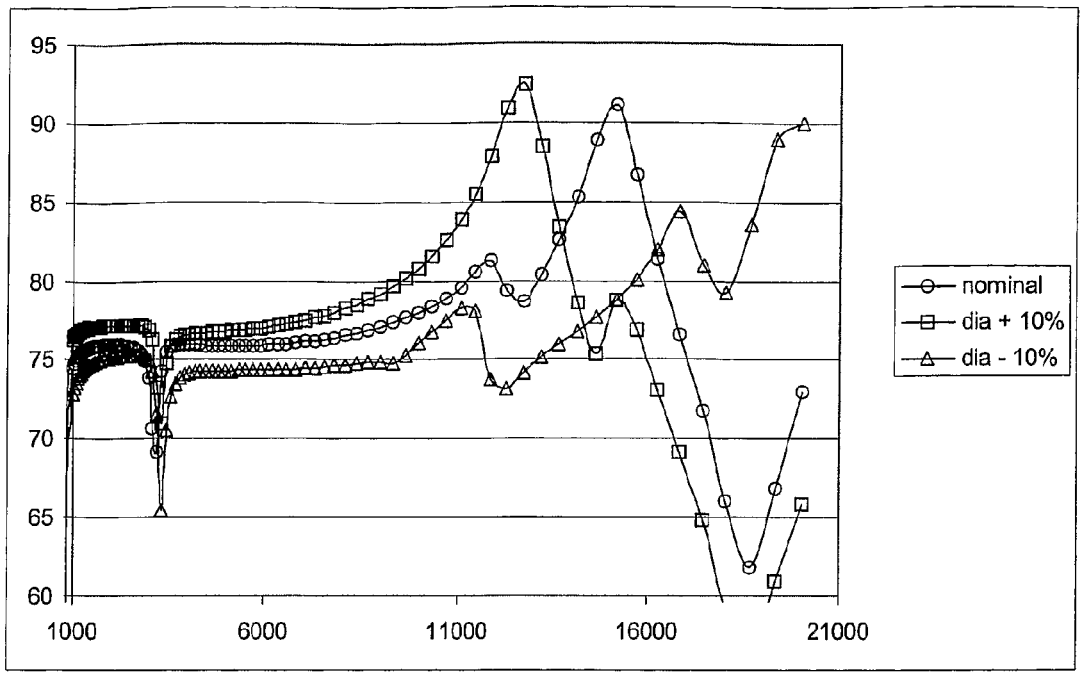
Figure 18A:
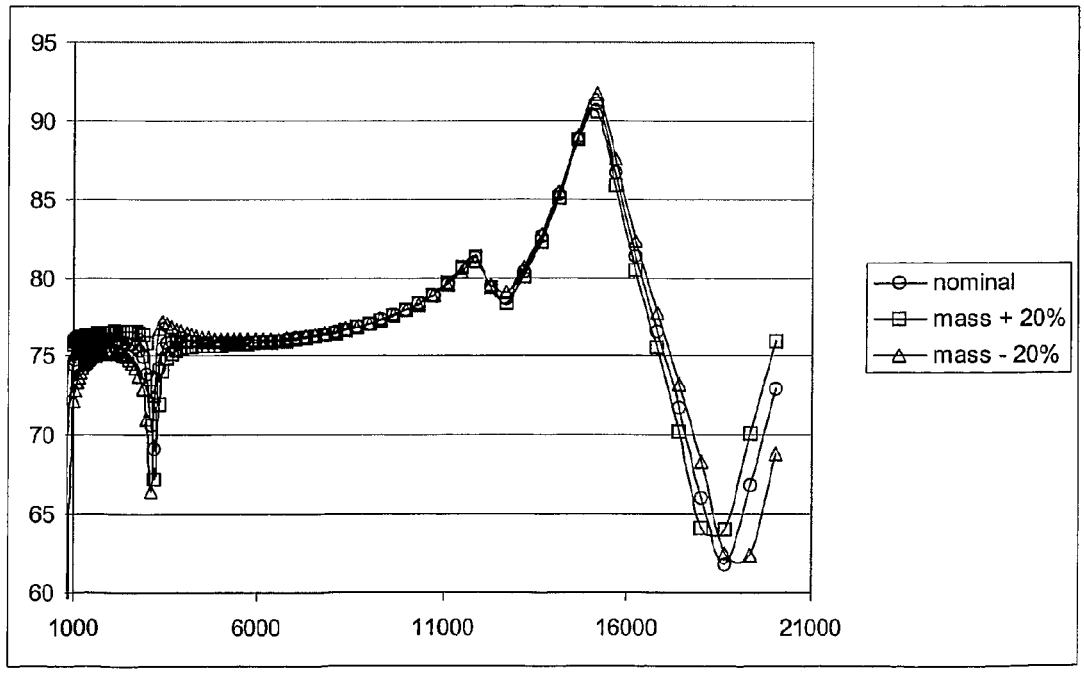
FIGS. 18*a* and 18*b* are graphs of the sound pressure against frequency showing the effect of 10% variations in mass and annular location, respectively for the innermost annular location.
Figure 18B:
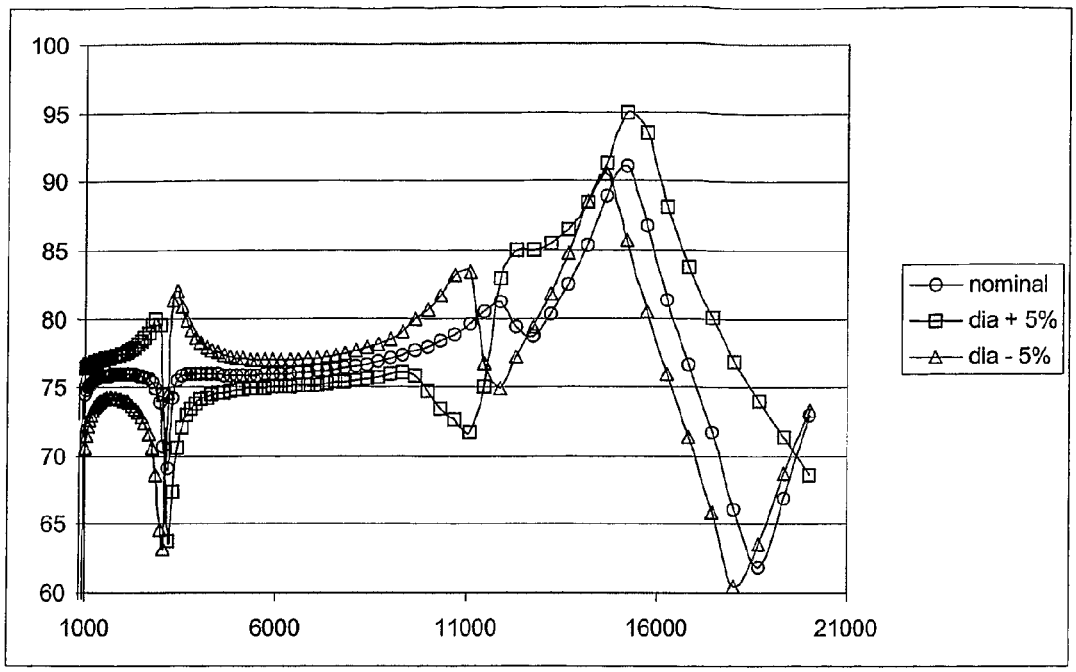
Figure 19:
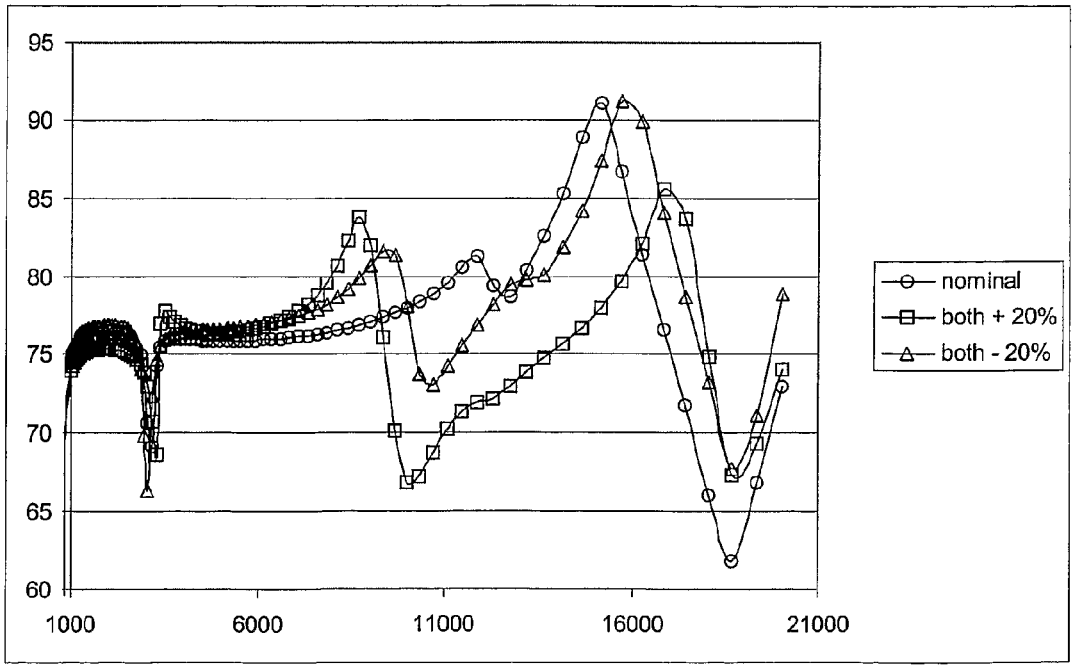
FIG. 19 is a graph of the sound pressure (db) against frequency (Hz) showing the effect of simultaneously changing the annular location and mass by 20%.

FIGS. 15 to 19 illustrate the effect of tolerances in the annular location and the masses. FIG. 15 shows the frequency response for a circular panel of diameter 121 mm with a 32 mm voice coil transducer mounted at the annular location 0.26 and masses mounted at the 0.59 and 0.89 diameter ratio. This frequency response is labelled "nominal" and the expected bandwidth is about 11-12 kHz, due to shear effects in the material. FIG. 15 also shows the frequency response for the same device with 10% increases and decreases respectively in mass at the innermost annular location. FIG. 16 shows the nominal frequency response of FIG. 15 together with the frequency responses for a device in which the annular location is increased or decreased by 10%. FIGS. 17*a* and 18*a* shows the effects of 10% and 20% variations in the mass at the 0.59 and 0.89 diameter ratios and FIGS. 17*b* and 18*b*, the effect of a 10% and a 5% variation in the locations themselves. FIG. 19 shows the effect of simultaneously changing the mass and annular location by 20% at the innermost annular location.

In general, the tolerance for changing mass is greater than that for changes in location. Furthermore, the effect on the frequency response of the location changes are most severe at frequencies above the last balanced mode. Overall, the greatest tolerance to change of is for locations closest to the centre of mass. Not only is this location tolerant to quite wide changes in either the diameter ratio or mass, but also it is observed that in the pass-band the changes are complementary. It may be possible to cope with a change of up to +/−30% on either mass or diameter ratio, providing the mass per unit length is unchanged. The outer locations are more sensitive to changes in ratio, but possibly less sensitive to changes in mass.

For an optimal solution, relative mean displacement $\Psi_{rel}=0$. For a two-mode optimum fix, varying the radius of the outer mass moves from optimal according to $$\frac{d\Psi_{rel}}{dr_2} \approx 1.75,$$

where $r_2$ is the radius of the mass divided by the plate radius

In other words, a 1% change in $r_2$ results in a 1.75% change in $\Psi_{rel}$. The above work shows that tolerances of +/−5% to +/−10% on r2 are acceptable. This corresponds to a tolerance on $\Psi_{rel}$ between 8% and 18%, respectively.

In FIGS. 9*a* to 9*e*, and later similar Figures, the minima in the graphs of average impedance are wide and thus we should expect some tolerance in the positioning of the masses. This is supported by FIGS. 15 to 19.

When shear flexibility is taken into account, the frequency of a mode may change substantially from what would be predicted by thin-plate theory. The shape of the mode, however, is largely unchanged. For example, with materials typically used, a reduction in the diameter ratios by about 0.01 to 0.02 results in a slightly better balancing of the modes. This improvement is largely academic, given the tolerances described in the previous paragraph. A simple equivalent compensation is to make the panel slightly larger—typically by 1 or 2 mm.

The size of the panel is limited by the size of the transducer voice coil. Given industry-standard coil sizes, the size of the panel is restricted. However, as described above, the frequency response of the device is quite tolerant to changes at the innermost ratio and this observation may be used to advantage, allowing changes in panel diameter of probably at least +/−10% from the tabulated values. For example, the method may be adapted by first finding the closest panel/transducer combination to that required (the voice coil of the transducer would be set to the inner-most diameter ratio) and then scaling all the diameter ratios and masses, except for that of the voice coil, to get the correct panel size.

Figure 20:
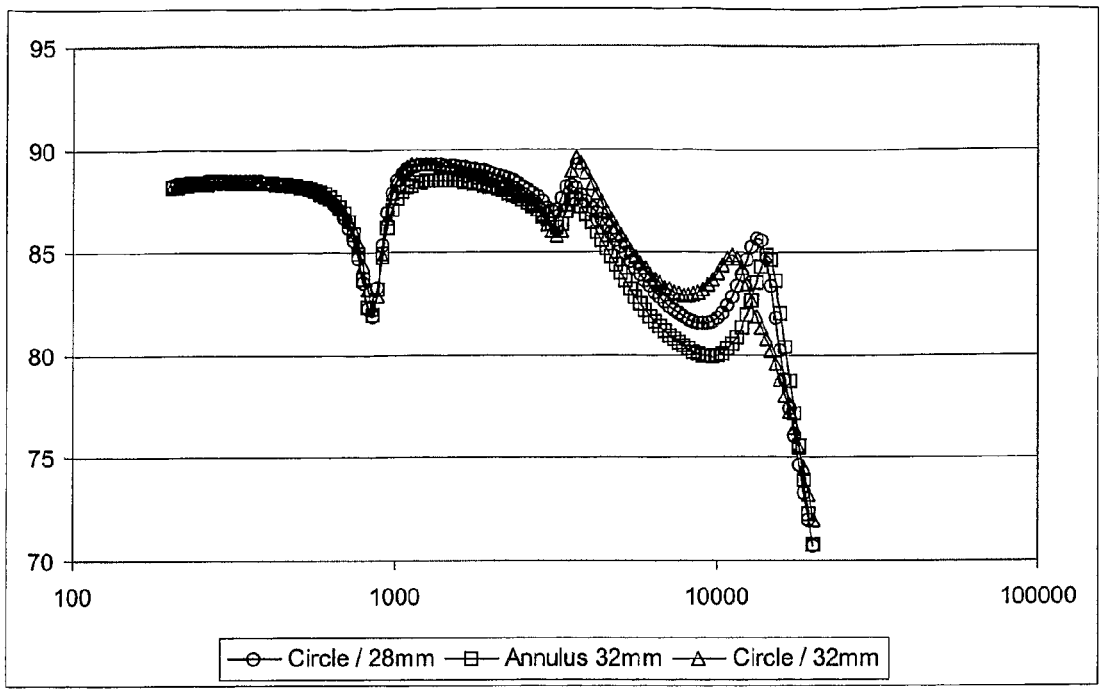
FIG. 20 is a graph of the sound pressure (db) against frequency (Hz) showing the effect of approximating using an annular diaphragm to achieve a desired circular panel.

Alternatively, work on annular shaped panels may be used to release a designer from constraints on the panel size. The argument is that if the hole is small, then its effect will also be small, so maybe it is not needed. The tables set out in relation to annular panels suggest that hole sizes having a diameter ratio of less than 0.1 have minimal effect on the annular locations. Thus the method may be adapted by designing an annular panel, but building a circular panel. For example, a panel diameter of 108 mm with a coil of 32 mm may be achieved by designing an annular panel with a hole ratio of 0.14. The nearest circular design would require a coil of 28 mm. FIG. 20 shows the frequency response for a circular panel driven by a 28 mm or a 32 mm voice coil transducer and an annular panel driven by a 32 mm voice coil transducer. The pass-band response for the annular panel is a little bumpier, but the out-of band response is arguably better.

Either of the methods discussed above, namely using the tolerances or annular shape to relax the restrictions on panel size may also be used to "detune" the pass-band modal balance in favour of a more graceful departure from a flat response at higher frequencies. This is important where the number of modes addressed does not fully cover the intended bandwidth or shear in the panel material results in higher-order modes reducing in frequency to the point where they appear in-band. The frequency response often becomes irregular near these higher modes, especially when the voice-coil falls on or near an anti-node of one of these modes. Improvement for these higher order modes may be addressed by using the tolerances or by choosing an annular form.

Figure 21:
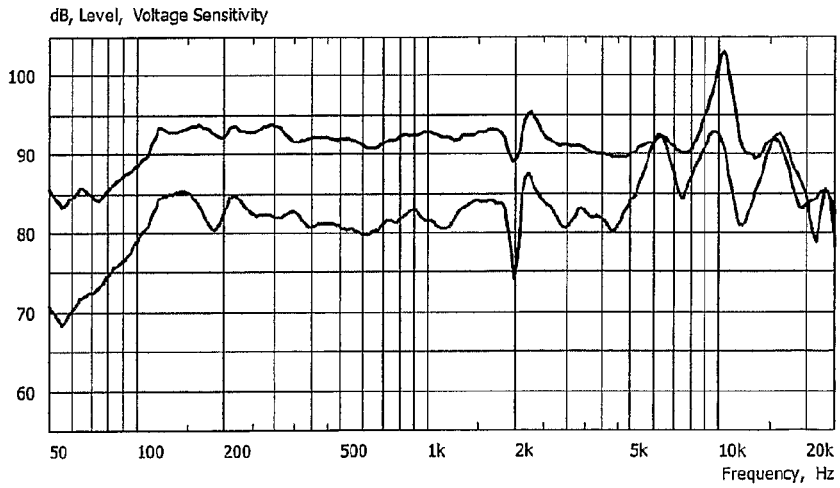
FIG. 21 shows the on-axis sound pressure level (SPL) and sound power level (SWL) curves (lower and upper curves respectively) for a loudspeaker in which the first two modes have been balanced and to which a single damping pad has been mounted.

FIG. 21 shows the on-axis sound pressure level (SPL) and sound power level (SWL) curves (lower and upper curves respectively) for a loudspeaker in which the first two modes have been balanced and to which a single damping pad has been mounted. The loudspeaker comprises a circular panel having a diameter of 85 mm which is driven by a 32 mm voice coil transducer. An annular ring of diameter 71 mm is mounted to the panel and the damping pad is mounted centrally on the panel. The damping pad is 9 mm by 9 mm and is made from ethylene propylene diene rubber (EPDR).

The use of a central damping disc follows traditional teaching, since for a circular panel, this is always an antinode (likewise at the panel edge). However, this will mean that all the modes will have some damping applied, but unfortunately, not all of the velocity profile will be equally damped. Thus as shown in FIG. 21, the effect of the damping pad is to damp the third mode in the SPL curve. However, the third mode is still clearly visible, at 11 Hz, in the sound power response, SWL curve. Accordingly, the on-axis response looks improved, but the power response is not.

In order to understand how this peak from the third mode can be effectively damped, we need to re-visit FIG. 9*c*, the panel admittance curve for a panel with three modes. As explained previously, balancing masses are added in the low velocity regions which are the narrow troughs on the graph. For damping, it is the high velocity regions which are of interest, since these represent maximum panel bending. As shown in FIG. 9*c*, the classic locations of maximum velocity are the centre and edge of the panel since these are maxima for all the modes.

There are also two other broad regions of high velocity which peak at panel diameters of 0.42 and 0.74. Selective damping may usefully be applied in these regions. Since the regions are broad admittance, the damping locations are not as critical as the balancing mass locations. For the loudspeaker shown in FIG. 21*a*, these ratios are at 35.7 mm and 63 mm. However, the transducer voice coil is at 32 mm (hence the large peak in output), so adding damping at 35.7 mm is not ideal. The 63 mm diameter is suitable but in order to affect sufficient selective damping of the whole mode-shape, at least a second region is needed. The region between ratios 0.2 and 0.27 also has high velocity. Although this region starts to encroach into the central region, it is one where the velocity is rising quite rapidly, so the surface damping material will be in tension.

Figure 22A:
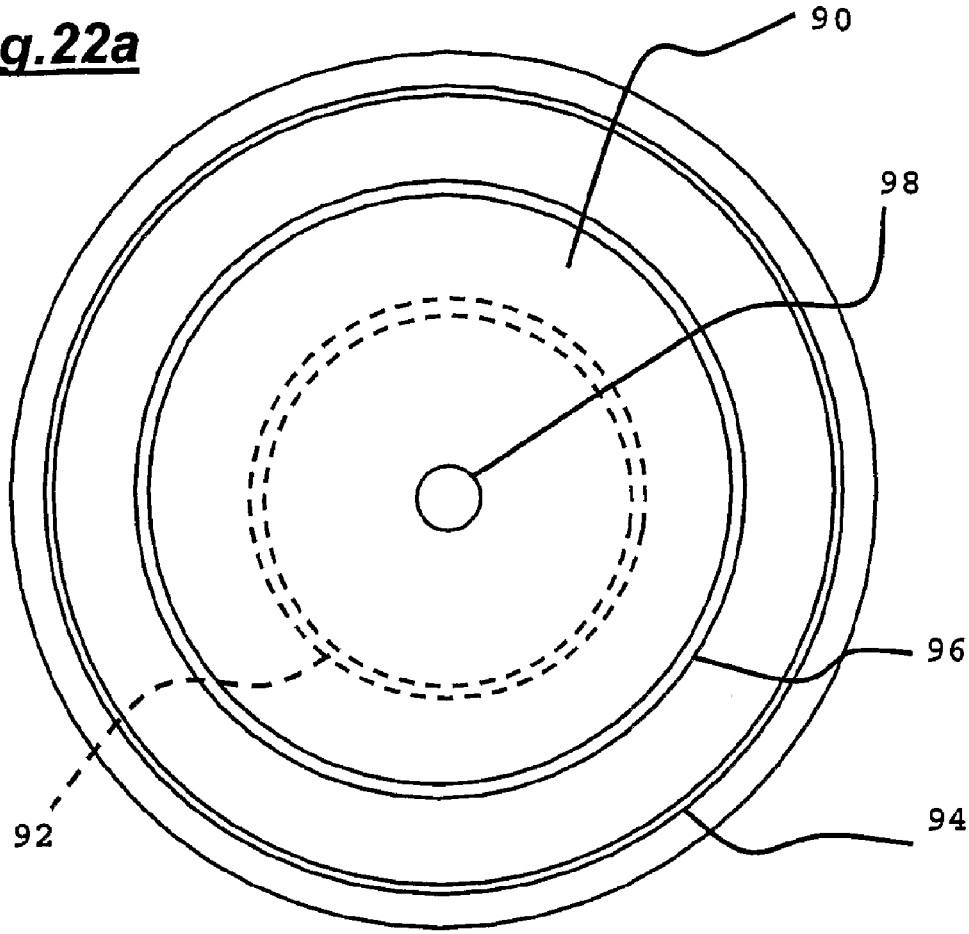
FIG. 22*a* is a plan view of a loudspeaker according to another aspect of the invention.

FIG. 22*a* shows a loudspeaker comprising a circular panel 90 having a diameter of 85 mm which is driven by a 32 mm voice coil transducer 92. An annular balancing ring 94 of diameter 71 mm is mounted to the panel together with a damping ring 96 of diameter 63 mm and a central damping pad of diameter 9 mm. The damping rings 96, 98 are made from ethylene propylene diene rubber.

Figure 22B:
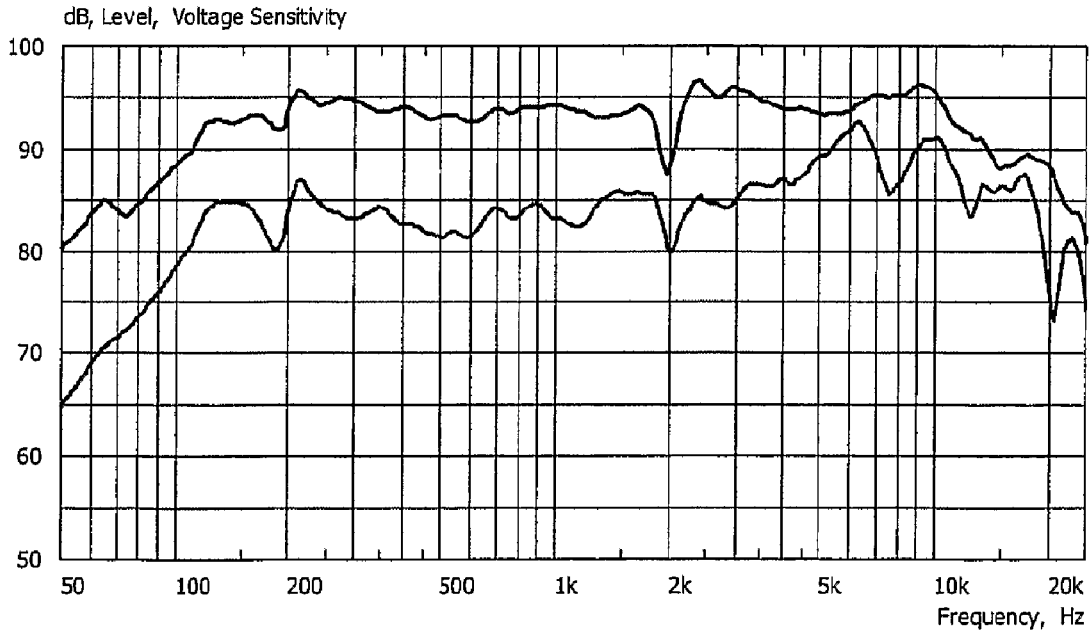
FIG. 22*b* shows the on-axis sound pressure level (SPL) and sound power level (SWL) curves (lower and upper curves respectively) for the loudspeaker of FIG. 22*a;*

FIG. 22*b* shows the on-axis sound pressure level (SPL) and sound power level (SWL) curves (lower and upper curves respectively) for the loudspeaker of FIG. 22*a*. There is no peak in either curve at 11 khz so the third mode has been effectively damped by the use of the annular ring.

The location of the damping rings is determined by the number of modes which are balanced. Using FIGS. 9*a* to 9*e*, the annular locations of the damping rings for damping the second to the fifth mode are set out below:

| | Position (ratio) | | | |
|---|---|---|---|---|
| Mode # | 1 | 2 | 3 | 4 |
| 2 | 0.58 | | | |
| 3 | 0.43 | 0.74 | | |
| 4 | 0.32 | 0.52 | 0.77 | |
| 5 | 0.27 | 0.48 | 0.63 | 0.81 |

For example, if the fourth mode is to be damped, damping pads should be mounted at diameter ratios 0.32, 0.52 and 0.77.

Figure 23:
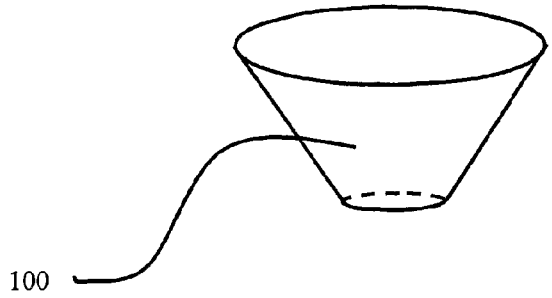
FIG. 23 is a perspective view of a frusto-conical coupler.
Figure 24:
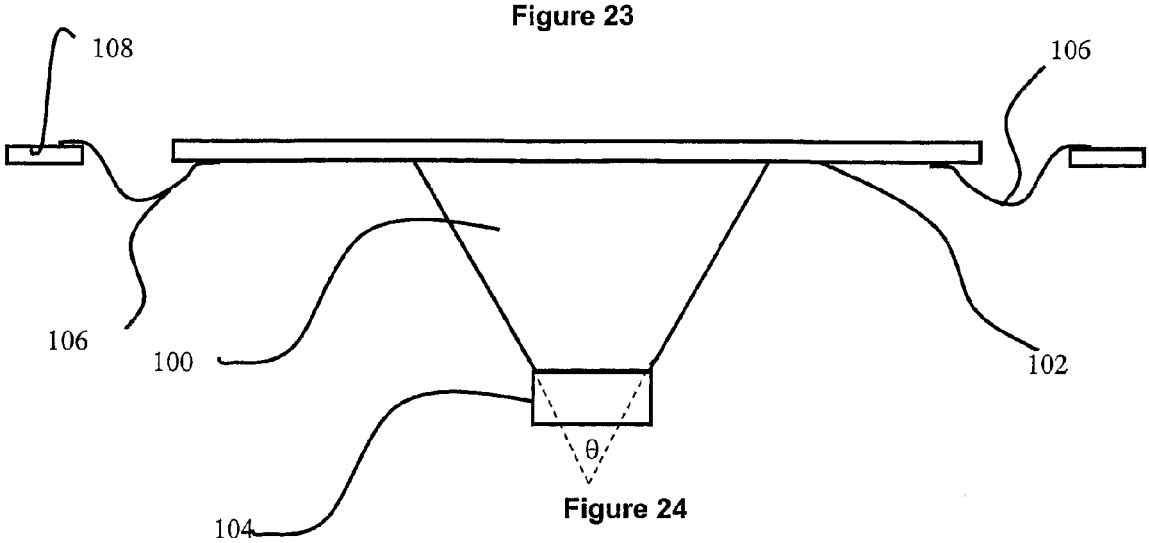
FIG. 24 is a side view of a loudspeaker drive unit incorporating the coupler of FIG. 23.

FIG. 23 shows a frusto-conical coupler 100. As shown in FIG. 24, the coupler 100 is disposed between a circular panel diaphragm 102 and a transducer voice coil 104. The magnet assembly of the transducer has been omitted for clarity. The diaphragm 102 is supported on a chassis 108 by an annular suspension 106. The dotted lines indicate the included angle θ of the coupler.

Figure 25:
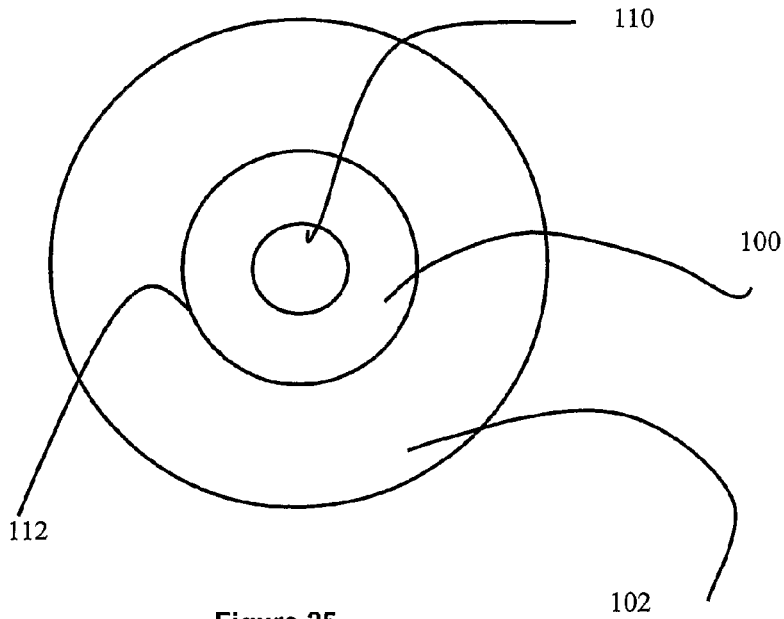
FIG. 25 is a rear view of the drive unit of FIG. 24.

As shown in FIG. 25, the coupler is coupled to the transducer voice coil at a first diameter 110 which is the diameter of the voice coil. The coupler is coupled to the diaphragm at a second diameter 112 which is larger than the first diameter. In this way, a small voice coil assembly which may be of moderate cost, is adapted to a larger driving circle. Furthermore, the coupler is matching an inappropriate voice coil diameter to a correct drive diameter at relatively low cost.

Figure 26A:
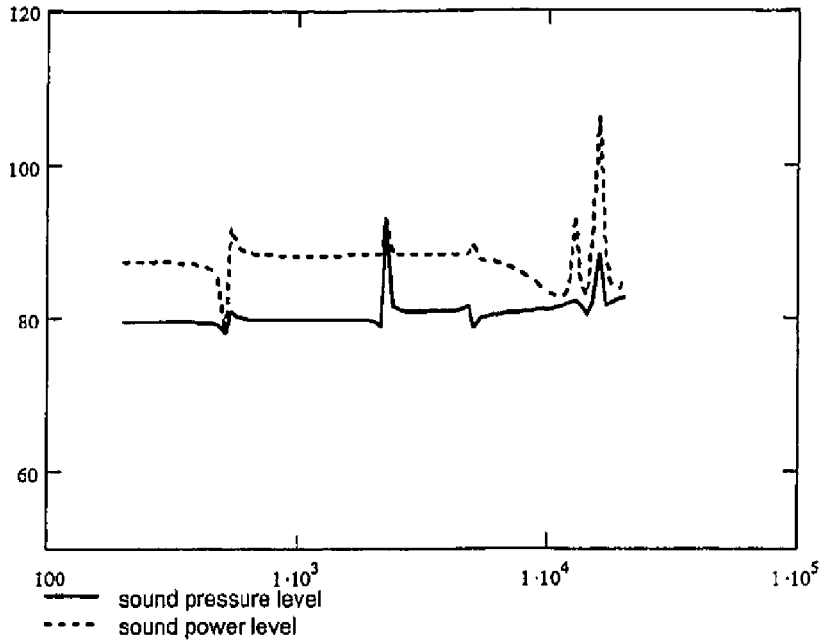
FIGS. 26*a* to 26*d* show sound pressure (db) against frequency (Hz) for variations of the drive unit of FIG. 23.

FIGS. 26*a* to 26*d* show sound pressure and sound power levels obtained by finite element analysis. FIG. 26*a* shows the output of a model of a loudspeaker according to the invention, i.e. with a panel diaphragm having annular masses mounted thereon. A tubular coupler is mounted between the diaphragm and the transducer voice coil. The coupler is of 0.5 mm thick cone paper, has a diameter of 25.8 mm, and the distance from the diaphragm to the voice coil was set at 5 mm—having, therefore, an included angle of zero degrees.

Figure 26B:
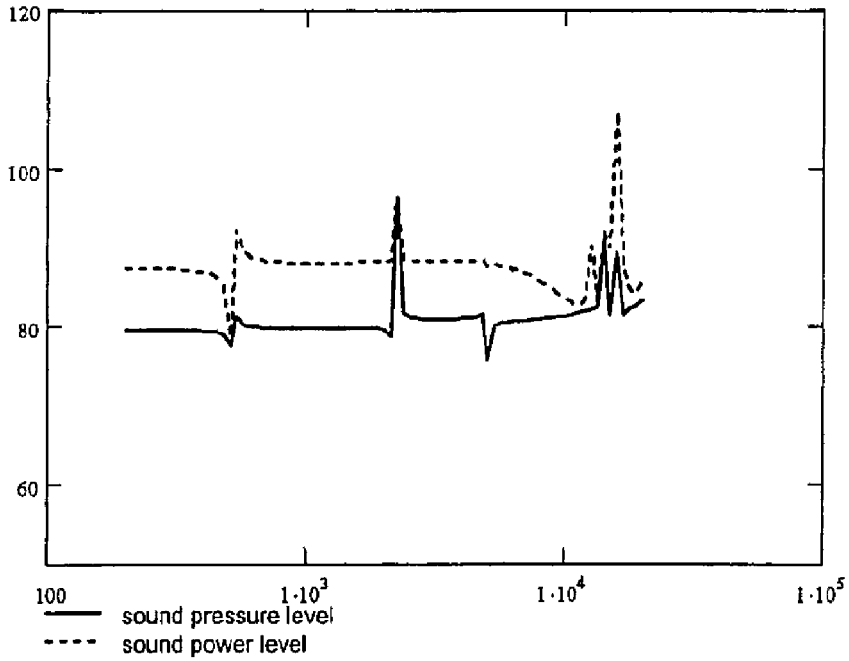
Figure 26C:
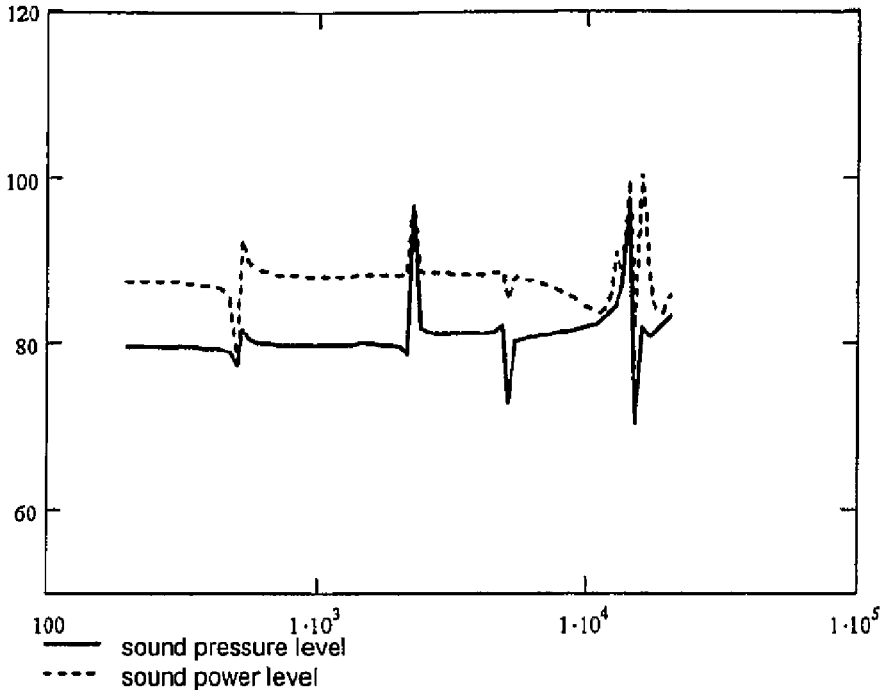
Figure 26D:
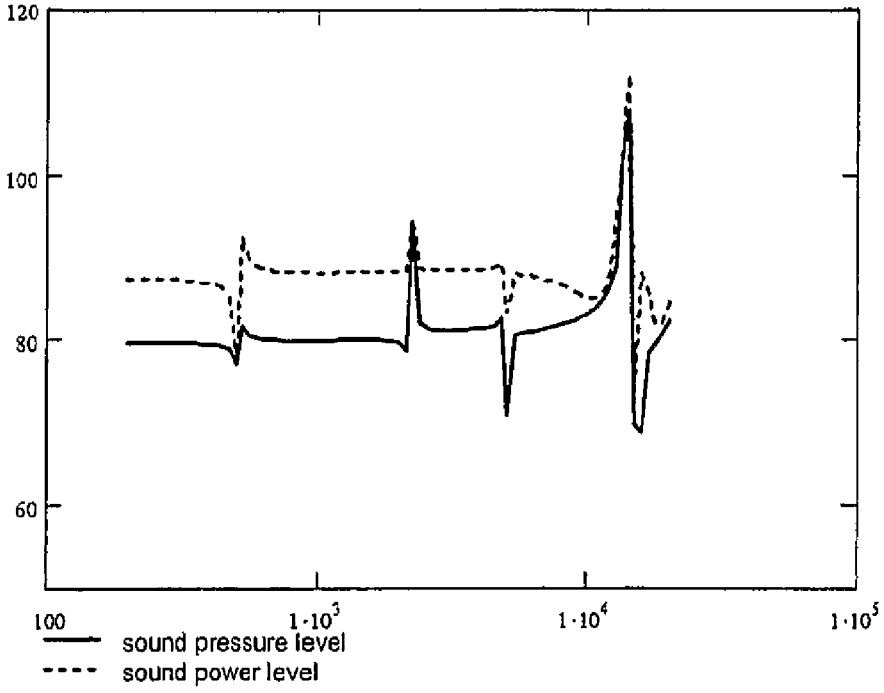

In FIGS. 26*b* to 26*d*, the diameter of the voice coil is reduced in 2 mm steps with the diameter of the coupler at the diaphragm remaining unchanged and thus the coupler changes from tubular to frusto-conical with increasingly steep sides. The voice coil diameter was reduced in steps starting with zero included angle, such that FIG. 26*b* corresponds to an included angle θ of 23 degrees, FIG. 26*c* to an included angle θ of 44 degrees and FIG. 26*d* to θ=62 degrees.

In FIG. 26*a*, there is little or no damping in the model and in practice a reasonably smooth axial frequency response results. It will be noted from FIGS. 26*b* to 26*d* that coupler resonance is clearly visible at the high frequency limit and this coupler resonance drops in frequency as the coil diameter is reduced, i.e. coupler angle is increased. If the coupler resonance is out of the operative range of the speaker, there is no adverse effect on performance. Accordingly, small changes in diameter may be accommodated, since the resonance is at the limit of the bandwidth.

The coupler in the models was of thin paper but depending on the ratio of diameter matching, allowable coupler mass, and cost, stronger shell constructions for the coupler are possible such as carbon fibre reinforced resin, and crystal orientated moulded thermoplastic such as Vectra. While the coupler in the models was a single frusto-conical section, it would also be possible to arrange the coupler to be a flared device, resembling a typical curved loudspeaker cone.

Figure 27A:
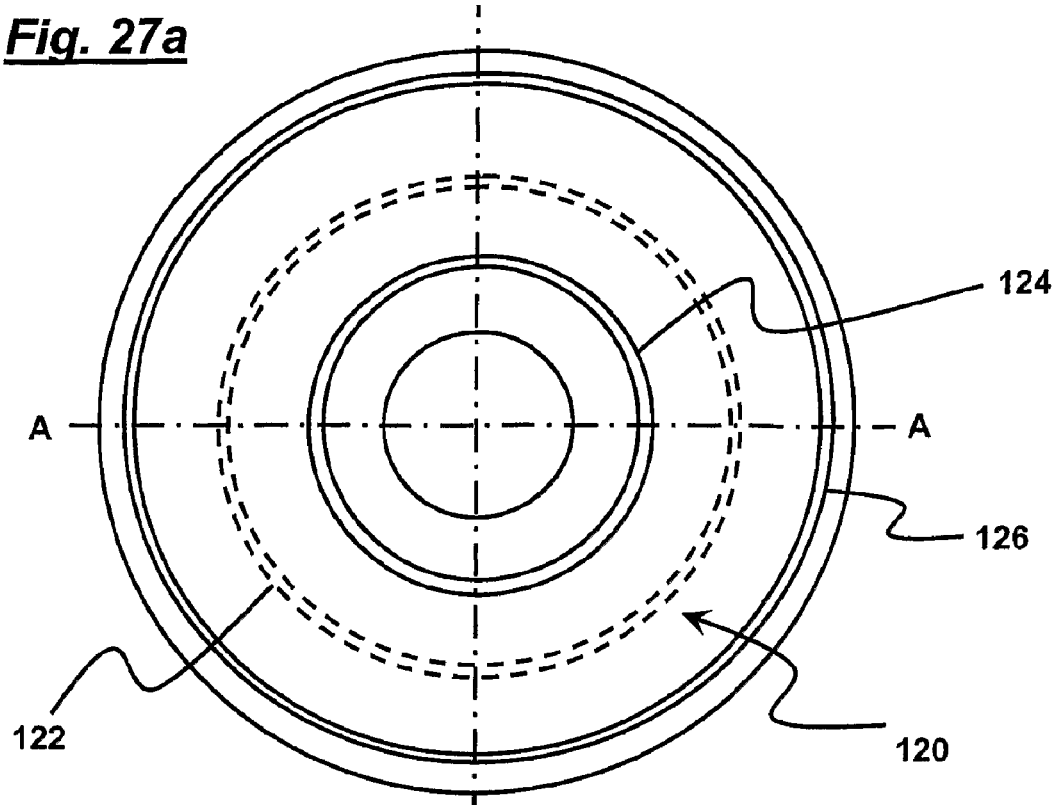
FIG. 27*a* is a plan view of a second embodiment of the present invention.
Figure 27B:
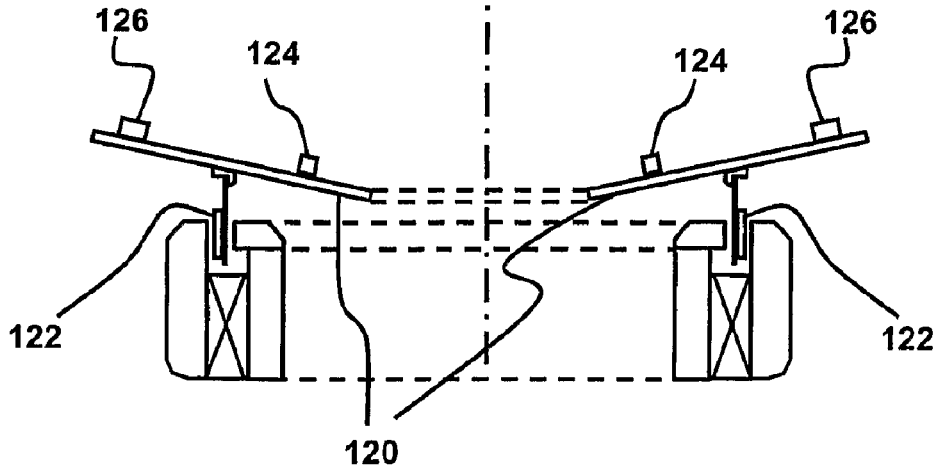
FIG. 27*b* is a cross-sectional view along line AA of FIG. 27*a;*

FIGS. 27*a* and 27*b* show a variation on the embodiment of FIG. 12*b* in which the diaphragm 120 is now cone-like having a cone angle of 158°. As in the previous embodiment, the voice coil 122 is mounted at the annular location which is 0.62 of the radius and ring masses 124, 126 are mounted at the 0.33 and 0.91 locations.

In both embodiments, the panel 110 is made from an isotropic material, namely 5 mm thick Rohacell™ (expanded poly methylimide) and has an outer periphery with a diameter of 100 mm and an inner periphery with a diameter of 20 mm. The balancing action of the masses is related to the relative distance from the drive point and/or centre of the panel. The value of the masses is balanced as follows:

| Component | diameter ratios | relative ratios | relative mass | actual mass (gm) |
|---|---|---|---|---|
| Mass 16 | 0.90 | 1.45 | 1.45 | 5.60 |
| Coil 12 | 0.62 | 1.00 | 1.00 | 4.15 |
| Mass 14 | 0.33 | 0.53 | 0.53 | 2.15 |

Figure 28A:
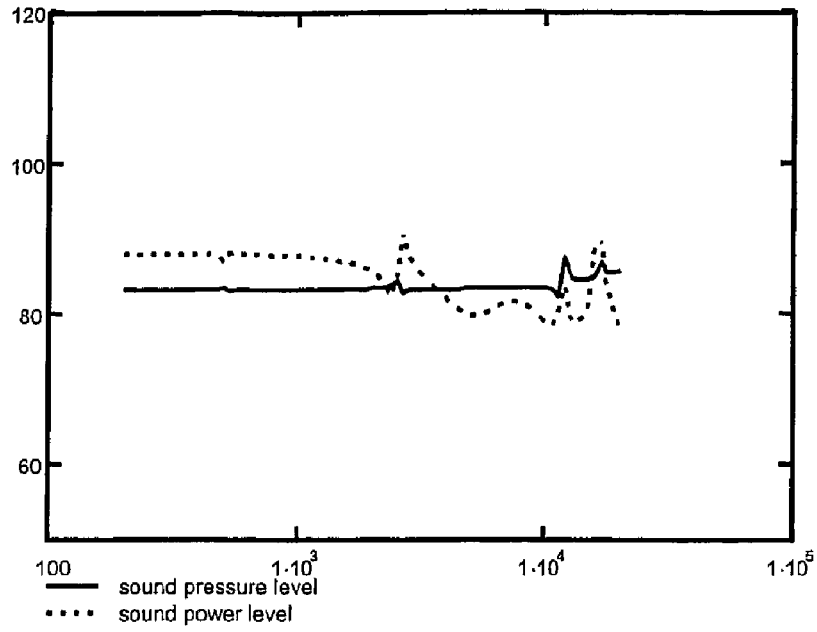
FIG. 28*a* is a graph showing the variation of on-axis sound pressure and half-space power with frequency for the device of FIG. 12*b;*
Figure 28B:
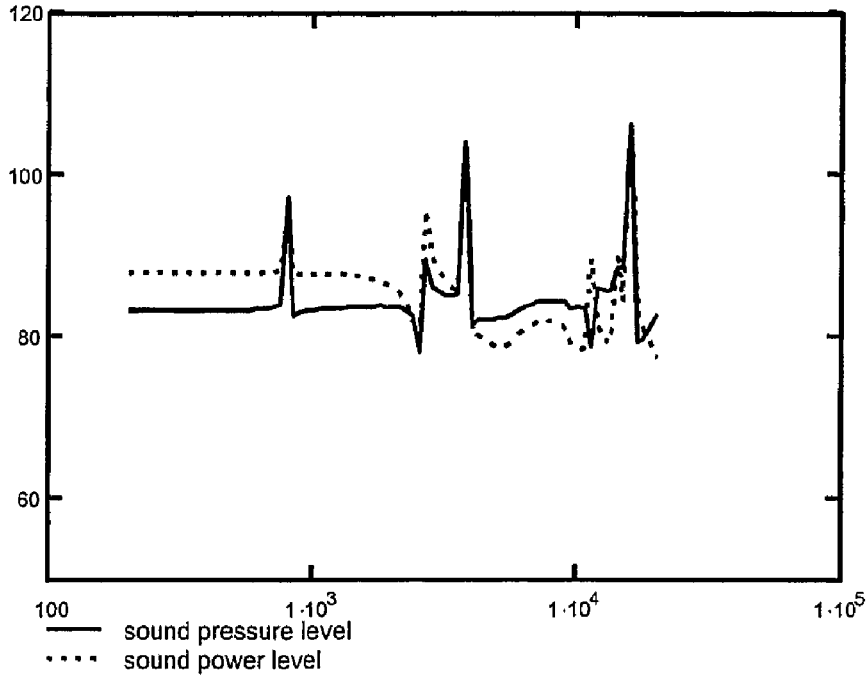
FIGS. 28*b*, 28*c* and 28*d* are graphs showing the variation of on-axis sound pressure and half-space power with frequency for the device of FIG. 27*a* with an included angle of 158°, 174° and 166° respectively.
Figure 28C:
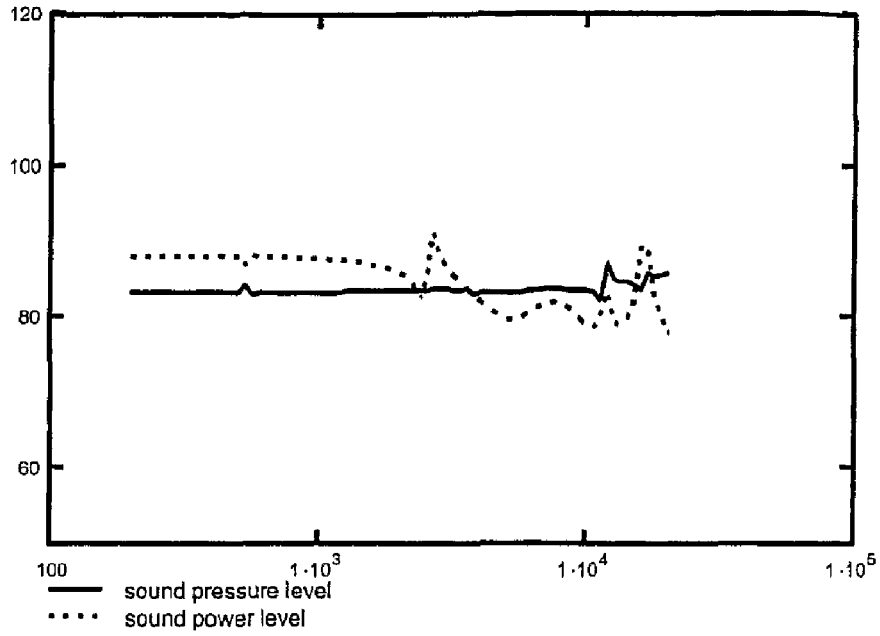
Figure 28D:
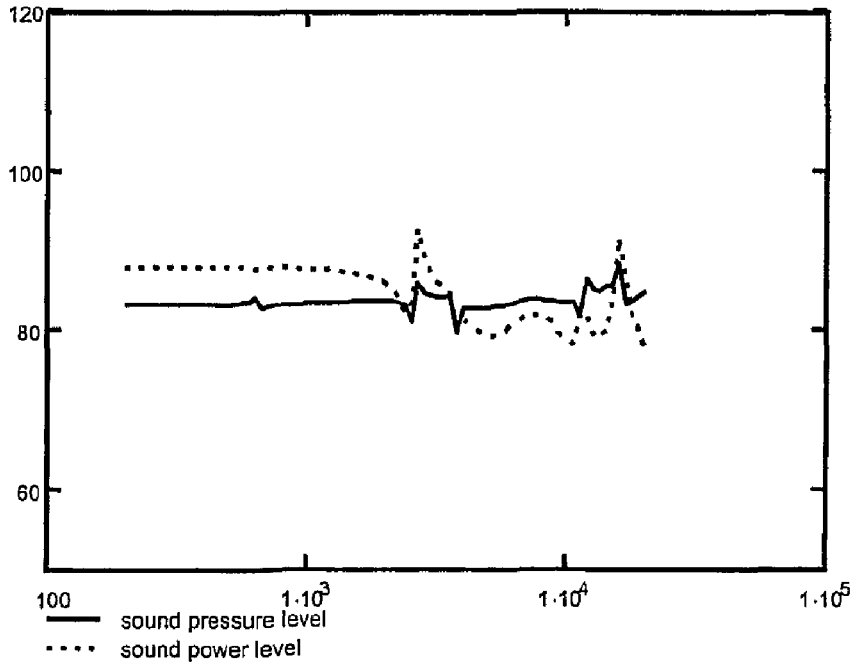

FIGS. 28*a* and 28*b* show the on-axis pressure and half-space power for the loudspeakers of FIGS. 12*b* and 27*a* respectively. FIG. 28*b* has an included angle of 158°, and has been chosen to illustrate the approximate limiting case for a three-mass balancing solution for cones. Both loudspeakers still achieve extended off-axis frequency response and good sound quality and intelligibility over the listening region. FIGS. 28*c* and 28*d* show how the performance improves for variations of the three mass device of FIG. 27*a* in which the cone angles are reduced 174° and 166°. In each of FIGS. 28*a* to 28*d*, the sound power steps down at the second mode and stays at this level to the high frequency limit.

Figure 29A:
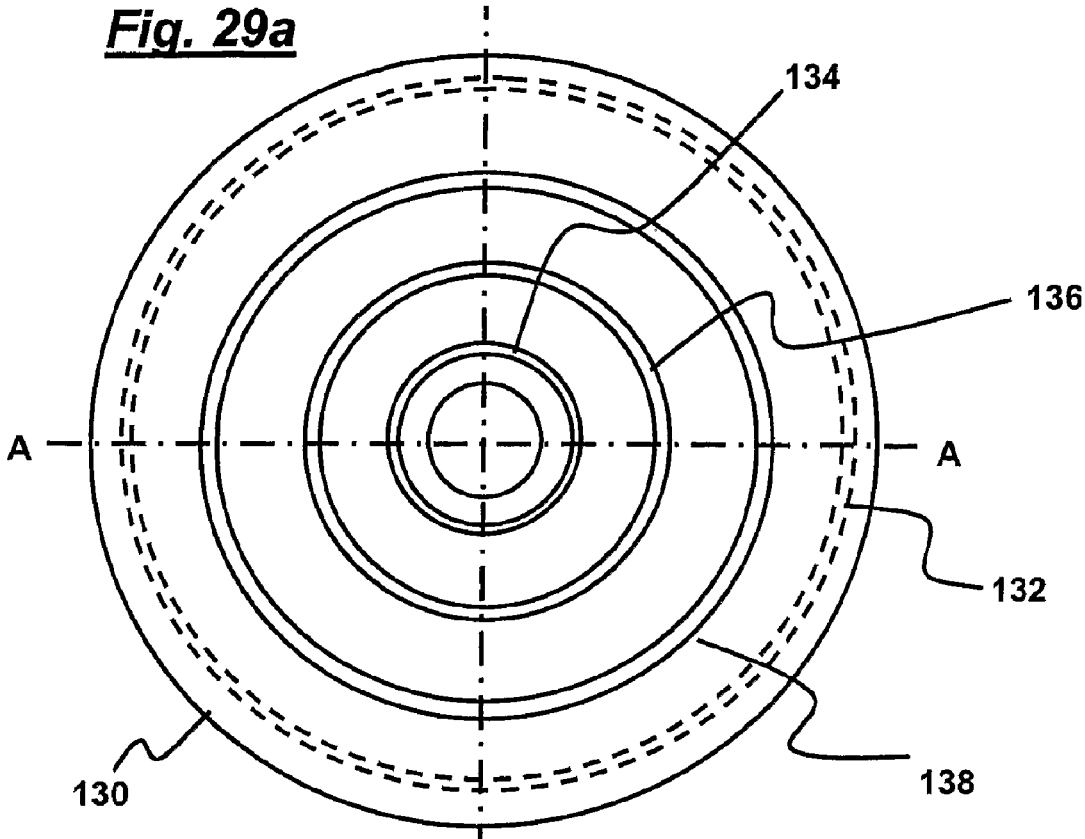
FIG. 29*a* is a plan view of another embodiment of the present invention.
Figure 29B:
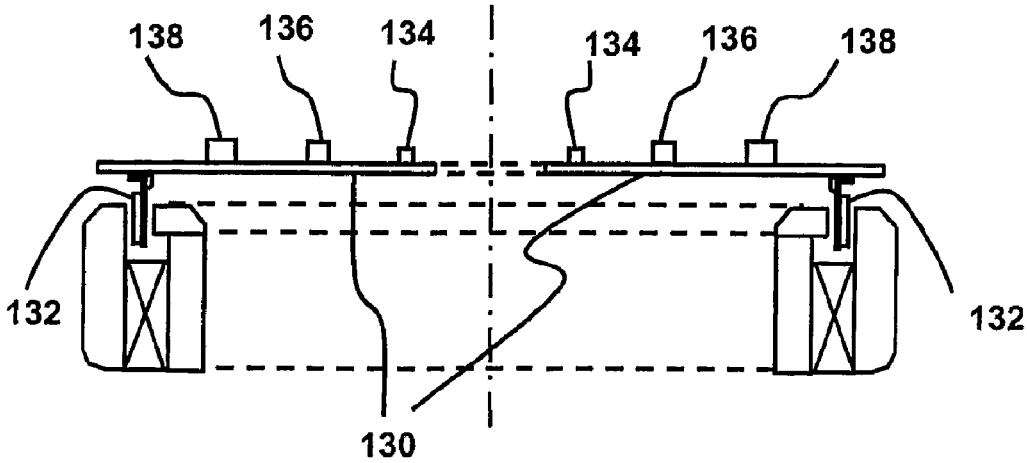
FIG. 29*b* is a cross-sectional view along line AA of FIG. 29*a;*

FIGS. 29*a* and 29*b* shows a variation on the device of FIG. 12*b* in which the locations of the masses and voice coils are chosen to compensate for four modes. The diaphragm is an annular flat panel 130 with a transducer having a voice coil 132 concentrically mounted to the panel 10 at a diameter ratio of 0.92. Three ring-shaped (or annular) masses 134, 136, 138 are concentrically mounted to the panel 130 using adhesive tape at diameter ratios 0.23, 0.46 and 0.7. As outlined above, the value of the masses is scaled to that of the voice coil and since the voice coil has a mass of 8 gm, the masses have values of 1.76 g, 3.864 gm and 6.06 gm respectively. The values of the masses decrease towards the centre of the panel.

Figure 30A:
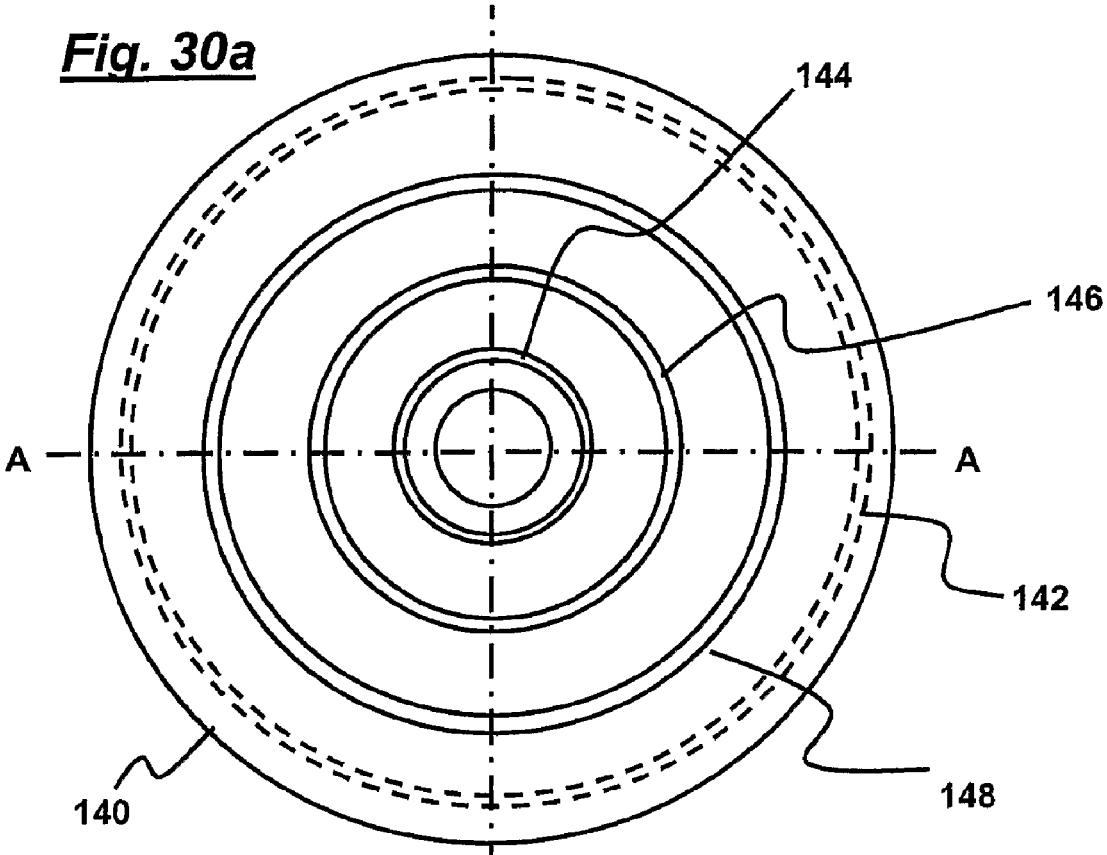
FIG. 30*a* is a plan view of another embodiment of the present invention.
Figure 30B:
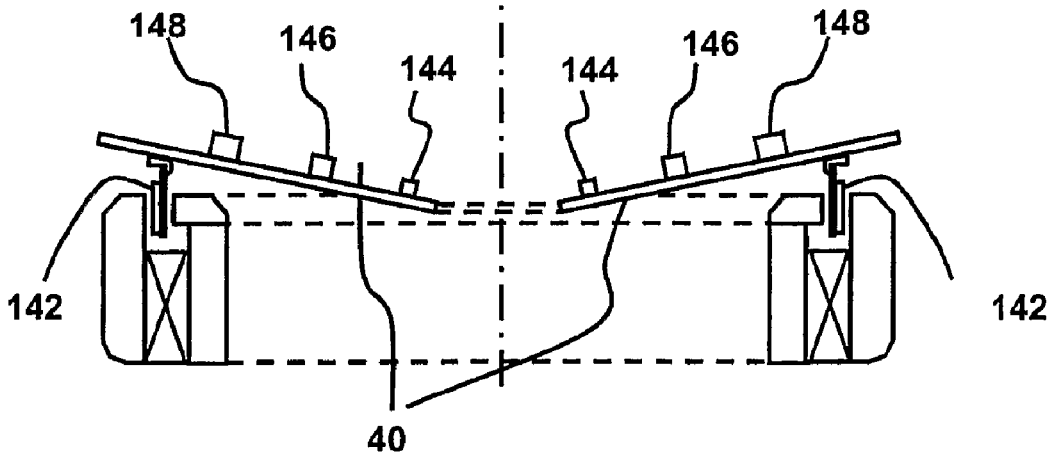
FIG. 30*b* is a cross-sectional view along line AA of FIG. 30*a;*

FIGS. 30*a* and 30*b* show a variation on the embodiment of FIG. 29*a* in which the diaphragm 140 is now cone-like having a cone angle of 158°. As in the previous embodiment, the voice coil 142 is mounted at the annular location which is 0.92 of the radius and ring masses 144, 146, 148 are mounted at the 0.23, 0.46, and 0.70 locations. The relative masses of the voice coil and ring masses are unchanged.

Figure 31:
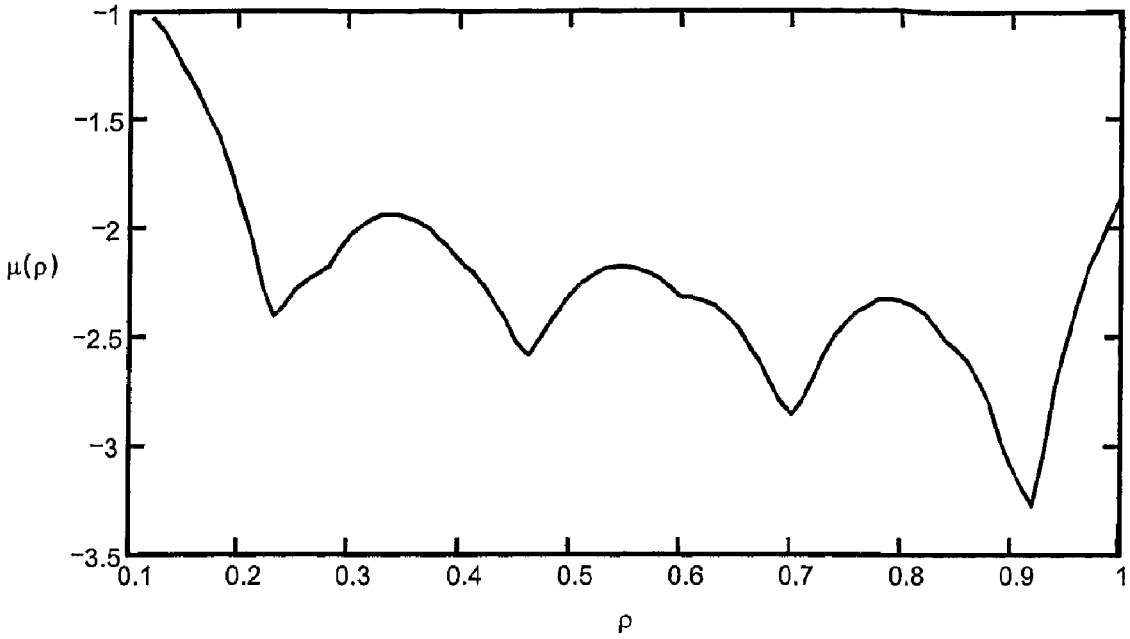
FIG. 31 shows the variation of the mean value of the real part of the admittance Ym with panel diameter for the first four modes of the panel of FIG. 29*a;*

FIG. 31 shows the logarithmic mean of the response of the first four modes (N=4) of the panel of FIG. 29*a* as it varies the radius of the panel. The mimina occur at 0.23, 0.46, 0.70 and 0.92 of the radius and these are the locations of the voice coils and masses used in FIGS. 29*a* and 29*b*. The solution from the first four modes is not an extension of the solution from the first three modes.

Figure 32A:
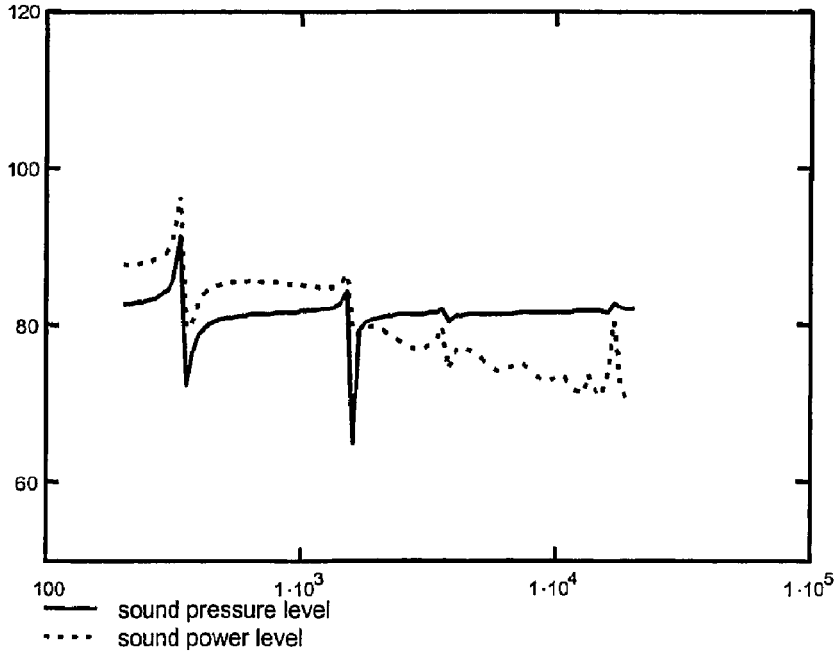
FIG. 32*a* is a graph showing the variation of on-axis sound pressure and half-space power with frequency for the device of FIG. 29*a;*
Figure 32B:
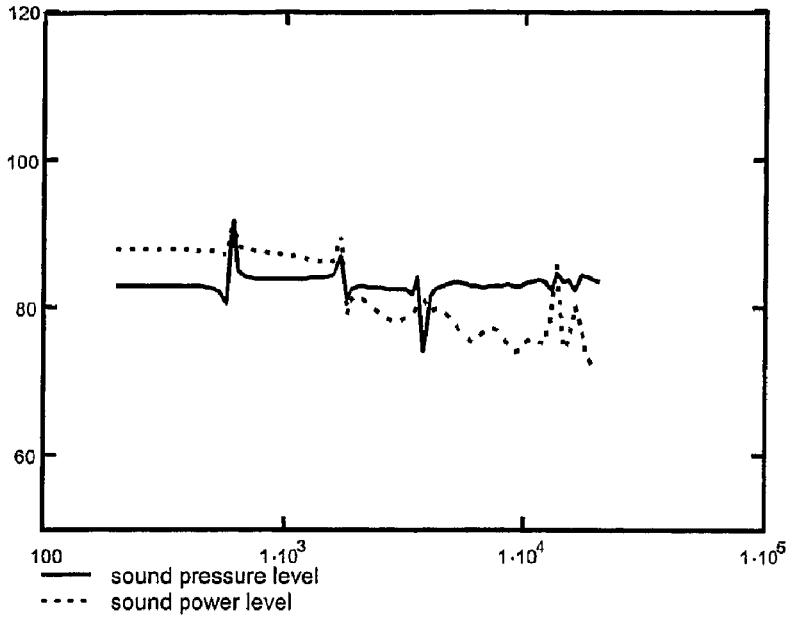
FIGS. 32*b*, 32*c* and 32*d* are graphs showing the variation of on-axis sound pressure and half-space power with frequency for the device of FIG. 29*a* with varying annular masses.

FIGS. 32*a* and 32*b* show the on-axis pressure and half-space power for the loudspeakers of FIGS. 29*a* and 30*a* respectively. The loudspeakers both have extended off-axis frequency response and good sound quality and intelligibility over the listening region. The frequency range of the device may be split into bands by the modes of the panel as determined by finite element analysis (FEA). Each band has a particular mass associated therewith and increasing the mass reduces the sensitivity of that band and vice versa. The sensitivity of the piston region is controlled by the mass at the outermost position. There is a decrease in the mechanical impedance of the panel towards the periphery and thus less mass may be required at the outermost position. Reducing the mass at the next position may also be beneficial.

Figure 32C:
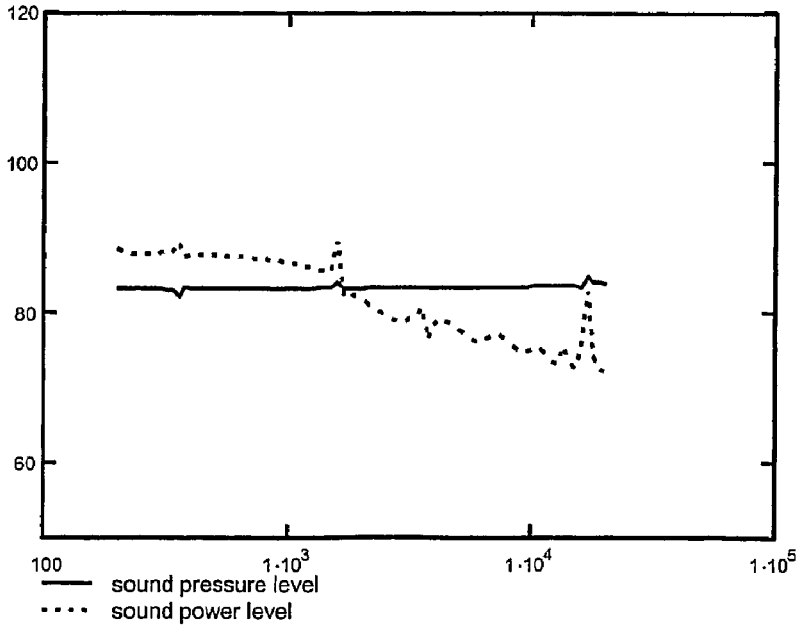
Figure 32D:
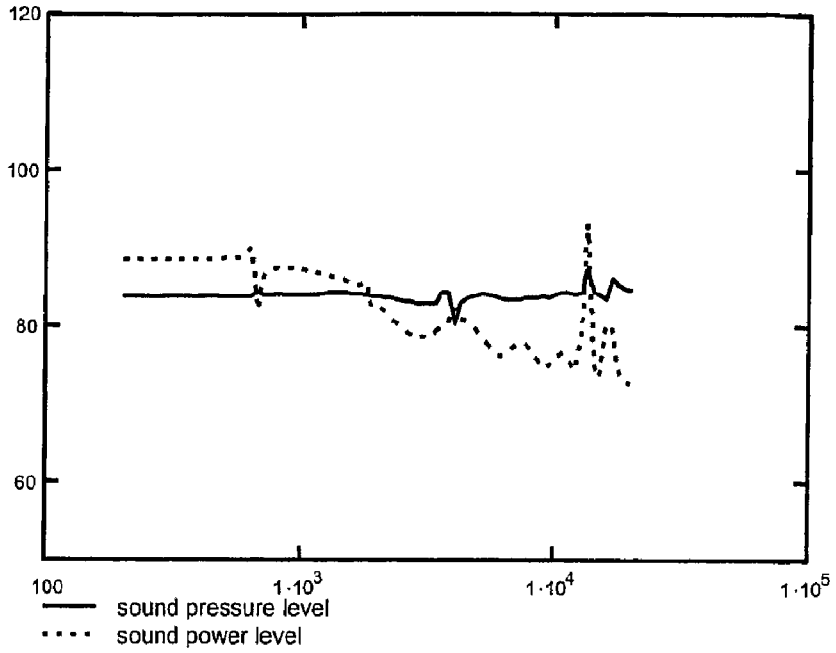

FIGS. 32*c* and 32*d* then show variations of the devices shown in FIGS. 29*a* and 29*b* respectively, where the values of the masses are varied to improve performance.

FIG. 32*c* shows the effect of reducing the mass of the transducer to 6 g and the value of the mass at the 0.7 location from 6.06 gm to 5.8 gm on the flat panel. FIG. 32*d* shows the effect of reducing the mass of the transducer to 5.4 g and the value of the mass at the 0.7 location from 6.06 gm to 5.6 gm on the 158° cone. There is an increase in sensitivity as expected and the response is generally improved for both embodiments. In FIG. 32*d*, there is a broad trough starting at 3 kHz which may be the effect of the cone cavity. In general, the performance of both embodiments is improved compared to the devices in which only three modes have been considered.

Figure 33A:
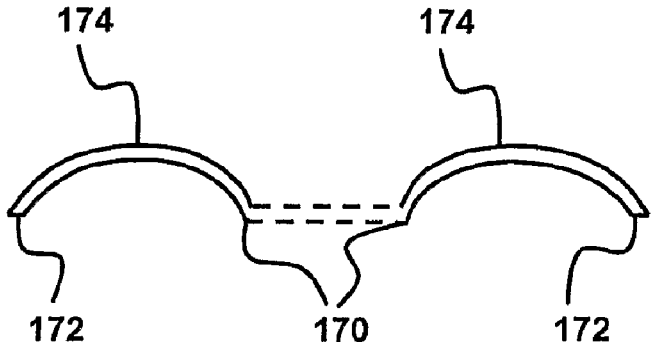
FIGS. 33*a* and 33*b* are cross-sectional views of alternative panels which may be incorporated in devices according to the present invention.
Figure 33B:
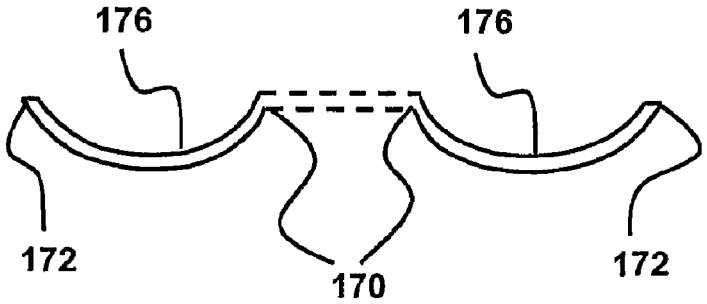

FIGS. 33*a* and 33*b* show alternative diaphragms which may be incorporated in the preceding embodiments. In FIGS. 33*a* and 33*b*, the diaphragms are annular with inner and outer peripheries 170, 172. In FIG. 33*a*, the diaphragm 174 has a convex curvature when viewed from above between the peripheries and in FIG. 33*b*, the diaphragm 176 has a concave curvature between the peripheries when viewed from above.

In each of the above embodiments, the annular masses are discrete masses mounted to the panel. The width or areal extent of the masses does not appear to be critical provided the centre of mass is referred to the correct annular location. Furthermore, the masses do not need to be mounted on the opposed surface of the panel to the voice coil. The extra mass may be provided at the annular locations by increasing the panel density in these locations. The panel may be injection moulded with additional masses at the annular locations.

Figures 34A, 34B:
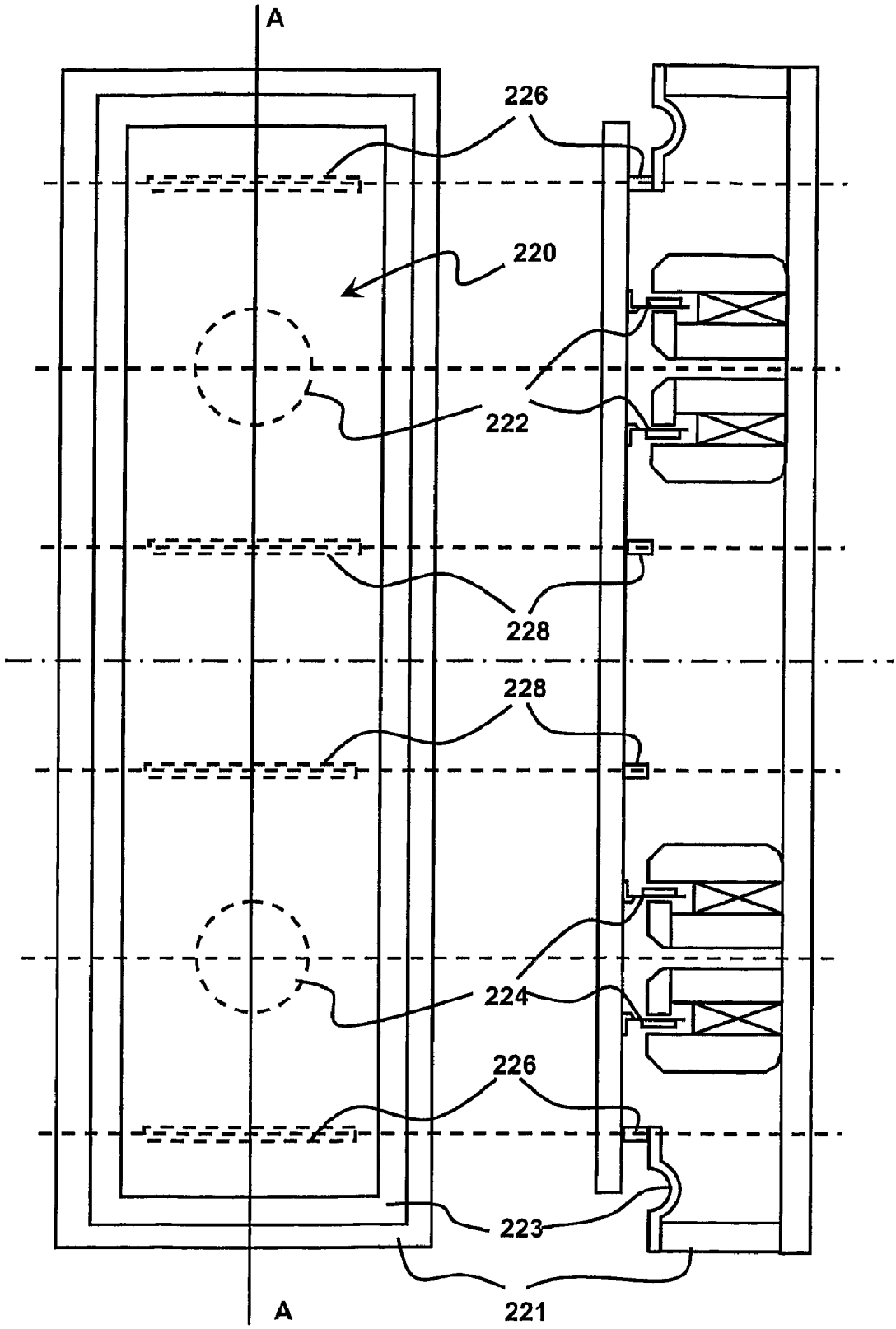
FIG. 34*a* is a plan view of another embodiment of the present invention.
FIG. 34*b* is a cross-sectional view along line AA of FIG. 34*a;*

FIGS. 34*a* and 34*b* show a loudspeaker comprising a diaphragm in the form of a beam-shaped panel 220 and two transducers mounted thereto. Two pairs of masses 228, 226 are mounted at locations at 0.19 and 0.88 of the distance from the symmetry line (or centre) to the edge of the panel (i.e. over the half-length of the panel). The voice coil 222, 224 of each transducer is mounted at a location which is 0.55 away from the centre of the panel. The panel 220 is mounted to a chassis 221 via a suspension 223 mounted at the 0.88 location.

The voice coils 222, 224 and masses 228 at 0.19 have equal mass. Since the beam is of constant width, the mass per unit length is proportional to mass but independent of position. However, due to edge effects, those masses nearest the edges of the panel may beneficially be smaller in value, typically by up to about 30%

Figure 35A:
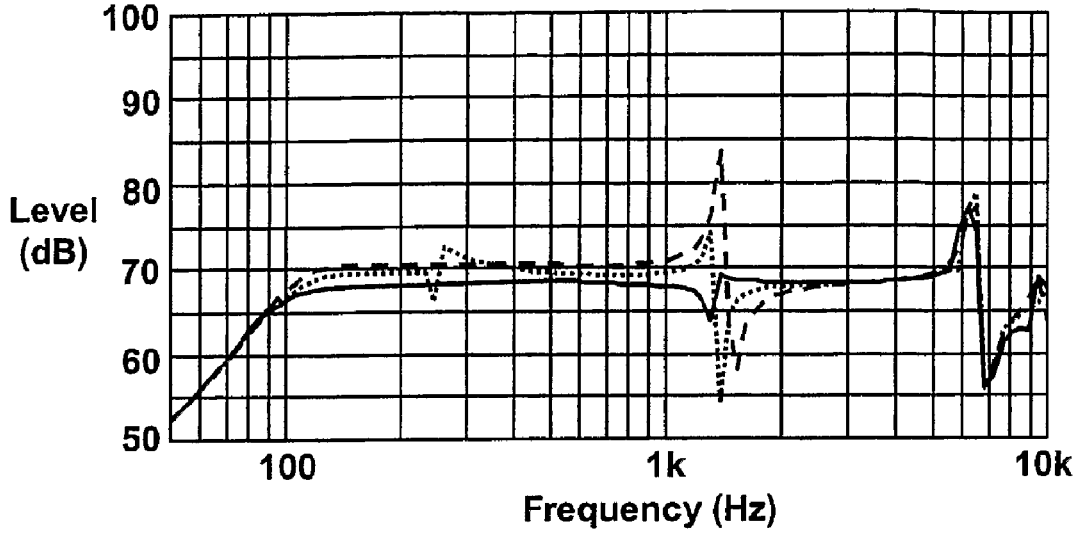
FIGS. 35*a* and 35*b* are graphs showing the variation of on-axis sound pressure and half-space power with frequency respectively for the device of FIG. 34*a* with one mass, with two masses and without masses.
Figure 35B:
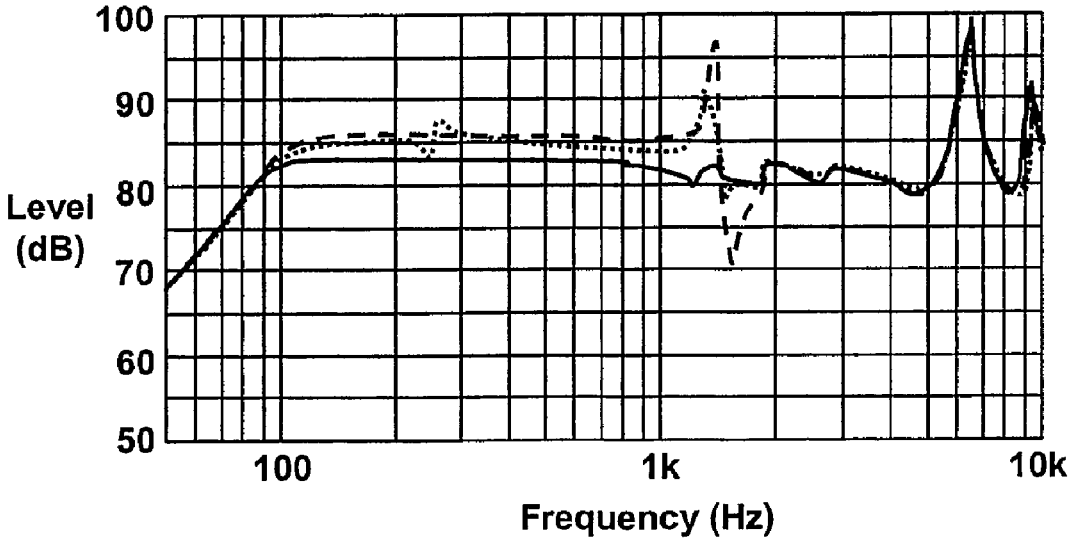

FIGS. 35*a* and 35*b* show the on-axis pressure and half-space power for the loudspeaker of FIG. 34*a* with both pairs of masses (solid line), with only one pair of masses (dotted line) and without any masses (dashed line). In the device without any masses, the transducers are mounted at the nodes of the panel. For the modelling, a panel of length 200 mm, with a first mode at around 280 Hz was chosen. The voice coils are mounted at 55 mm from the centre and each pair of masses is mounted at 19 mm and 88 mm from the centre, respectively. The voice-coils and inner masses at 55 mm are 550 mg each, and the outer masses are 400 mg.

As shown in the FIGS. 35*a* and 35*b*, the panel without masses has only a bandwidth of about 1500 Hz, i.e. up to the second mode. In contrast, the panel with both pairs of masses has an extended off-axis frequency response and has improved sound quality and intelligibility up to about 7 kHz, i.e. up to the fourth mode.

Figure 36A:
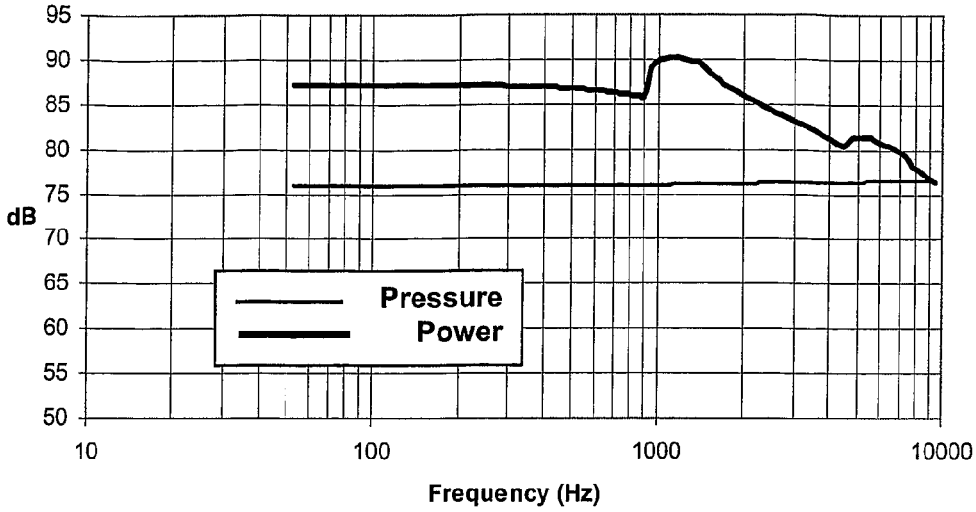
FIGS. 36*a*, 36*b* and 36*c* are graphs showing the variation of on-axis sound pressure and half-space power with frequency for two theoretical loudspeakers and a practical loudspeaker respectively.

FIGS. 36*a* to 36*g* illustrate a method for choosing the positions of the masses and the drive location for the device of FIG. 34*a*. FIG. 36*a* shows the sound pressure and sound power levels for a theoretical pistonic loudspeaker comprising a free beam-shaped, flat, rigid panel driven by a mass-less point force applied at the panel centre. The sound pressure is constant with frequency while the sound power is constant until approximately 1 kHz and thereafter it falls away gradually with increasing frequency.

Figure 36B:
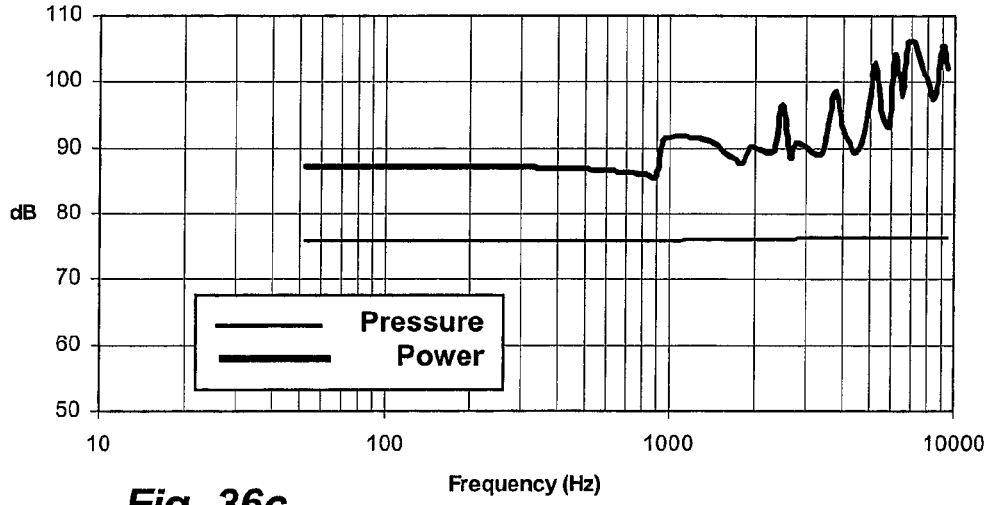

FIG. 36*b* shows the sound pressure and sound power levels for a theoretical loudspeaker comprising a free, resonant beam-shaped panel driven by a mass-less point force applied at the panel centre. The sound pressure is still substantially constant with frequency but now the fall-off in sound power has been significantly improved compared to that shown in FIG. 36*a*. Panel modes are now visible in the analysis since the model uses no electromechanical damping. If these modes were invisible the free resonant panel delivers constant on-axis sound pressure, as well as substantially constant sound power.

Figure 36C:
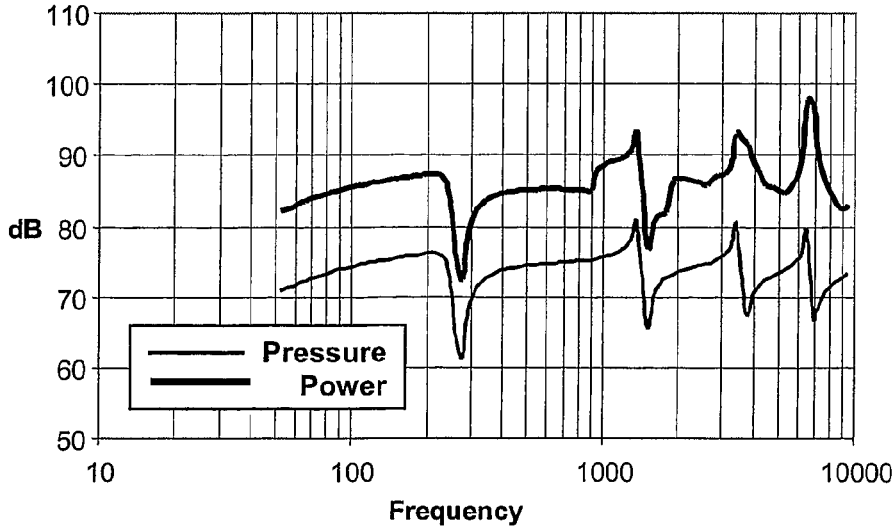

FIG. 36*c* shows the sound pressure and sound power levels for a practical loudspeaker similar to that of FIG. 36*b* but driven by a transducer with a voice coil having a 25 mm diameter and a finite mass which is dependent upon the design of the voice coil (materials, turns, etc.). The fall-off in sound power with frequency is still improved compared to that in FIG. 36*a*. However, now both the on-axis pressure and sound power are no longer constant with frequency.

Since the loudspeakers are quasi one-dimensional, simple modelling may be used for the modes. The results are similar to that shown in FIG. 8 in which the modes of the theoretical ideal of FIG. 36*b* are inertially balanced to the extent, that except for the "whole body displacement" mode, they all have zero mean displacement. In contrast, the modes of the practical loudspeaker of FIG. 36*c* are not balanced. However, this behaviour may be addressed as outlined above by mathematically mapping the nodal contours and hence modes and velocity profile of the practical loudspeaker to those of the ideal theoretical loudspeaker.

As outlined above, the location(s) are at positions of average low velocity, i.e. admittance minima. For a beam-shaped panel, the admittance Ym and its logarithmic mean $\mu(\xi)$ as it varies with half-length $\xi$ are calculated using the equations below:

$$Ym(N, \xi, \omega) := j \cdot \omega \cdot \sum_{i=0}^{N} \frac{y(i, \xi)^2}{(\lambda_i)^4 - \omega^2 + j \cdot \zeta \cdot (\lambda_i)^2 \cdot \omega} \qquad \zeta \equiv 5 \cdot \%$$

$$S := \int_{0.3}^{2.3} 10^{\phi}\, d\phi$$

$$\mu(\xi) := \frac{1}{S} \cdot \int_{0.3}^{2.3} 10^{\phi} \cdot \log(\mathrm{Re}(Ym(4, \xi, 10^{\phi})))\, d\phi$$

N=Number of modes.

S=Scaling factor over the operative frequency range.

$\lambda_i$=eigenvalue≈$(n-1/4)\cdot\pi$

ω=frequency

γ(i, λ)=mode shape of $i^{th}$ mode

Figure 36D:
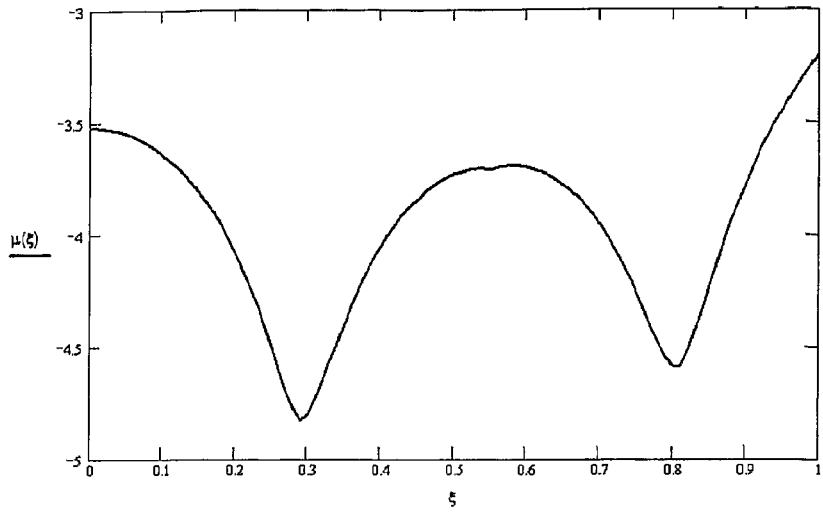
FIGS. 36*d* to 36*g* are graphs of the logarithmic mean admittance of the first two to five modes of the panel of FIG. 34*a* against half-length, respectively.

FIG. 36*d* shows the logarithmic mean admittance of the first two modes (N=2) of the panel of FIG. 34*a* as it varies with the distance from the symmetry line (or centre) to the edge of the panel (i.e. over the half-length of the panel). The minima occur at 0.29 and 0.81 of the half length and thus the voice coil and/or masses may be placed at these locations.

Figure 36E:
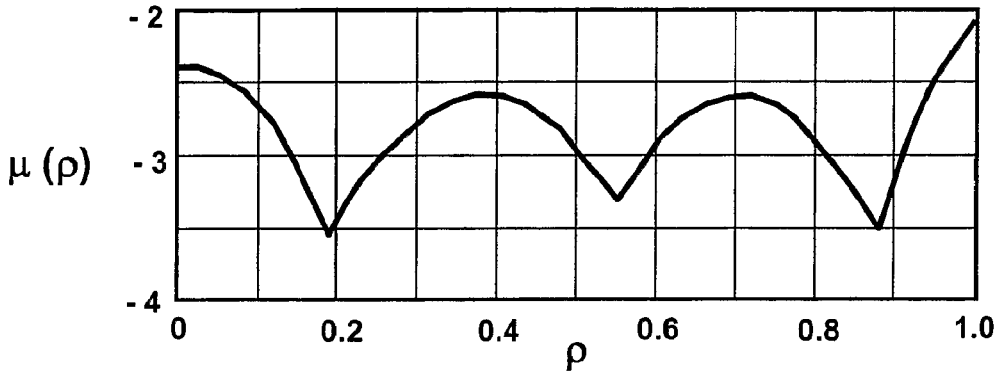

FIG. 36*e* shows the logarithmic mean admittance of the first three modes (N=3) of the panel of FIG. 34*a* as it varies with the distance from the symmetry line (or centre) to the edge of the panel (i.e. over the half-length of the panel). Since the first five modes of a beam-shaped panel have frequencies in the ratio 1:5.4:13:25:40, addressing the first three modes means that the device can cover quite a wide bandwidth. The minima occur at 0.19, 0.55 and 0.88 of the half length and thus the voice coil and/or masses are placed at these locations (as shown for example in FIGS. 34*a* and 34*b*).

Figure 36F:
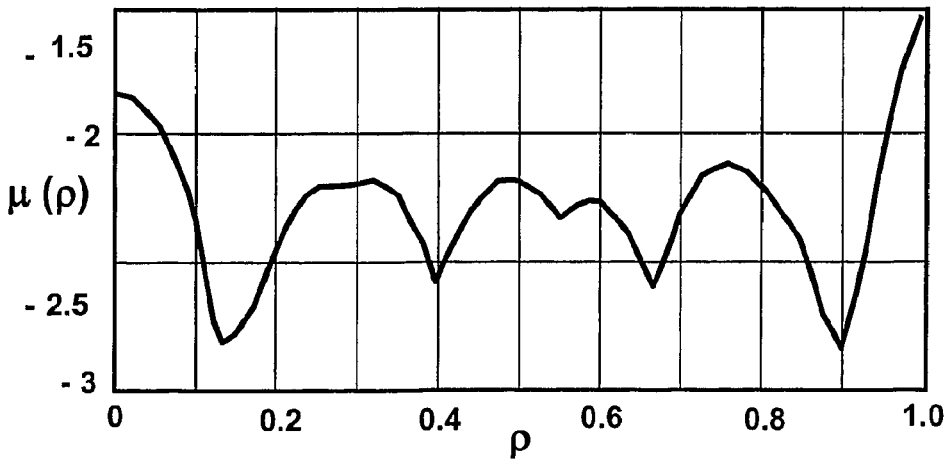

FIG. 36*f* shows the logarithmic mean admittance of the first four modes (N=4) of the panel of FIG. 34*a* as it varies with the distance from the symmetry line (or centre) to the edge of the panel (i.e. over the half-length of the panel). The minima occur at 0.15, 0.40, 0.68 and 0.91 of the half length. Thus the solution from the first four modes is not an extension of the solution from the first three modes.

The higher order modes may be satisfactorily mapped if the first four modes are mapped when the higher modes are out of the frequency band of interest, and the panel is reasonably stiff in shear. When this is not true, then higher orders of modal balancing are possible; e.g. five or more modes.

Figure 36G:
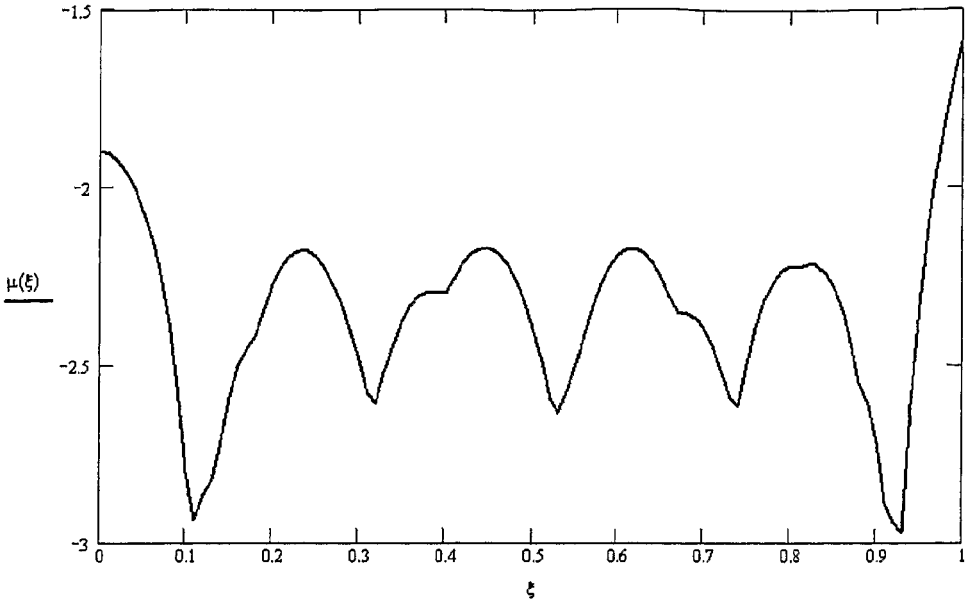

FIG. 36*g* shows the logarithmic mean admittance of the first five modes (N=5) of the panel of FIG. 34*a* as it varies with the distance from the symmetry line (or centre) to the edge of the panel (i.e. over the half-length of the panel). The minima in the admittance Ym when considering five modes are at 0.11, 0.315, 0.53, 0.74 and 0.93 respectively.

The various minima restrict the location of the transducer on the panel any thus the overall panel size may be determined by industry standard voice coil sizes. However, it is possible to have more than one transducer on the panel and thus the constraints on panel size are relaxed. The effect of the ratio of transducer diameter to panel width on the presentation of cross-modes is profound and a value of about 0.8 for this ratio may beneficially suppress the lowest cross-mode.

Figure 36H:
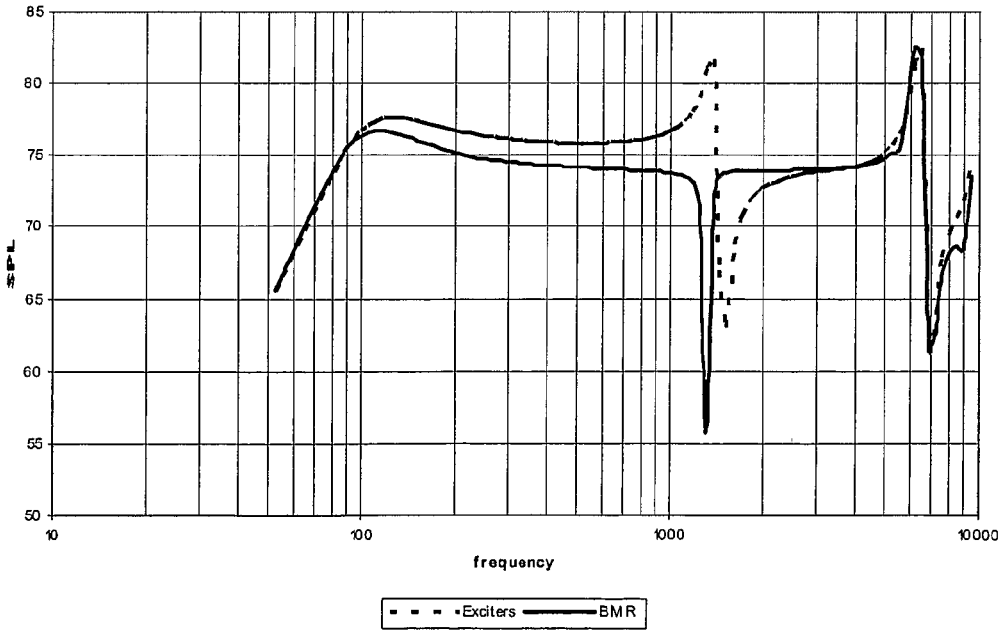
FIGS. 36*h* and 36*i* are graphs of the sound pressure level against frequency for a two mode and a five mode solution respectively.

FIG. 36*h* compares the output from a diaphragm with a pair of transducers mounted thereon (dotted line) with the same diaphragm having the pair of transducers and a pair of masses mounted at an average nodal position of the two modes in the frequency range (solid line). The first mode is not seen in either case due to the location of the transducer. The second mode is balanced by the addition of the masses. The average nodal locations are 0.29 and 0.81 and are calculated using the same method above. The nodal locations translate to locations of 0.095, 0.355, 0.645 and 0.905 when expressed as fractions of the length of the diaphragm.

Figure 36I:
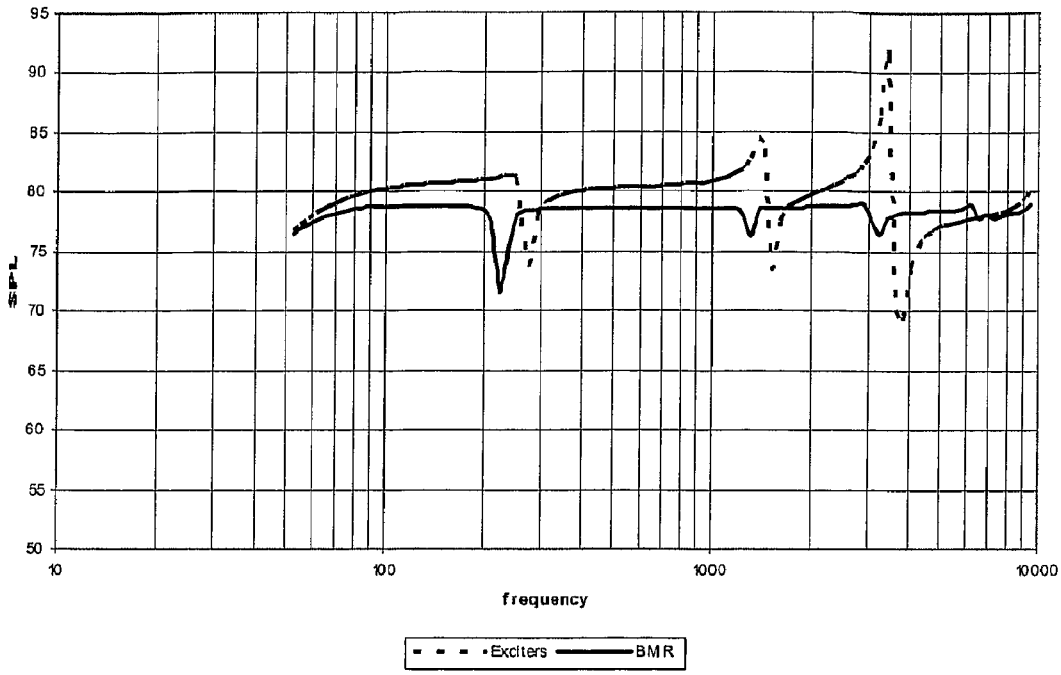

FIG. 36*i* compares the output from a diaphragm with only a transducer mounted thereon (dotted line) with the same diaphragm having the transducer and a pair of masses mounted at an average nodal position of the five modes in the frequency range (solid line). The average nodal radii are 0.11, 0.315, 0.53, 0.74 and 0.93 which translate to locations (as fractions of the length of the diaphragm) of 0.035, 0.13, 0.235, 0.3425, 0.445, 0.555, 0.6575, 0.765, 0.87 and 0.965.

Figure 37:
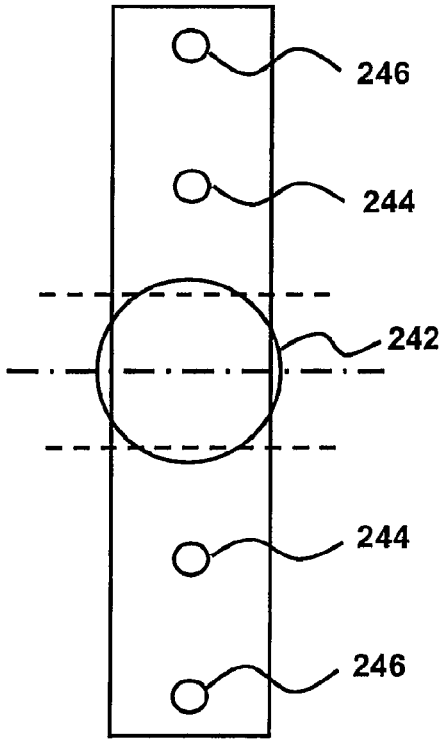
FIGS. 37 and 38 are plan views of two further embodiments of the present invention.

FIG. 37 shows an alternate embodiment of the present invention in which a single transducer is mounted to a beam-shaped panel like that used in the device of FIG. 34*a*. The transducer has a large voice coil 242 which is mounted centrally on the panel so that the drive is essentially at the 0.19 locations. Two pairs of masses 244, 246 are mounted at the 0.55 and 0.88 locations. The voice coil mass is halved by the dual locations so the masses are set at half the overall coil mass. Like the device of FIG. 34*a*, the locations of the masses and voice coil are chosen to compensate for three modes.

Figure 38:
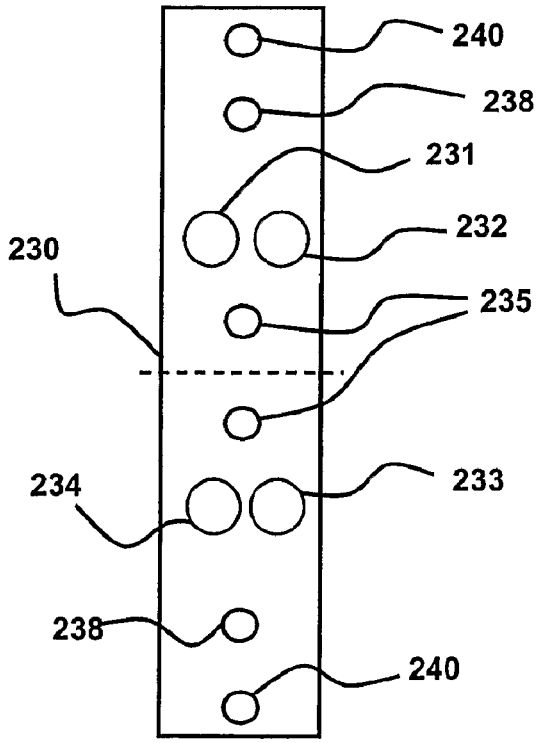

FIG. 38 shows another variation on the device of FIG. 34*a* in which the locations of the masses and voice coils are chosen to compensate for four modes. The beam shaped panel 230 has four transducers mounted thereto with the voice coils 231,232,233,234 of each transducer mounted in pairs at symmetric locations which are 0.40 away from the centre of the panel. Symmetrically placed pairs of masses 235, 238, 240 are located at 0.15, 0.68 and 0.91 away from the centre of the panel. The masses are equal to twice the individual voice coil masses except for those at the 0.91 location where edge effects mean that a lower value may be useful, up to about 30% less. So, for example, if the voice coil masses are 225 mg, the masses are 550 mg except for the masses at the 0.91 locations which are reduced to 400 mg.

Figure 39A:
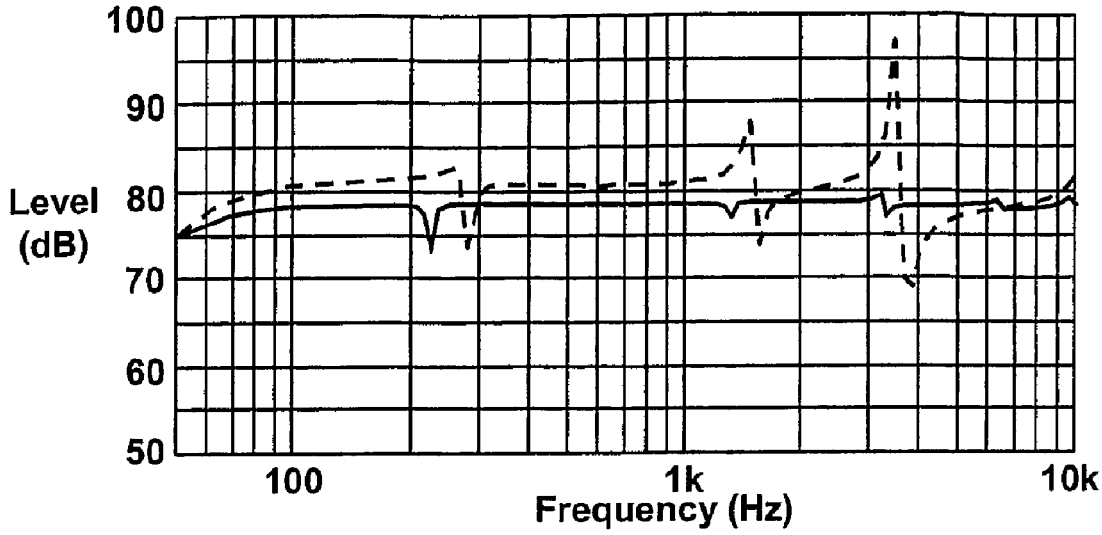
FIGS. 39*a* and 39*b* are graphs showing the variation of on-axis sound pressure and half-space power with frequency respective for the device of FIG. 38 with and without masses.
Figure 39B:
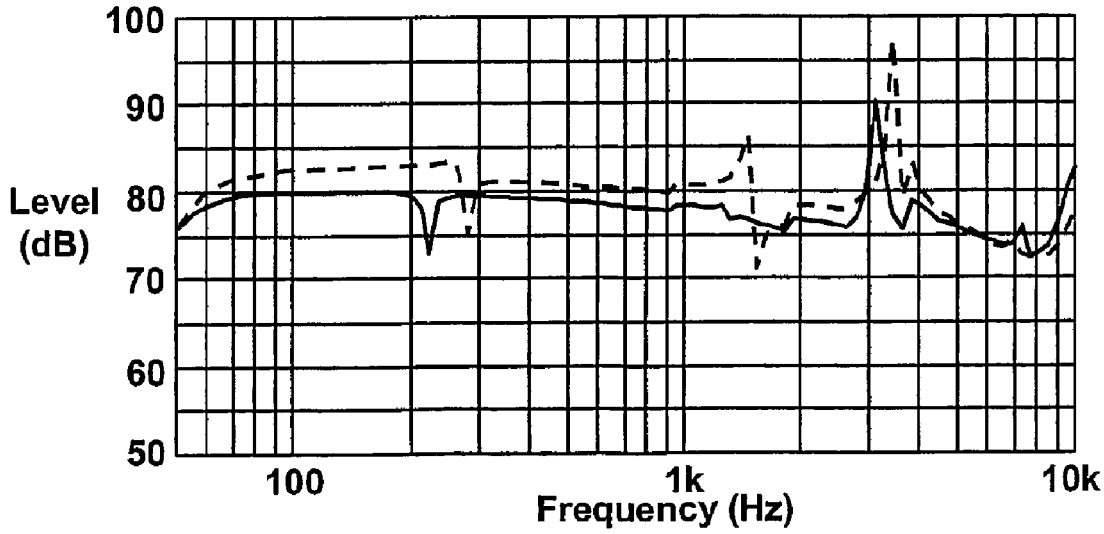

FIGS. 39*a* and 39*b* show the on-axis pressure and half-space power for the loudspeaker of FIG. 38 with all three pairs of masses (solid line) and without any masses (dashed line). In the device without any masses, the transducers are mounted at the nodes of the panel. The bandwidth of the loudspeaker of FIG. 38 is increased by 4 kHz when compared to that of FIG. 34*a*. However, at high frequencies, the panel is starting to behave as a two-dimensional object because the voice coil size is now critical. Another solution to extend from three to four modes, may be to use a bar coupler rather than the split transducer, then the fourth mode may also be balanced. Further improvement may also be possible by splitting the outermost masses so that they lie on the nodal lines of the lowest cross-mode. As shown in FIGS. 39*a* and 39*b*, fixing the fourth mode appears to give the fifth for free, certainly for the pressure response.

FIGS. 40*a* and 40*b* show an alternate embodiment of the present invention in which the beam-shaped panel 250 has a thickness which varies with length. The overall length of the panel 250 is 306 mm and the thickness increases linearly from t1=2 mm at each edge to t2=5 mm in the centre. The voice coils 252, 254 of each transducer are mounted at a location which is 0.08 away from the centre of the beam. Pairs of masses 256, 258, 260 are mounted at locations at 0.28, 0.53 and 0.80 of the distance from the symmetry line to the edge of the panel. The masses mounted at 0.28 and 0.53 are equal in mass to the voice coils 252, 254 whereas the pairs of masses 260 at 0.80 have reduced mass. Thus for modelling purposes, the mounting locations are 12 mm, 45 mm, 85 mm and 128 mm. The voice-coils and inner two pairs masses are 550 mg each, and the outer masses are 400 mg.

Figure 41B:
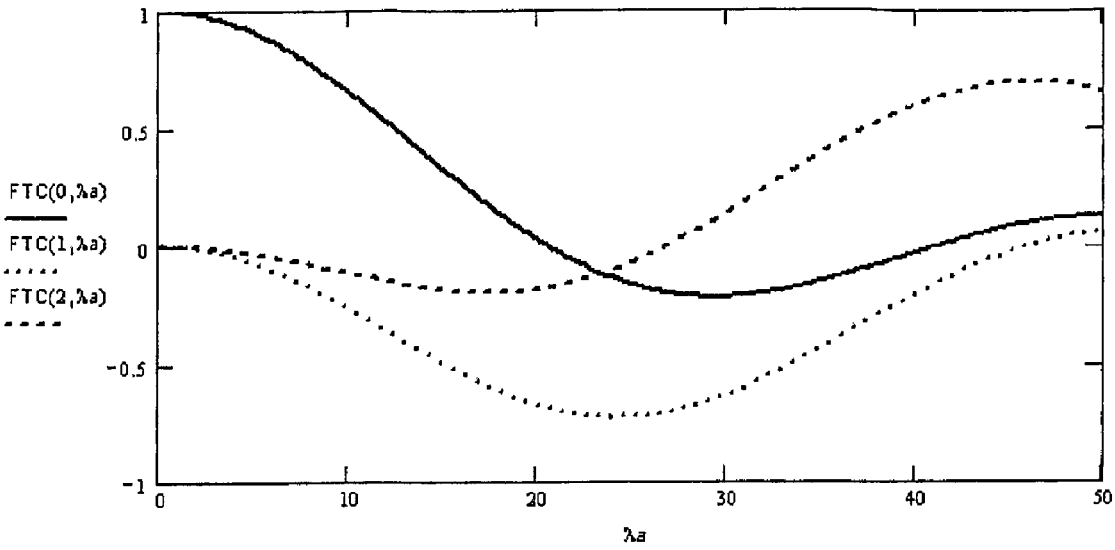
FIG. 41*b* is a graph of the Fourier transforms of the mode shapes of FIG. 41*a;*

Since the panel is symmetrical, FIG. 41*a* shows the shape of the first four modes of each half of the panel of the embodiment used in FIG. 40*a*. FIG. 41*b* shows the Fourier transforms for these four modes. λa=k.a.sin(θ), where k is the acoustic wave-number, a is the half-length of the panel, and θ is the radiation angle measured from the axis of the panel. Note that except for the rigid-body mode, FTC(0,λa), the transforms all vanish for λa=0. This corresponds to zero frequency or zero angle—i.e. on-axis.

Figure 41C:
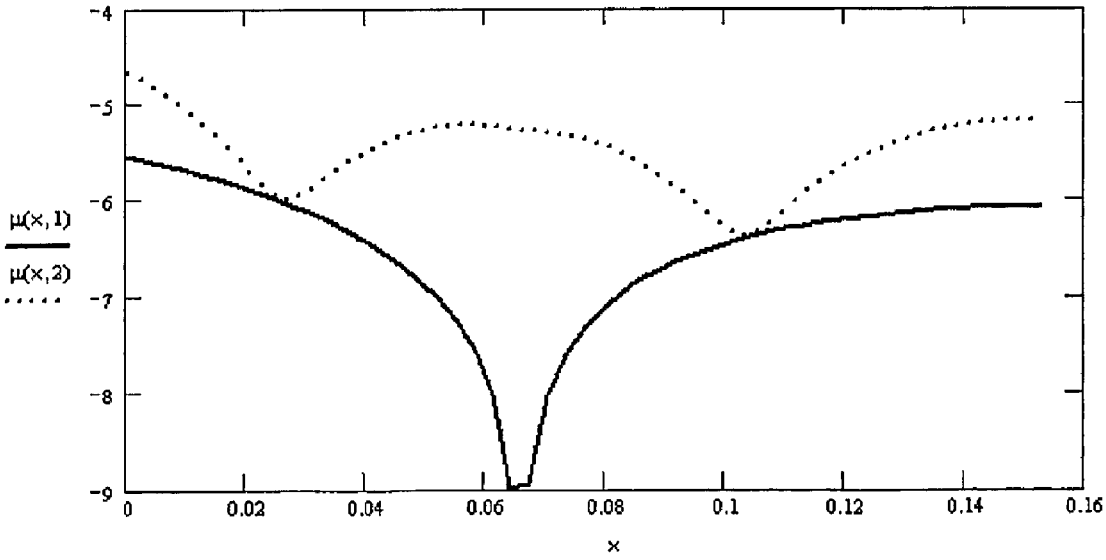
FIG. 41*c* is a graph showing the logarithmic mean of the response for both the first mode and the first two modes of the diaphragm of FIG. 40*a*.
Figure 41D:
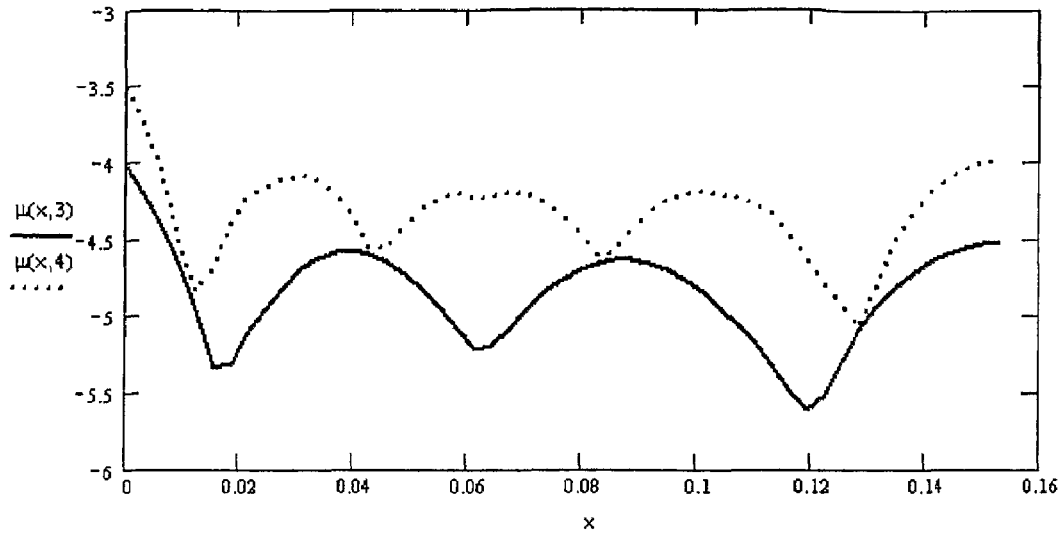
FIG. 41*d* is a graph showing the logarithmic mean admittance for both the first three modes and the first four modes of the diaphragm of FIG. 40*a*.

FIGS. 41*c* and 41*d* shows the logarithmic mean of the response of the first four modes (N=1 . . . 4) of the panel of FIG. 40*a* as it varies with the distance from the symmetry line (or centre) to the edge of the panel (i.e. over the half-length). The minima are tabulated below:

| Number of modes considered | Position of minima | Relative position of Minima |
|---|---|---|
| 1 | 65.5 mm | 0.41 |
| 2 | 25.5 mm, 65.5 mm | 0.16, 0.65 |
| 3 | 17.5 mm, 62.5 mm, 119 mm | 0.11, 0.39, 0.75 |
| 4 | 12 mm, 45 mm, 85 mm, 128 mm | 0.08, 0.28, 0.53, 0.80 |

As described above in relation to FIGS. 9*a* to 9*e*, the method is flexible enough to allow a designer to map only particular modes. The locations calculated for the first four modes, correspond to the positions of the masses and voice coil in the device of FIGS. 40*a*.

The table below shows the frequencies for the first five free-symmetric modes of the wedge of FIG. 40*a* for a minimum width t1 varying between 1 and 4.5 mm. The thickness at the centre remains at 5 mm.

| t1/ mm | Mode 1/ Hz | Mode 2/ Hz | Mode 3/ Hz | Mode 4/ Hz | Mode 5/ Hz |
|---|---|---|---|---|---|
| 4.5 | 505 | 2670 | 6573 | 12210 | 19580 |
| 4 | 492 | 2540 | 6228 | 11560 | 18560 |
| 3.5 | 478 | 2405 | 5873 | 10880 | 17430 |
| 3 | 463 | 2265 | 5504 | 10180 | 16290 |
| 2.5 | 448 | 2120 | 5118 | 9446 | 15100 |
| 2 | 431 | 1967 | 4711 | 8670 | 13840 |
| 1.5 | 413 | 1804 | 4274 | 7834 | 12490 |
| 1 | 393 | 1625 | 3792 | 6909 | 10980 |

The approximate locations of nodal lines for the first four modes are set out below. Since the panel is symmetric, only the nodal lines in one half of the panel are shown; a line at "x" implies one at "200-x".

| | First | Second Mode | | Third Mode | | |
|---|---|---|---|---|---|---|
| t1/ mm | mode Nodal line | 1st Nodal Line | 2nd Nodal line | 1st Nodal Line | 2nd Nodal Line | 3rd Nodal line |
| 4.5 | 45 | 18 | 70 | 12 | 45 | 82 |
| 4 | 44 | 18 | 70 | 12 | 44 | 82 |
| 3.5 | 44 | 18 | 70 | 12 | 44 | 81 |
| 3 | 44 | 18 | 70 | 11 | 43 | 80 |
| 2.5 | 43 | 17 | 69 | 11 | 42 | 80 |
| 2 | 43 | 16 | 68 | 10 | 41 | 79 |
| 1.5 | 42 | 16 | 68 | 10 | 40 | 78 |
| 1 | 42 | 15 | 66 | 9 | 37 | 77 |

-continued

| | Fourth Mode | | | |
|---|---|---|---|---|
| t1/mm | 1st Nodal Line | 2nd Nodal Line | 3rd Nodal line | 4th Nodal Line |
| 4.5 | 9 | 33 | 60 | 86 |
| 4 | 8 | 32 | 59 | 86 |
| 3.5 | 8 | 31 | 58 | 86 |
| 3 | 8 | 31 | 57 | 85 |
| 2.5 | 8 | 30 | 56 | 85 |
| 2 | 7.5 | 29 | 55 | 84 |
| 1.5 | 7 | 27 | 53 | 83 |
| 1 | 7 | 26 | 52 | 82 |

Comparing the results with those from FIGS. 41*c* and 41*d*, for t1=2, the locations of nodal lines for the second mode are at 0.16 and 0.68 and the average nodal locations for two modes are at 0.16 and 0.65. The locations of nodal lines for the third mode are at 0.10, 0.41 and 0.79 and the average nodal locations for three modes are at 0.11, 0.39 and 0.75. Accordingly, as indicated above the average nodal location is close to the nodal line of the highest mode which is being considered.

Figure 42A:
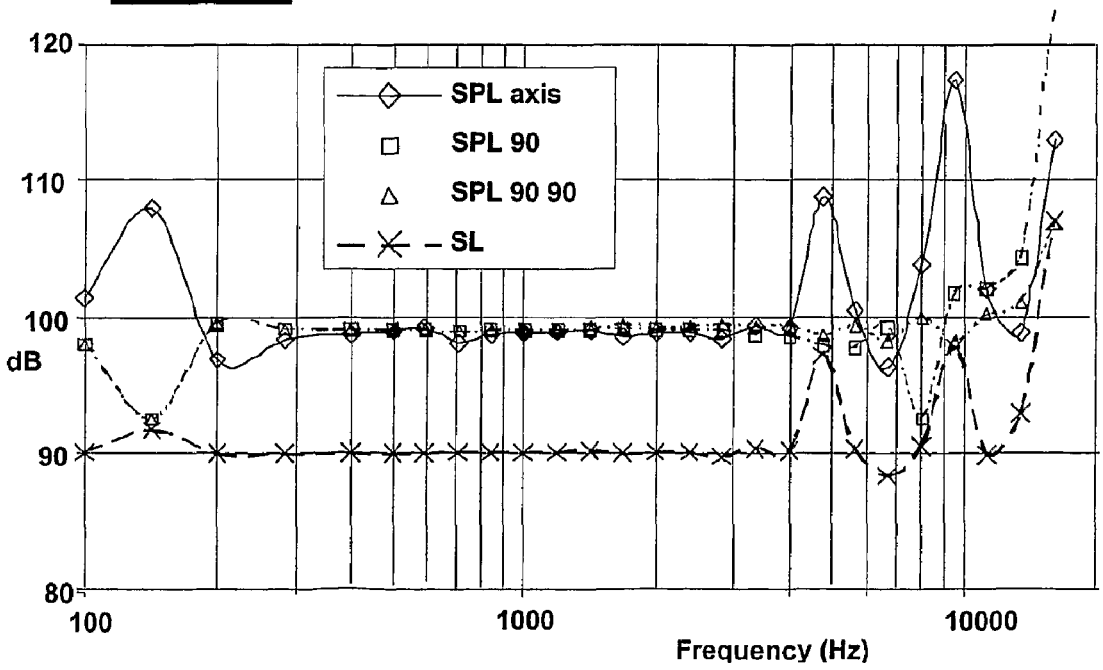
FIGS. 42*a*, 42*b* and 42*c* are graphs showing the variation of on-axis sound pressure and half-space power with frequency for two theoretical loudspeakers and a practical loudspeaker respectively.

FIG. 42*a* shows the sound pressure and sound power levels for a theoretical loudspeaker comprising a free symmetrical wedge-shaped, rigid panel driven by a mass-less point force applied at the panel centre. The panel is 200 mm long and 20 mm wide, tapering from 5 mm thick at the centre to 2 mm thick at either end. The sound pressure and sound power are generally constant with frequency up to about 10 kHz, although there is some break-through of modes at 4.8 kHz and 9.5 kHz. The far-field, on-axis pressure should be flat, however, the pressure is simulated at 200 mm so there is variation.

Figure 42B:
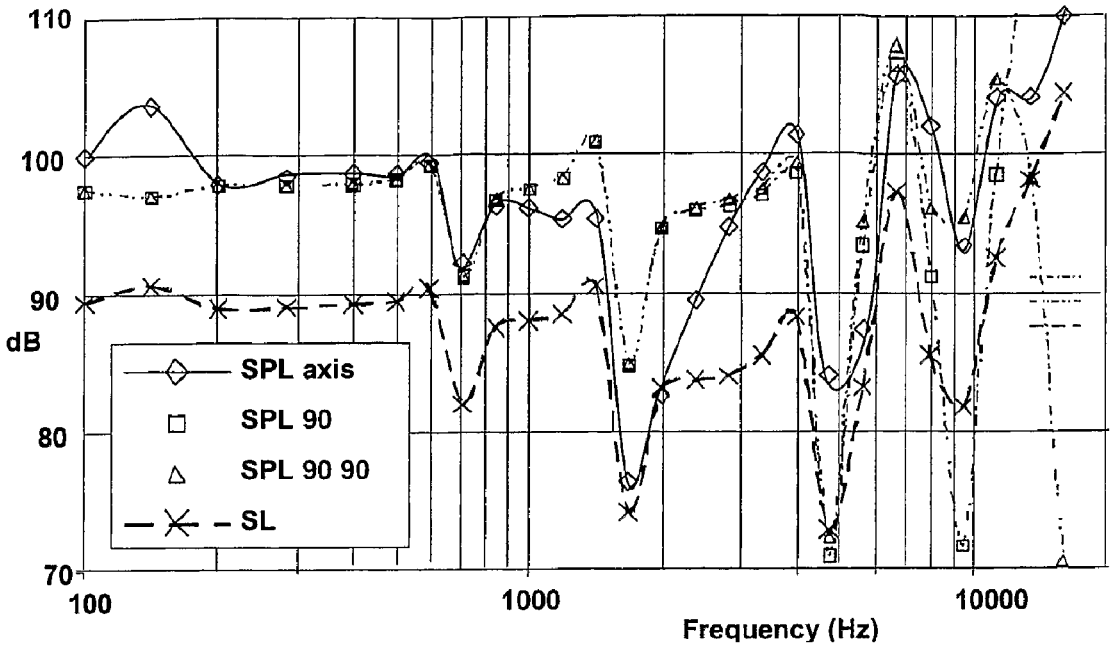

FIG. 42*b* shows the sound pressure and sound power levels for a practical loudspeaker comprising the free, wedge-shaped panel driven by a transducer with a voice coil having a 25 mm diameter and a finite mass which is dependent upon the design of the voice coil (materials, turns, etc.) The sound pressure and sound power has been significantly impaired compared to that shown in FIG. 42*a*.

Figure 42C:
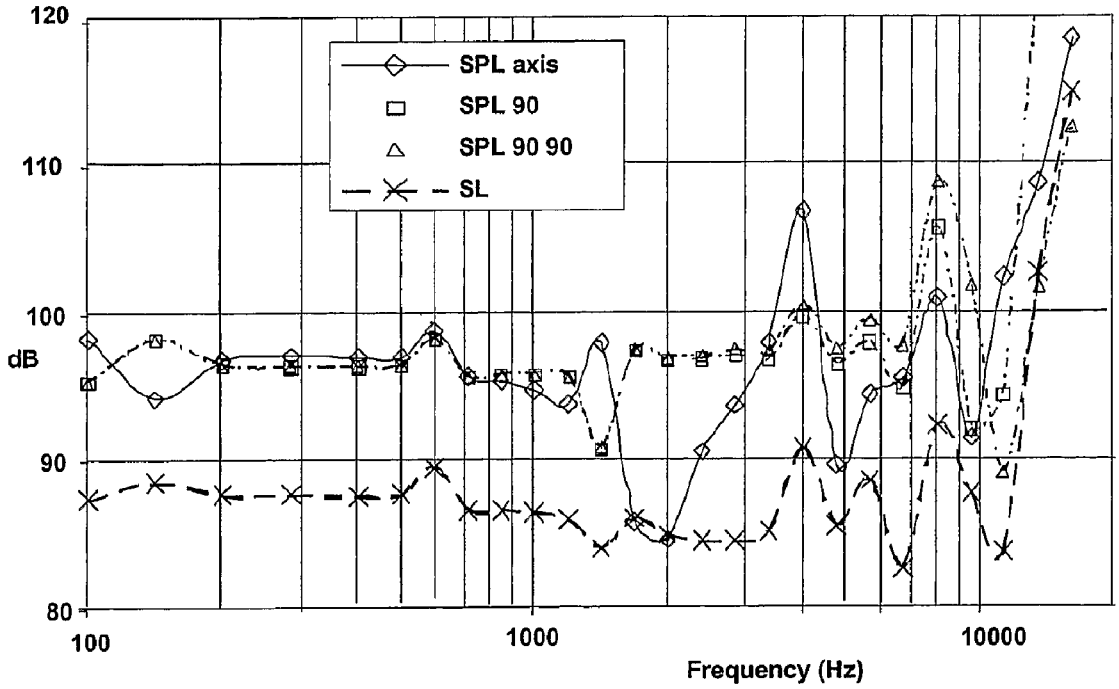

FIG. 42*c* shows the sound pressure and sound power levels for a practical loudspeaker similar to that of FIG. 42*b* but which has been mapped to the ideal shown in FIG. 42*a*. Thus the balancing masses have been applied as taught in FIG. 40. There is improvement in performance compared to that in FIG. 42*b*. Furthermore, since this sound pressure is simulated at 200 mm rather than far-field, the device may be better than FIG. 42*c* shows.

In each of FIGS. 42*a* to 42*c*, the sound pressure level (re 20.4 uPa) is simulated at 200 mm and the sound power level (re 1 W) with an input=1N. The measurements are taken on-axis, at 90° off-axis along the long axis of the beam and at 90° off axis along the short axis of the beam.

Figure 43A:
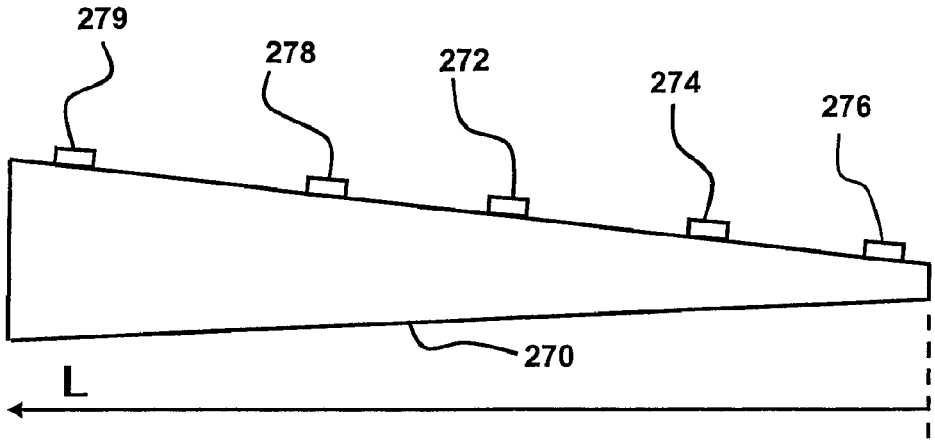
FIG. 43*a* is a plan view of an alternative embodiment of the invention.

FIG. 43*a* shows an alternate embodiment of the present invention in which the beam-shaped panel 270 has a thickness which varies with length and is not symmetrical. The overall length of the panel 270 is 153 mm and the thickness increases with a square root dependency from 2 mm at one end to 5 mm at the opposite end. The voice coils 274, 272 of each transducer are mounted at locations which are 0.23 and 0.43 away from the thinner end of the panel. Pairs of masses 276, 278, 279 are mounted at locations at 0.06, 0.66 and 0.88 of the distance from the thinner end of the panel. The masses mounted at 0.66 and 0.88 are equal in mass to the voice coils 272, 274 whereas the pairs of masses 280 at 0.06 have reduced mass. Thus for modelling purposes, the mounting locations are 9 mm, 35 mm, 66 mm, 101 mm and 134 mm. The voice-coils and inner two pairs masses are 550 mg each, and the outer masses are 400 mg.

Figure 43B:
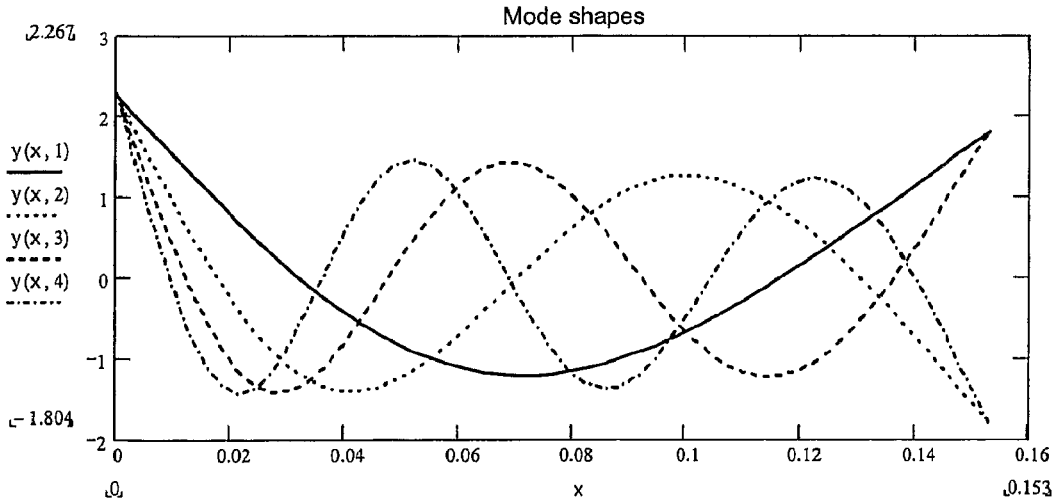
FIG. 43*b* is a graph of the first four mode shapes for the diaphragm of the embodiment of FIG. 43*a;*
Figure 43C:
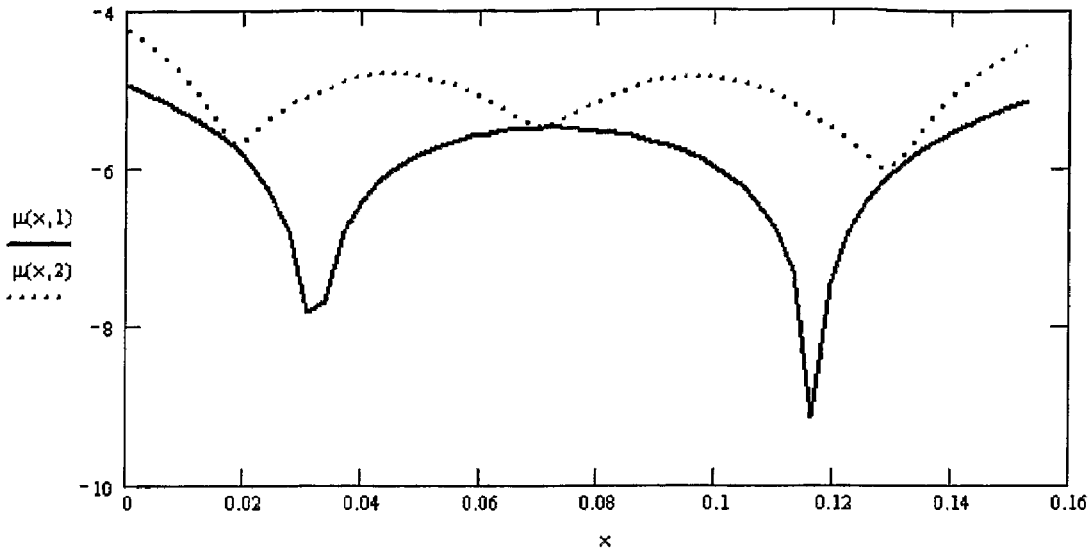
FIG. 43*c* is a graph showing the logarithmic mean admittance for both the first mode and the first two modes of the diaphragm of FIG. 43*a;*
Figure 43D:
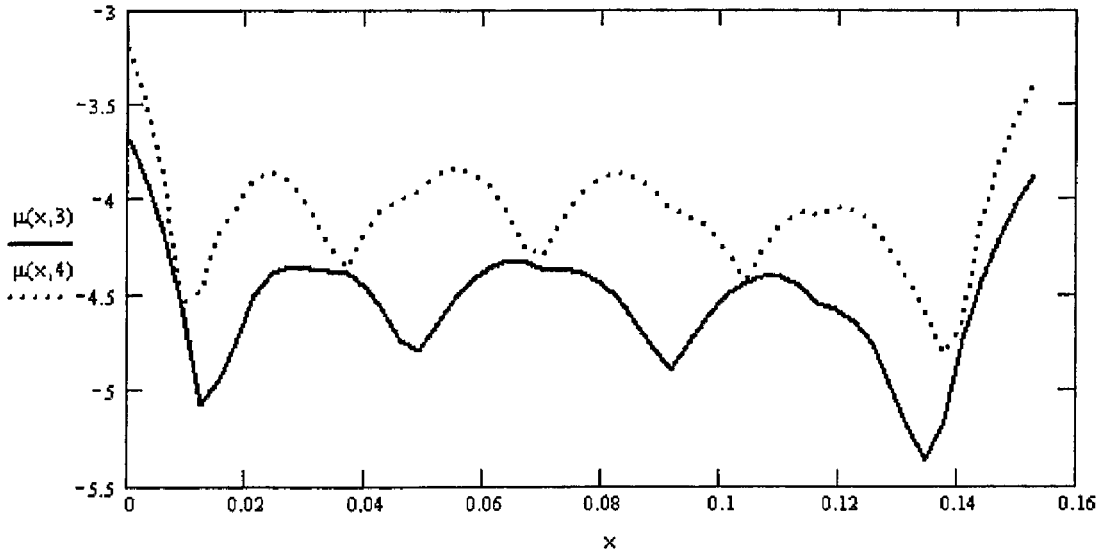
FIG. 43*d* is a graph showing the logarithmic admittance for both the first three modes and the first four modes of the diaphragm of FIG. 43*a;*

FIG. 43*b* shows the shape of the first four modes of the panel of the embodiment used in FIG. 43*a*. FIGS. 43*c* and 43*d* shows the logarithmic mean admittance of these first four modes (N=1 . . . 4) as it varies along the length of the panel (from the thinner end to the thicker end.) The minima are tabulated below:

| Number of modes considered | Position of minima (mm) | Relative position of Minima |
|---|---|---|
| 1 | 31, 111 | 0.21, 0.73 |
| 2 | 17.6, 67.3, 123 | 0.12, 0.44, 0.80 |
| 3 | 12.4, 46, 86, 128 | 0.08, 0.30, 0.56, 0.84 |
| 4 | 9.4, 35, 66, 101, 134 | 0.06, 0.23, 0.43, 0.66, 0.88 |

As described above in relation to FIGS. 9*a* to 9*e*, the method is flexible enough to allow a designer to map only particular modes. The locations calculated for the first our modes, correspond to the positions of the masses and voice coil in the device of FIG. 43*a*.

The table below shows the frequencies for the first five free-symmetric modes of the wedge of FIG. 43*a* for a minimum width t1 varying between 1 and 4.5 mm. The maximum width is unchanged at 5 mm. The panel material is a practical one, namely Rohacell™ foamed plastics.

| t1/ mm | Mode 1/ Hz | Mode 2/ Hz | Mode 3/ Hz | Mode 4/ Hz | Mode 5/ Hz |
|---|---|---|---|---|---|
| 4.5 | 1966 | 5420 | 10620 | 17560 | 26240 |
| 4 | 1860 | 5125 | 10040 | 16600 | 24800 |
| 3.5 | 1752 | 4821 | 9445 | 15610 | 23310 |
| 3 | 1640 | 4508 | 8825 | 14580 | 21770 |
| 2.5 | 1525 | 4182 | 8178 | 13500 | 20160 |
| 2 | 1406 | 3839 | 7495 | 12370 | 18450 |
| 1.5 | 1281 | 3474 | 6763 | 11140 | 16620 |
| 1 | 1146 | 3075 | 5955 | 9788 | 14580 |

The approximate locations of nodal lines for the first four modes are set out below.

| | First Mode | | Second Mode | | |
|---|---|---|---|---|---|
| t1/ mm | 1st Nodal Line | 2nd Nodal line | 1st Nodal Line | 2nd Nodal Line | 3rd Nodal line |
| 4.5 | 22 | 77 | 13 | 49 | 87 |
| 4 | 22 | 77 | 13 | 49 | 86 |

-continued

| | | | | | |
|---|---|---|---|---|---|
| 3.5 | 22 | 77 | 12.5 | 48 | 86 |
| 3 | 21.5 | 77 | 12 | 48 | 86 |
| 2.5 | 21 | 77 | 12 | 47 | 85.5 |
| 2 | 21 | 76 | 11.5 | 46 | 85 |
| 1.5 | 20.5 | 76 | 11 | 45 | 84.5 |
| 1 | 20 | 75.5 | 10 | 43 | 84 |

| | Third Mode | | | |
|---|---|---|---|---|
| t1/mm | 1st Nodal Line | 2nd Nodal Line | 3rd Nodal line | 4th Nodal Line |
| 4.5 | 9 | 35 | 64 | 90 |
| 4 | 9 | 34.5 | 63 | 90 |
| 3.5 | 9 | 34 | 63 | 90 |
| 3 | 9 | 33 | 62 | 90 |
| 2.5 | 8 | 32 | 61 | 89.5 |
| 2 | 8 | 31 | 60 | 89 |
| 1.5 | 7.5 | 30 | 59 | 89 |
| 1 | 7 | 28 | 57 | 88 |

| | Fourth Mode | | | | |
|---|---|---|---|---|---|
| t1/ mm | 1st Nodal Line | 2nd Nodal Line | 3rd Nodal line | 4th Nodal Line | 5th Nodal Line |
| 4.5 | 7 | 27 | 49 | 72 | 95 |
| 4 | 7 | 27 | 49 | 71.5 | 92 |
| 3.5 | 7 | 26 | 48 | 71 | 92 |
| 3 | 6.5 | 25.5 | 47 | 70 | 92 |
| 2.5 | 6.5 | 24.5 | 46 | 69 | 92 |
| 2 | 6 | 24 | 45 | 68 | 91.5 |
| 1.5 | 6 | 22.5 | 43.5 | 67 | 91 |
| 1 | 5 | 21 | 41 | 65 | 90.5 |

Comparing the results with those from FIGS. 43*c* and 43*d*, for t1=2, the locations of nodal lines for the second mode are at 0.115, 0.46 and 0.85 and the average nodal locations for two modes are at 0.12, 0.44 and 0.80. The locations of nodal lines for the third mode are at 0.08, 0.31, 0.60 and 0.89 and the average nodal locations for three modes are at 0.08, 0.30, 0.56 and 0.84. Accordingly, as indicated above the average nodal location is close to the nodal line of the highest mode which is being considered. Both sets of ratios are likely to produce the desired effect of net mean displacement tending to zero.

Figure 44A:
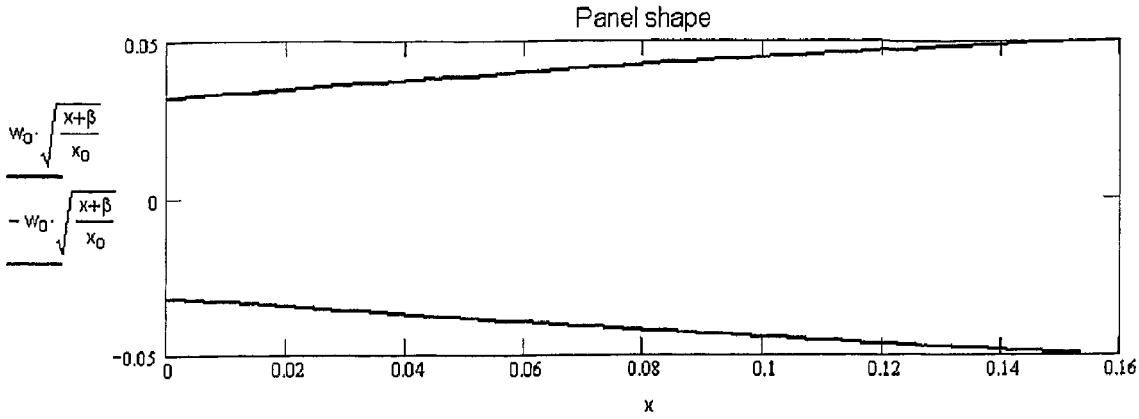
FIG. 44*a* is a plan view of an alternative embodiment of the invention.

FIG. 43*a* shows a beam varying in thickness linearly with length x. If we consider a narrow slice of the beam, taken across the width at x, then we have another, conceptual beam of uniform properties. As shown in FIG. 44*a*, the width of the beam varies linearly with x. The modal frequencies are compared below:

| Case | F0 | F1 | F2 | F3 | F4 | F5 | F6 |
|---|---|---|---|---|---|---|---|
| Varying thickness | 0.0 | 149.062 | 407.023 | 794.660 | 1311.093 | 1956.505 | 2730.926 |
| Varying width | 0.0 | 150.789 | 409.324 | 797.187 | 1313.754 | 1959.251 | 2733.731 |

Figure 44B:
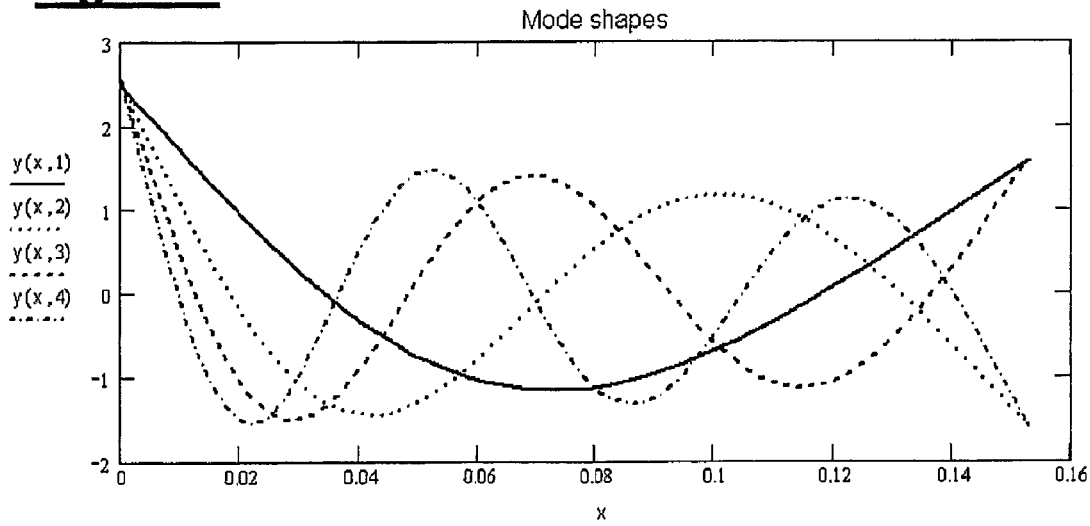
FIG. 44*b* is a graph of the first four mode shapes for the diaphragm of the embodiment of FIG. 44*a;*

The mode shapes of the varying width beam are shown in FIG. 44*b*. It can be seen that the mode-shapes and mode frequencies for the two embodiments are actually very similar. This may be taken to indicate that, for a practical implementation, there is some available tolerance in the solution sets, allowing for some "artistic freedom" in the interpretation of the design rules. It also allows a designer to set the "conceptual" cross-mode to a constant frequency. As this is proportional to $1/\text{width}^2 \times \sqrt{(B/\mu)}$ where B varies as $x^{P+2}$, a panel where the width varies with the square root of length satisfies this criterion.

The mean volume velocity Vn for each mode is set out below, where V0 is the mean volume velocity for the "piston" mode.

| Case | V0 | V1 | V2 | V3 | V4 | V5 |
|---|---|---|---|---|---|---|
| Varying thickness | 1.0 | 5.587e−11 | 1.432e−14 | 1.556e−13 | −1.178e−14 | −2.159e−13 |
| Varying width | 1.0 | 2.513e−9 | −1.106e−9 | −1.215e−8 | 7.438e−11 | 5.777e−13 |

In both cases, the mean volume velocity of all the bending modes is zero (within the tolerance of the calculation), so both embodiments may be used as a theoretical ideal to which the unbalanced modes of a practical acoustic device may be mapped.

Figure 45:
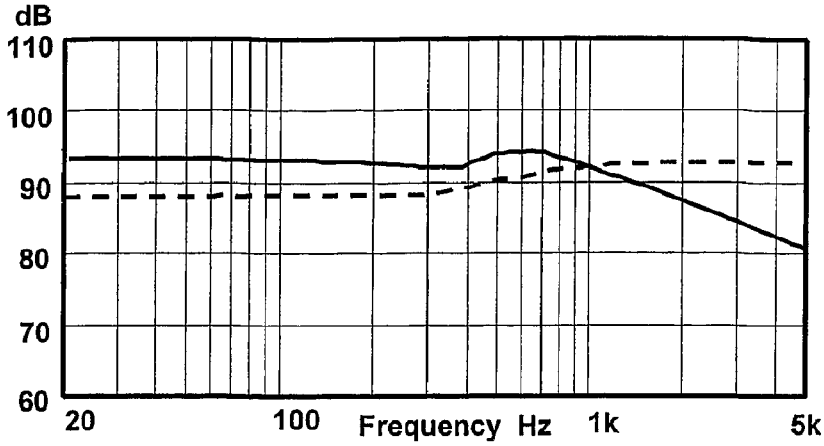
FIGS. 45, 46 and 47 are graphs showing the variation of on-axis sound pressure and half-space power with frequency for a rectangular pistonic speaker, a theoretical resonant panel-form speaker and a practical resonant panel-form speaker respectively.
Figure 46:
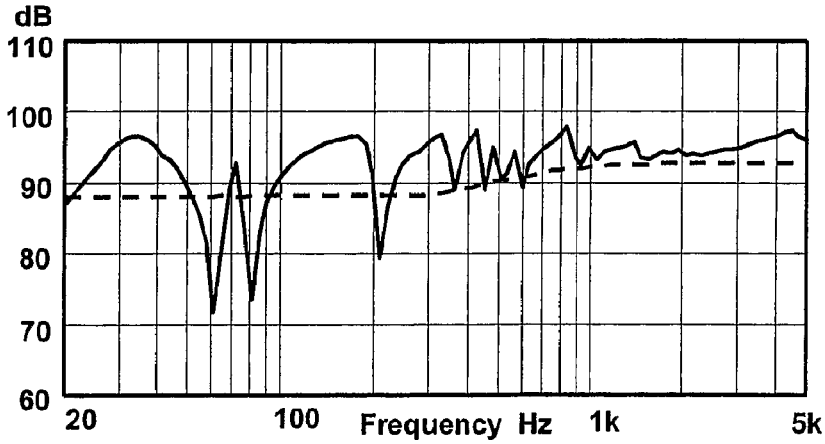

FIG. 45 shows the sound pressure and sound power levels for a theoretical loudspeaker comprising a free rectangular piston driven by a mass-less point force applied at its centre. The sound pressure is constant with frequency while the sound power is constant until approximately k times L and thereafter it falls away gradually with increasing frequency. FIG. 46 shows the sound pressure levels for a loudspeaker comprising a free, rectangular panel driven by a mass-less point force applied at the panel centre (dashed line). The solid line shows the same panel now driven by a practical 25 mm diameter motor having a finite mass which is dependent upon the design of the voice coil (materials, turns, etc.).

Figure 47:
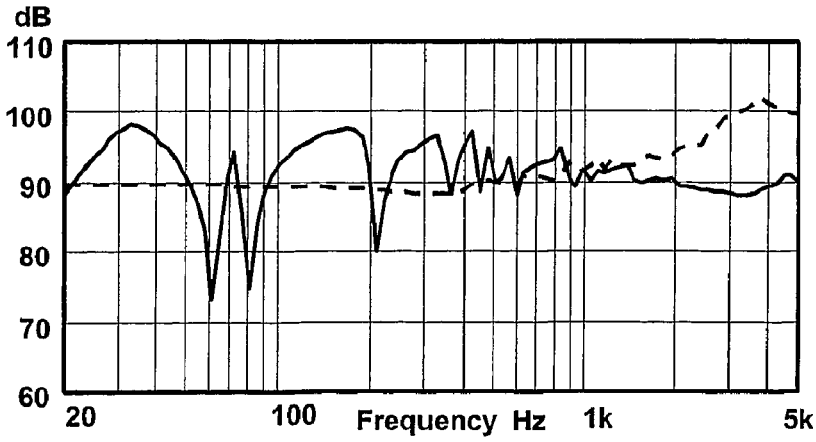

FIG. 47 shows the sound power levels corresponding to the pressure levels of FIG. 46. The fall-off in sound power with frequency is significantly improved compared to that in FIG. 45. However, in the practical case, both the on-axis pressure and sound power are no longer constant with frequency. (Note that at higher frequencies the modal density increases and thus the performance may benefit from distributed mode teaching for modal interleaving and for optimal drive point coupling).

Figure 48A:
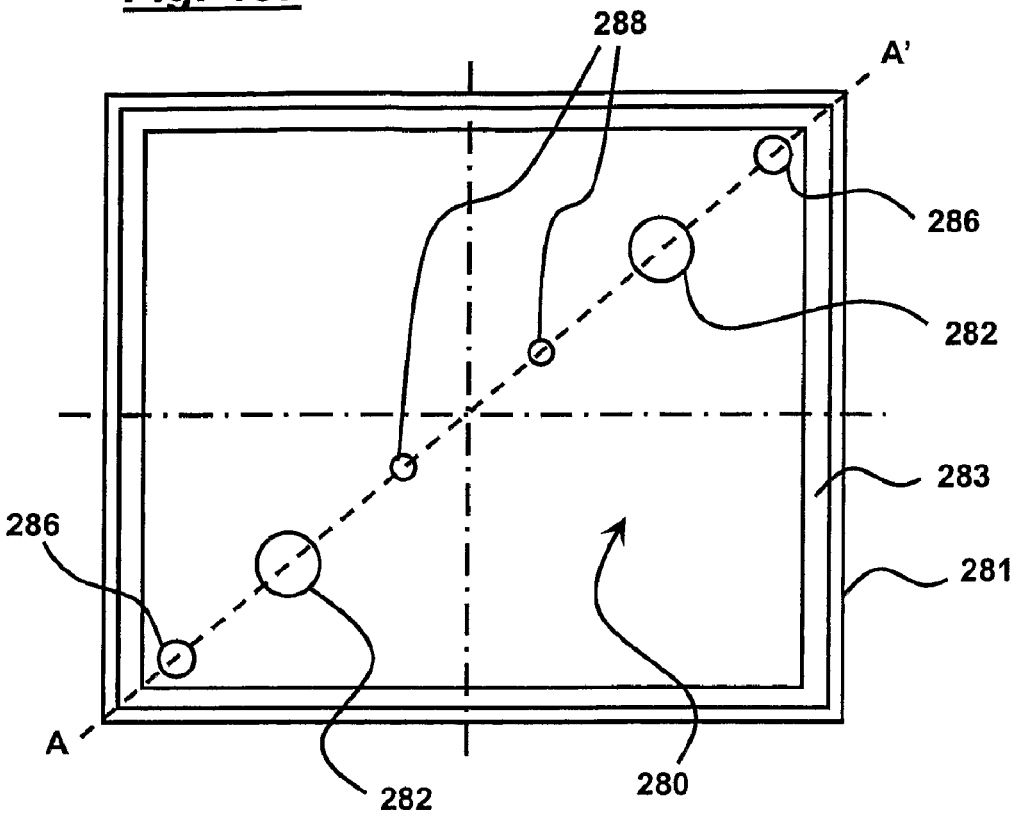
FIGS. 48*a* and 48*b* are plan and side views of another embodiment of the present invention.
Figure 48B:
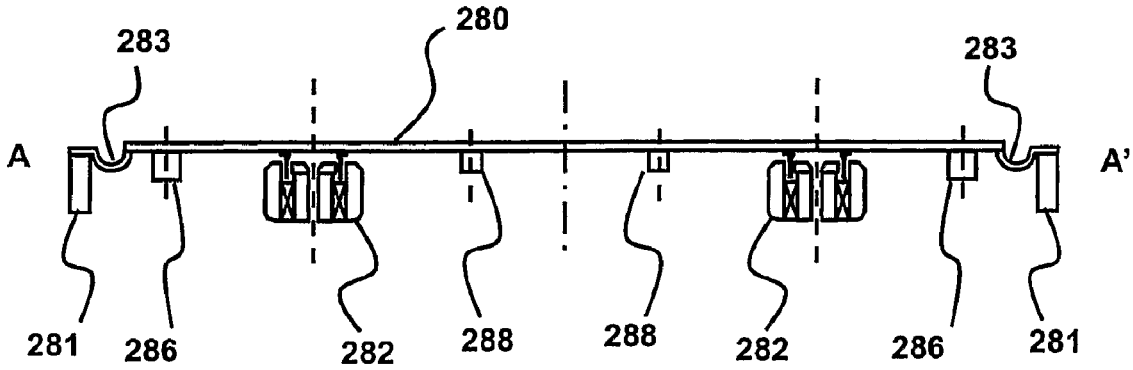

FIGS. 48*a* and 48*b* show a loudspeaker comprising a diaphragm in the form of a rectangular panel 280 and two transducers 282 mounted thereto. The panel is made from skinned, cored lightweight composite material. Two pairs of masses 288, 286 are mounted at locations at 19% and 88% of the distance from the centre to one corner of the panel (i.e. over the half-diagonal of the panel). The voice coil of each transducer 282 is mounted at a location which is 55% away from the centre of the panel along the half-diagonal. The panel is mounted to a chassis 281 by a suspension 283 and sealed in a baffle (not shown).

The locations of the transducers and masses are calculated in a similar manner to the earlier embodiments. The mode shapes for the X-axis and Y-axis are considered separately and may be computed from the bending stiffness and the surface area mass of the panel. The average nodal positions are calculated from the minima in impedance. In the embodiment shown, the locations of the masses and transducers are average nodal positions for both axes when the first three modes for each are considered. There are additional effective locations along the diagonal if four modes are addressed. For a panel of 460 mm by 390 mm, the (x,y) locations of each of the masses and transducers are given as follows:

| Component | First (x, y) location | Second (x, y) location |
|---|---|---|
| 1.38 g masses | 186 mm, 158 mm) | (274 mm, 232 mm) |
| 6.4 g masses | (28 mm, 23 mm) | (432 mm, 367 mm) |
| Transducers | (104 mm, 88 mm) | (356 mm, 302 mm) |

The voice coils each have a mass of 4 g and the value of the masses is scaled to that of the voice coil as follows:

| Half-diagonal ratios | relative ratios | Relative mass | actual mass (gm) |
|---|---|---|---|
| 0.88 | 1.35 | 1.35 | 6.40 |
| 0.55 | 1.00 | 1.00 | 4.00 |
| 0.19 | 0.35 | 0.35 | 1.38 |

The coil masses are not summed when obtaining the values for the balancing masses because each transducer relates only to the axis which it drives.

Figure 49:
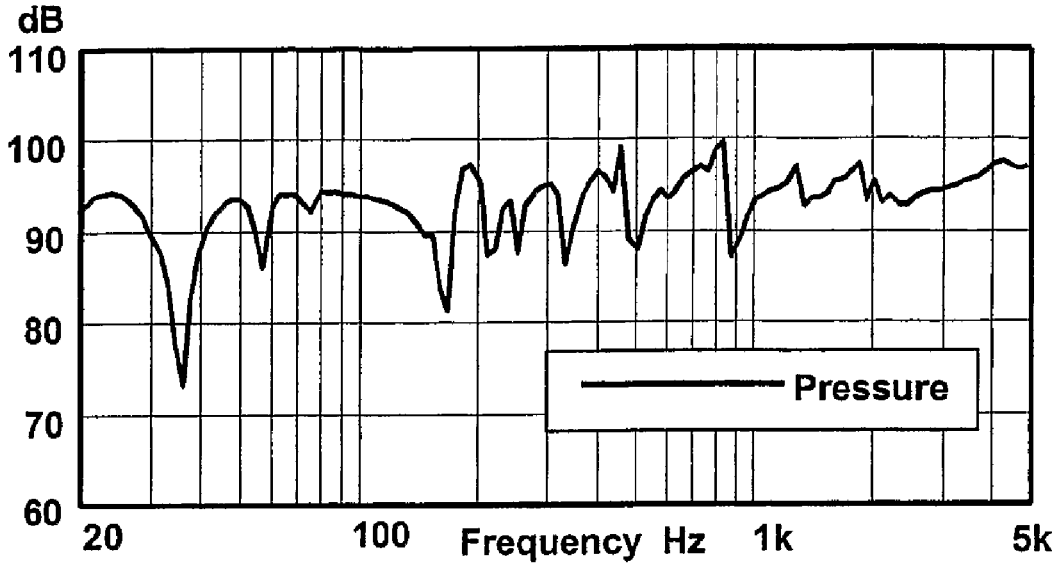
FIGS. 49 and 50 are graphs showing the variation of on-axis sound pressure and half-space power with frequency respectively for the embodiment of FIG. 48*a;*
Figure 50:
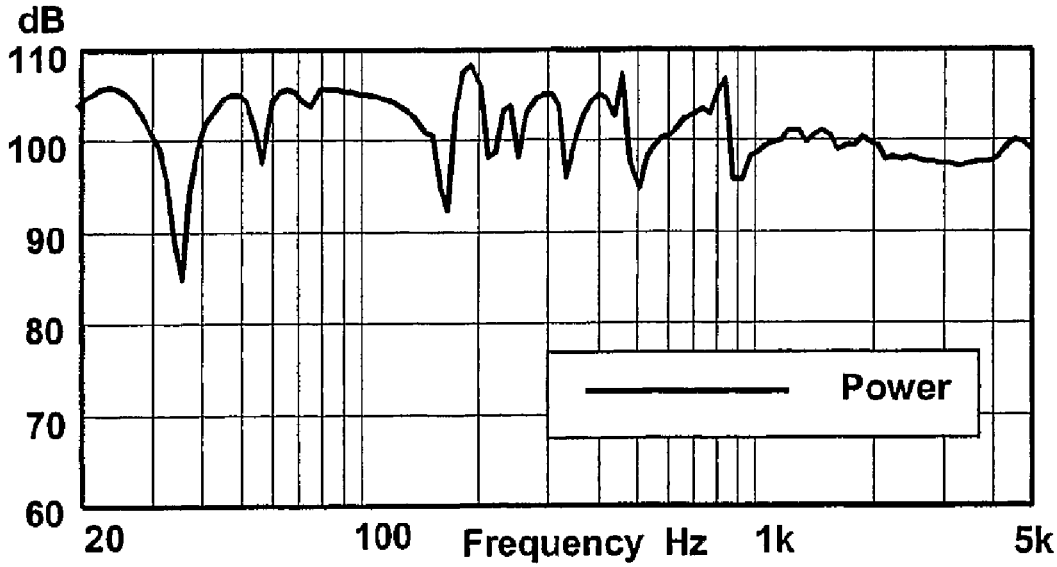
Figure 51A:
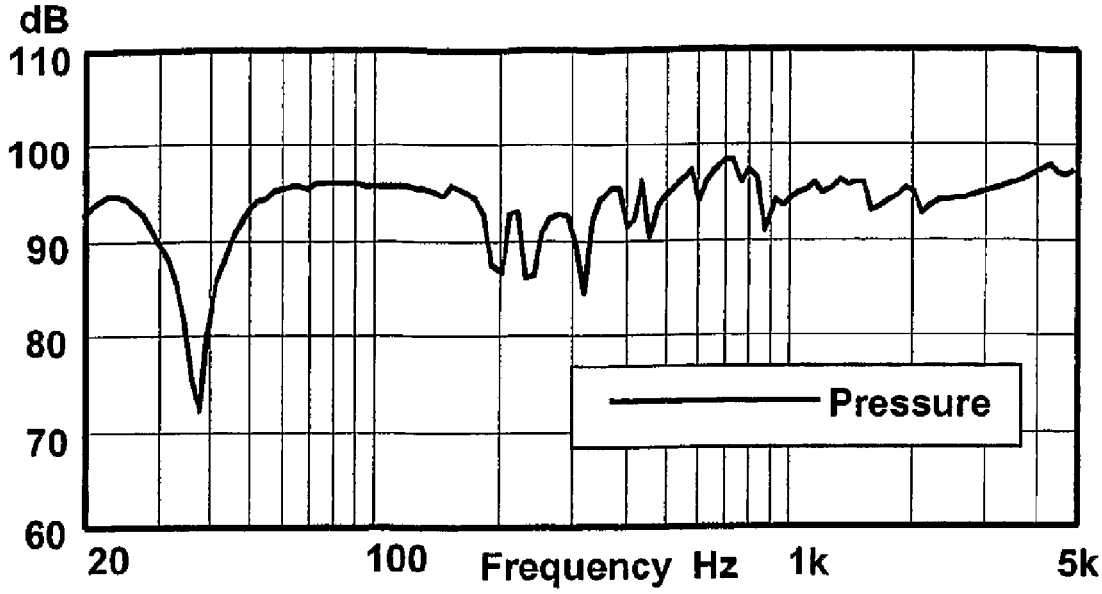
FIGS. 51*a* and 51*b* are graphs showing the variation of on-axis sound pressure and half-space power with frequency for a variation on the embodiment of FIG. 48*a;*
Figure 51B:
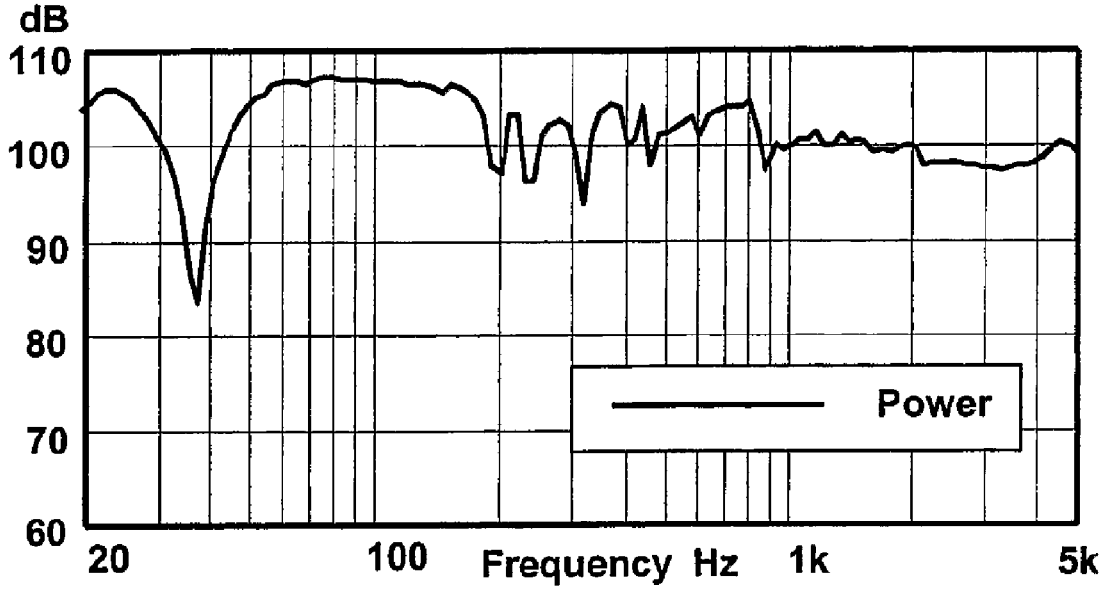

FIGS. 49 and 50 show the sound pressure and sound power levels for the loudspeaker of FIG. 48*a*. There is a substantial improvement in low frequency uniformity down to 40 Hz when compared with the loudspeaker of FIG. 47 which has no balancing masses. The response may be further smoothed by applying damping for the low frequency modes, e.g. via the suspension properties. The masses may also be fine tuned by varying the location coordinates by up to ±5% (or even ±8%). The fine tuning may optimise particular aspects of the acoustic output in the low frequency range.

Where an outer suspension has significant mass there is an opportunity for the designer to distribute this mass by choice of surround material noting that it is distributed near the panel perimeter. The advantage is some additional control via damping and loading of higher order, e.g. 2 D coupled modes which are not susceptible to the single axis modal balancing technique FIGS. 51*a* and 51*b* show the sound pressure and sound power levels for a variation of the loudspeaker of FIG. 48*a*. The outer masses are no longer discrete, having been replaced by distributing their total mass uniformly in the suspension. The values of the inner masses are small enough for them to be omitted completely with little effect The table below shows the modes for the rectangular panel of FIG. 48*a*; the first mode is at 72.3 Hz:

| | 0 | 1 | 2 | 3 | 4 | 5 | 6 |
|---|---|---|---|---|---|---|---|
| 0 | 0 | 0 | 72.3 | 199.3 | 390.8 | 646.0 | 965.1 |
| 1 | 0 | 47.7 | 120.9 | 245.8 | 433.8 | 686.9 | 1003.8 |
| 2 | 91.7 | 133.5 | 228.9 | 365.3 | 554.5 | 805.4 | 1120.1 |
| 3 | 252.9 | 290.9 | 393.0 | 539.9 | 734.0 | 985.9 | 1299.5 |
| 4 | 495.8 | 530.3 | 630.3 | 779.5 | 975.3 | 1226.8 | 1538.4 |
| 5 | 819.5 | 851.9 | 948.6 | 1096.4 | 1290.8 | 1540.0 | 1848.0 |
| 6 | 1224.2 | 1255.0 | 1348.7 | 1493.9 | 1685.5 | 1930.9 | 2233.9 |

Moderate modal density appears above 250 Hz where the chosen panel parameters such as aspect ratio additionally confer distributed mode operation at these higher frequencies. If this type of embodiment is not required to be full range then the modal balancing alone is sufficient to provide an extended, piston equivalent performance in the lower frequency range from a resonant panel diaphragm.

If the diaphragm is also required to have useful modal behaviour at higher frequencies, e.g. Distributed Mode, then in a further improvement, the available options for the balancing drive positions may also be iterated with respect to the preferred drive points for good modal coupling at higher frequencies. The latter teaching indicates a preference for off-centre and also for off-cross-axis locations. Such combination locations may be found by inspecting an analysis of the modal distribution with frequency over the area of the panel.

If more output is required from the speaker four exciters could be used, exploiting the second diagonal, and now working with eight masses. Typically all the exciters would be wired for an in-phase connection to the signal source.

Figure 52A:
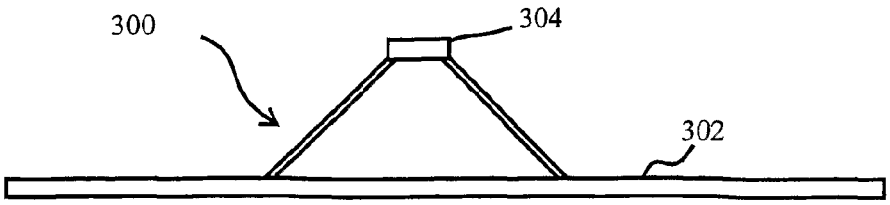
FIGS. 52*a* and 52*b* are cross-sectional and rear views of a loudspeaker comprising a coupler.
Figure 52B:
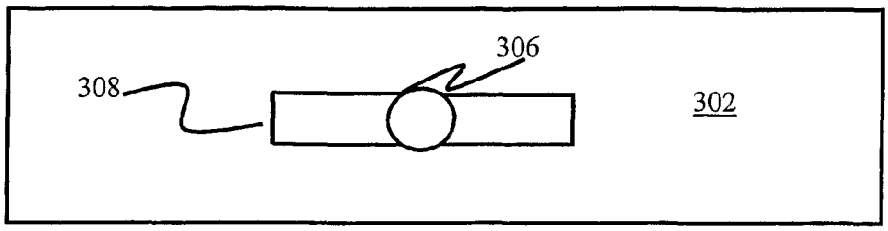

FIGS. 52*a* and 52*b* show a coupler 300 disposed between a beam-like panel diaphragm 302 and a transducer voice coil 304. The magnet assembly of the transducer has been omitted for clarity. As shown in FIG. 52*b*, the coupler is profiled to be of one size 306, namely a circular shape, where it couples to the transducer voice coil and a second size 308, namely a rectangular shape, where it couples to the diaphragm. The rectangular shape is of significantly larger size than the circular shape so that a small voice coil assembly is adapted to a larger drive. Furthermore, the coupler is matching an inappropriate voice coil diameter to correct drive points. In this way, a standard size transducer which may be of moderate cost is adapted to the invention.

Figure 53A:
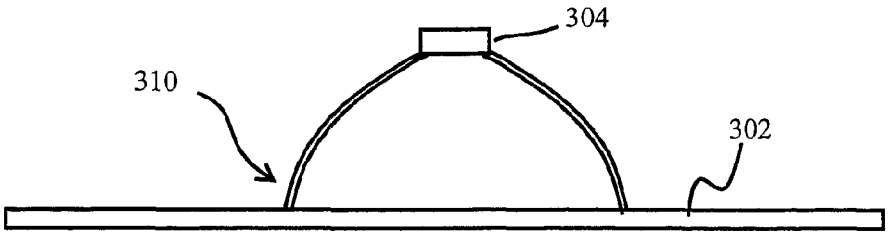
FIGS. 53*a* and 53*b* are cross-sectional and rear views of a loudspeaker comprising a second embodiment of a coupler.
Figure 53B:
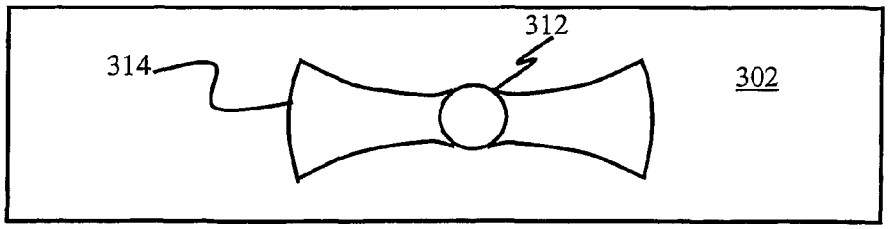

FIGS. 53*a* and 53*b* show a coupler 310 disposed between a beam-like panel diaphragm 302 and a transducer voice coil 304. The magnet assembly of the transducer has been omitted for clarity. As shown in FIG. 53*b*, the coupler is profiled to be of one size 312, namely a circular shape, where it couples to the transducer voice coil and a second size 314, namely a bow-tie shape, where it couples to the diaphragm. The bow-tie shape is of significantly larger size than the circular shape so that a small voice coil assembly is adapted to a larger drive. Furthermore, the coupler is matching an inappropriate voice coil diameter to correct drive points.

In both FIGS. 52*a* and 53*a*, the couplers are hollow shells which may be of 0.5 mm thick cone paper. Depending on the ratio of first to second sizes, allowable coupler mass, and cost, stronger shell constructions for the coupler are possible such as carbon fibre reinforced resin, and crystal orientated moulded thermoplastic such as Vectra.

Figure 54:
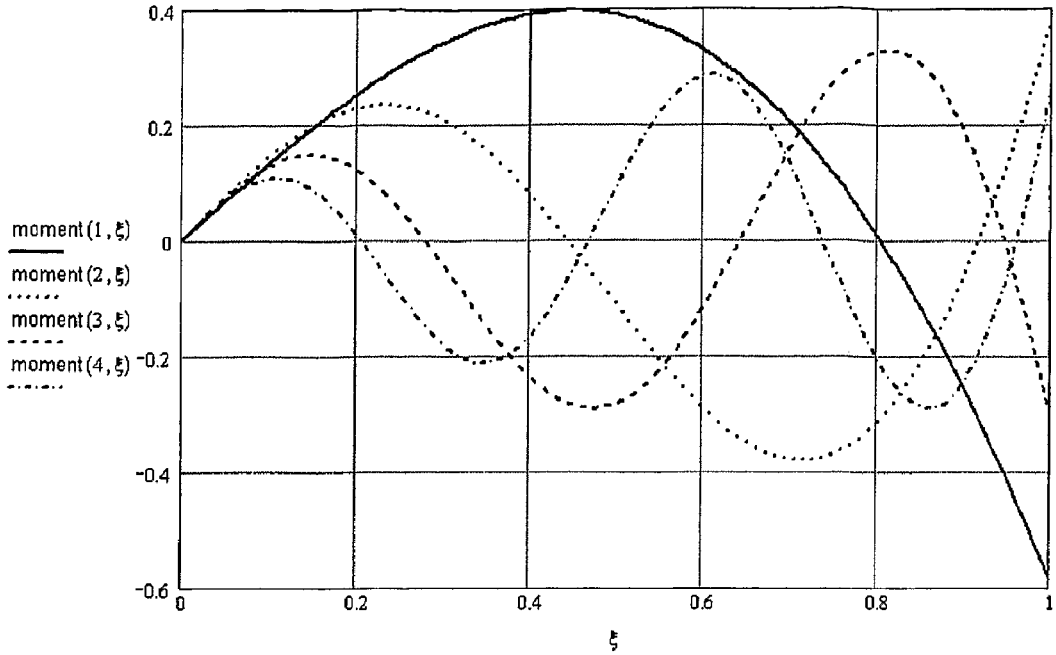
FIG. 54 is a graph of F the effective net force of a transducer voice coil against ρ the radius of the voice coil.

FIG. 54 is a graph of F the effective net force of a transducer voice coil against ρ the radius of the voice coil. F is calculated by integrating around the coil circumference the force weighted by the displacement of the mode-shape, or explicitly for a coil radius of ρ, $$F(n,\rho)=\oint y(n,\xi)ds=\int_0^{\rho} y\left(n,\sqrt{\rho^2-\xi^2}\right)\frac{\rho}{\sqrt{\rho^2-\xi^2}}\,d\xi$$

where y(n,ξ) is the mode shape for the nth mode.

In order to avoid exciting a particular mode, the corresponding average net force should vanish. In other words, we want the zero-crossings of the functions F(n, ρ), i.e. effectively driving at a nodal line. The results are tabulated for up to four modes, together with the nodal line nearest the origin. From these results, it suggests that the actual diameter of the voice coil is about 1½ times the effective drive diameter of the voice coil.

| Mode number | Nodal line | Zero of F(n) | Ratio |
|---|---|---|---|
| 1 | 0.552 | 0.803 | 1.455 |
| 2 | 0.288 | 0.444 | 1.539 |
| 3 | 0.182 | 0.278 | 1.531 |
| 4 | 0.133 | 0.204 | 1.531 |

Furthermore, it is noted that F(1) has a zero crossing at about 0.8. Mounting a voice coil having a diameter in the ratio of 0.8 to the width of the panel will thus suppress the lowest cross-mode.

Figure 55A:
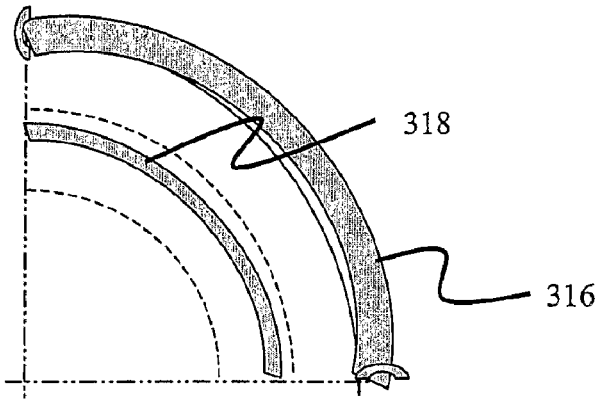
FIGS. 55*a* and 55*b* are plan views of a quarter of a circular and beam-like diaphragm, respectively.
Figure 55B:
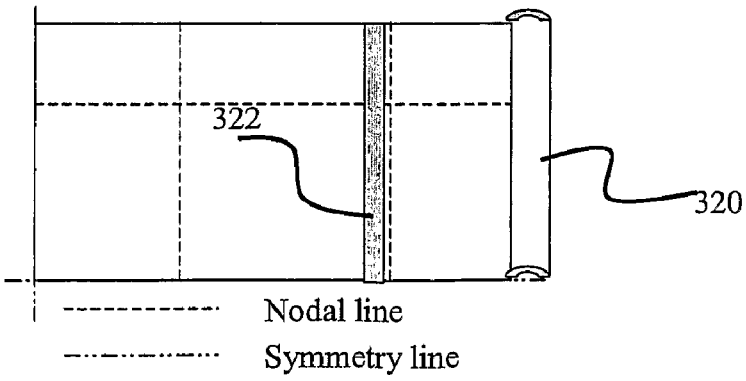

The teaching above suggests mounting the suspension away from the periphery of the diaphragm. FIGS. 55*a* and 55*b* show more practical embodiments in which a suspension 316,320 in the form of a roll surround is mounted at the edge of the diaphragm. An additional suspension balancing mass 318,322 is mounted near the nodal line so that the combined effect of the edge suspension and suspension balancing mass is equivalent to a suspension mounted inboard of the panel periphery.

FIG. 55*c* shows a cross-section of the quarter diaphragm in which M1 is the mass mounted near the nodal line, Ms is the mass of the glue-zone of the suspension, Md is the mass of the active part of the suspension, ξ0 and ξ1 are the distances from the centre of the diaphragm to the nodal line and mass near the nodal line, respectively and 1−ξ2 is the width of the glue-zone. There are three basic ways of ensuring that the suspension balancing mass and edge suspension are equivalent to the inboard suspension.

The simplest is when the mass of the glue zone is considered lumped with the mass of the suspension's active part. For the beam this means solving:

$$F(n,\xi_1)=M1y(n,\xi_1)+(Md+Ms)y(n,1)=0$$

Where y(n, ξ1) is the mode shape.

For example, starting from a transducer having a voice coil of diameter 32 mm and mass 1.5 g, the diaphragm has a width of 40 mm and 156.8 mm. The width is selected so the voice coil diameter is 80% thereof and the length so that the effective net force for the fourth mode is zero, i.e. F(4)=0.

The nodal lines of mode 4 are tabulated below, along with the corresponding locations and masses from the text-book.

| Line number | "radius" | Position 1 | Position 2 | Mass |
|---|---|---|---|---|
| 1 (i.e. the "coil") | 0.133 | 67.9 mm | 88.8 mm | 750 mg |
| 2 | 0.400 | 47.0 mm | 109.7 mm | 750 mg |
| 3 | 0.668 | 26.0 mm | 130.7 mm | 750 mg |
| 4 | 0.912 | 6.9 mm | 149.9 mm | 600 mg |

The suspension has the following properties:

Ms+Md=1.8 g/m×40 mm-=72 mg.

Ks (stiffness)=443.5 N/m/m

Rs (damping)=0.063 Ns/m/m

Width (1-2).L/2=4.0 mm, giving 42=0.949

Accordingly, M1=M−Md−Ms=528 mg. Using the lumped approximation above gives ξ1=0.897, i.e. the location of the suspension balancing mass is at 8.1 mm and 148.7 mm measured from one end of the diaphragm. Without the lumped simplification, the locations are calculated to be 7.9 mm and 148.9 mm (i.e. very similar). In both cases, the attachment points are at least 1 mm further from the edge of the diaphragm than the nodal line.

Figure 56C:
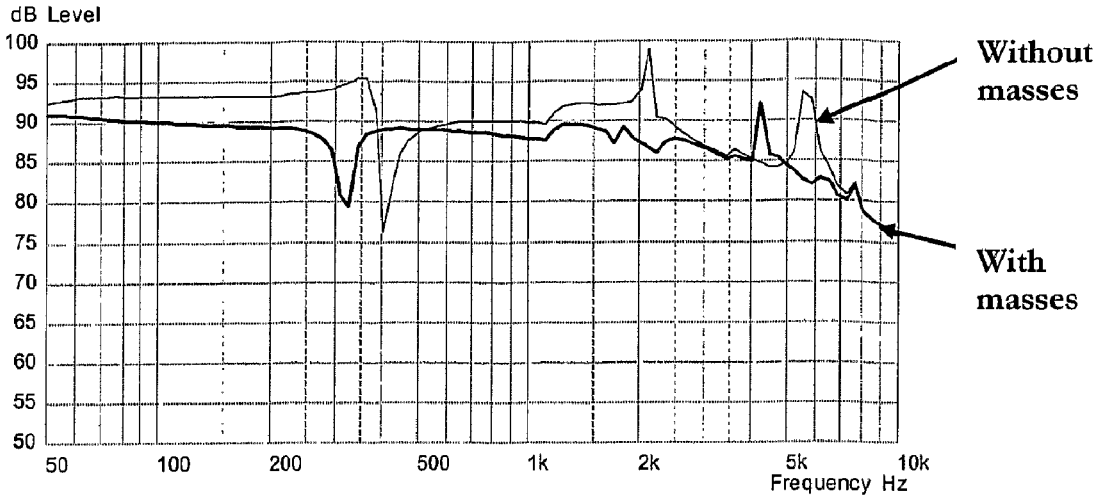
FIG. 56*c* shows the variation of half-space power with frequency for a loudspeaker without and with suspension balancing masses.

FIGS. 56*a* and 56*b* shows the loudspeaker response without and with the suspension balancing masses, respectively. FIG. 56*c* compares the power responses without and with the suspension balancing masses. In both measurements, the improvement of the loudspeaker is significantly improved by using a suspension balancing mass.

The equation for a circular diaphragm is $$F(n, \xi_1) = \frac{1}{\xi} M1\, y(n, \xi_1) + (Md + Ms) y(n, 1) = 0$$

This may be solved either by preserving the total mass or the total mass per unit length. If ξ0 (i.e. location of nodal line) is 0.919 for the fourth mode, preserving the total mass gives ξ1=0.8947 and M1=3.4. Preserving the total mass per unit length gives a similar result, namely ξ1=0.8946 and M1=3.387.

It is also possible to incorporate the suspension balancing mass as part of the suspension by ensuring that the suspension balancing mass butts up to the glue zone. The equations are now more complicated, for example for the beam diaphragm:

$$F(n,\xi_1)=M1(\xi_1)y(n,\xi_1)+\mu l(yi(n,1)-yi(n,\xi_1))+Md\, y(n, 1)=0$$

where μl is the mass-per-unit-length of the glue zone region, and M is the required total mass.

Figure 57A:
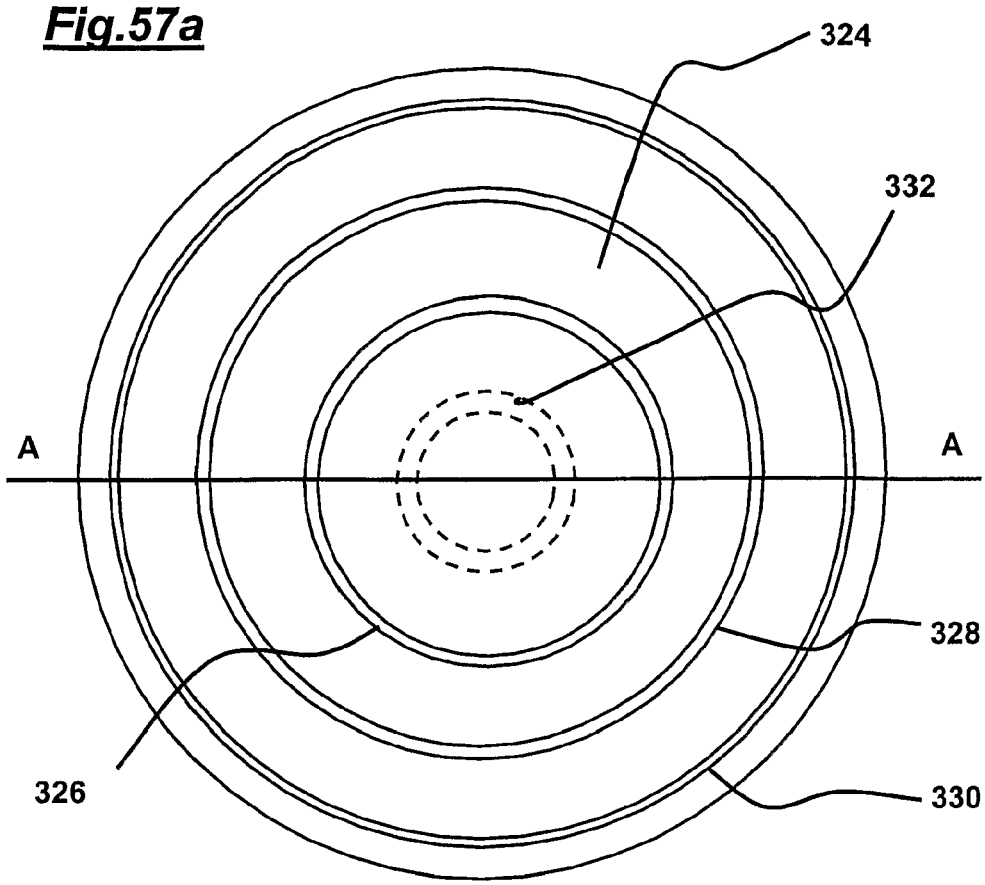
FIG. 57*a* is a plan view of another embodiment of the present invention.
Figure 57B:
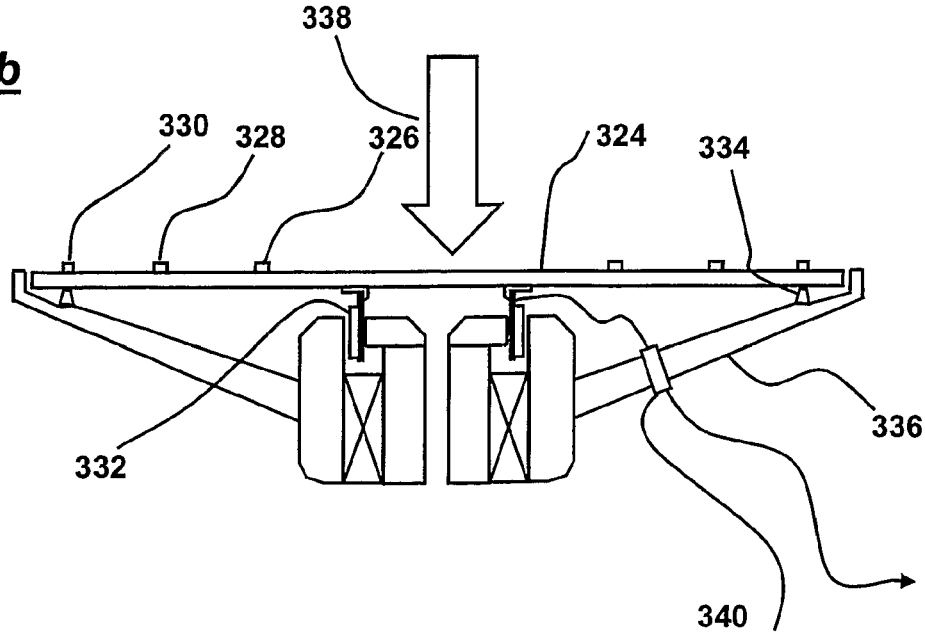
FIG. 57*b* is a cross-sectional view along line AA of FIG. 77*a;*

FIGS. 57*a* and 57*b* show a microphone which is generally similar to the loudspeaker of FIGS. 1*a* and 1*b*. The microphone comprises a diaphragm in the form of a circular panel 324 and a transducer having a voice coil 332 concentrically mounted to the panel 324 at the 0.2 ratio. Three ring-shaped (or annular) masses 326,330,332 are concentrically mounted to the panel 324 at the ratios 0.44, 0.69 and 0.91. The panel and transducer are supported in a circular chassis 336 which is attached to the panel 324 by a circular suspension 334. The suspension 334 is attached at the 0.91 ratio. The transducer is grounded to the chassis 336.

Incident acoustic energy 338 causes the panel to vibrate and the vibration is detected by the transducer and converted into an electrical signal. The signal is outputted via wires and a microphone output connection 340.

Figure 58:
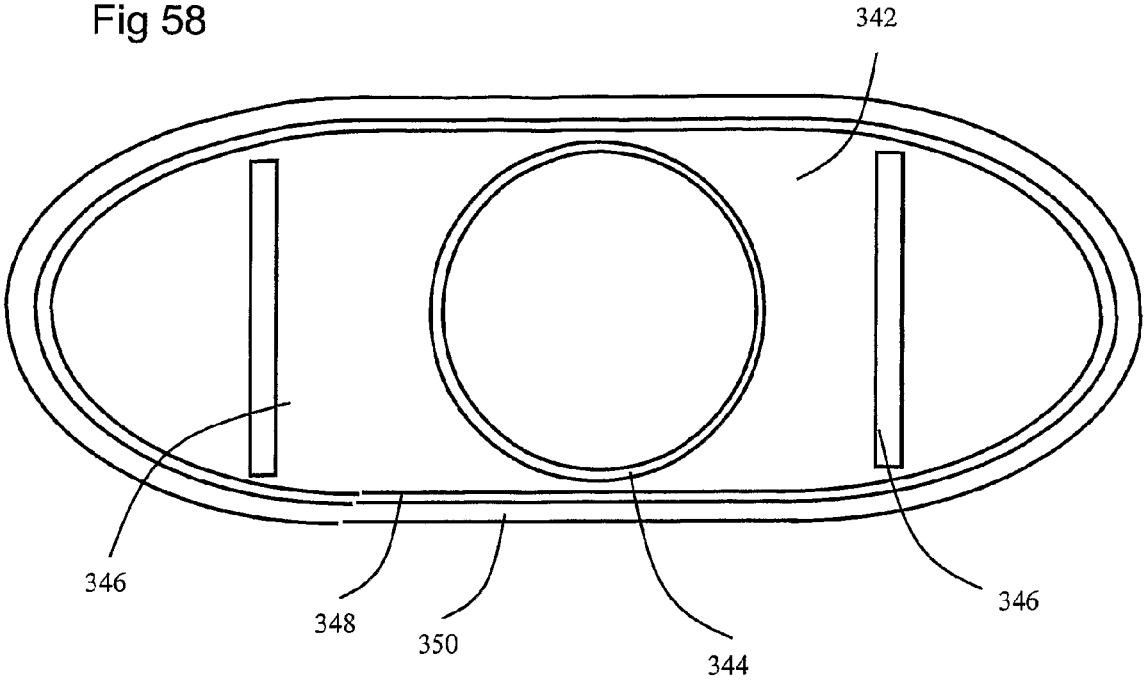
FIG. 58 is a plan view of another embodiment of the invention.

FIG. 58 shows a rectangular panel 342 with rounded corners so that the panel has non-constant width. The panel is 100 mm long by 36 mm wide, 3.2 mm thick and made of an economical resin bonded paper composite, e.g. Honipan HHM-PGP. A transducer having a voice coil of diameter 25 mm is mounted to the panel with a lightweight coupling ring 344 of 28 mm. The transducer is thus effectively driving two opposed locations (or drive lines across the panel width) which are 13 mm from the centre, i.e. at a ratio of 0.26. Mechanical impedance means in the form of strip masses 346 are located at opposed positions 41.5 mm from the centre, i.e. at a ratio of 0.83. There are two modes in the operating frequency range which are addressed by the location of the transducer and the mechanical impedance means.

The voice coil has a mass of 1 g but driving at separate locations means that the effective mass at each location is halved. The masses 346 are strips of plain rubber having a mass which balances the effective mass of the voice coil at each location, i.e. 0.5 g.

The panel is supported in a moulded plastics frame 350 by a suspension 348 of low mechanical impedance whereby the panel is essentially free to resonate. Such a speaker is suitable for higher quality flat panel TV and monitor applications and has a nominal 100 Hz to 20 kHz bandwidth with uniform frequency and good power response.

Figure 59:
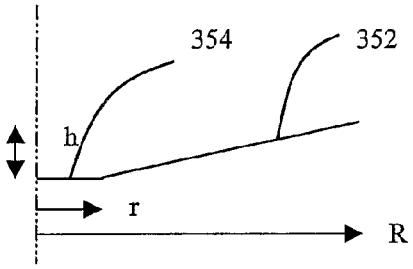
FIG. 59 is a part cross-sectional view of another embodiment of the invention.

FIG. 59 shows a diaphragm in the form of a shallow annular cone 352 in which the central aperture has been filled with a planar section 354. The planar section substantially acoustically seals the central aperture without introducing an unduly stiff cusp at the centre, which would be the case if the cone were continued to a point.

The ratio of the radius r of the planar section 354 to the outer radius R of the cone 352 is an additional diaphragm parameter which may be adjusted to achieve a desired acoustical response. This adjustment may be done with a number of intermediate objectives. For example:

1) The ratio could be adjusted so that the cone is another theoretical ideal to which the unbalanced modes of a practical acoustic device may be mapped. Average nodal positions for this theoretical ideal would be calculated and used to suggest placement of coil and masses.
2) Mechanical impedances in the form of masses may be added to achieve a net transverse modal velocity tending to zero.

Additional parameters which may be varied are the height h, shape and angle of the dished portion, all of which are found to cooperatively relate to the planar section. For example, the latter may be found to balance a mode for which the drive is on the nodal line. A solution may then be found with just one additional balancer. The locations of the drive and the balancing mechanical impedance or impedances are not shown. The mechanical impedances may be added according to the other parameters and the intended operating range.

The invention claimed is:

1. An acoustic device comprising a diaphragm having an area and having an operating frequency range and the diaphragm being such that it has resonant modes in the operating frequency range, an electromechanical transducer having a drive part coupled to the diaphragm and adapted to exchange energy with the diaphragm, and at least one mechanical impedance coupled to or integral with the diaphragm, the positioning and mass of the drive part of the transducer and of the at least one mechanical impedance being such that the net transverse modal velocity over the area of the diaphragm tends to zero.

2. An acoustic device according to claim 1, wherein the diaphragm parameters are such that there are two diaphragm modes in the operating frequency range.

3. An acoustic device according to claim 1 or claim 2, wherein the operating frequency range includes the piston-to-modal transition and wherein the transducer is adapted to move the diaphragm in translation.

4. An acoustic device according to claim 1, wherein the drive part of the transducer is coupled to the diaphragm at an average nodal position of modes in the operating frequency range.

5. An acoustic device according to claim 4, wherein the diaphragm is generally rectangular and has a centre of mass.

6. An acoustic device according to claim 5, wherein the parameters of the diaphragm are such that the first diaphragm mode is below k1=4, where k is the wave number and l is the length of the diaphragm.

7. An acoustic device according to claim 5, wherein the or each average nodal position is at a pair of opposed positions and the ratio of the distance of each opposed position from the centre of mass to the half-length of the diaphragm is dependent on the number of modes in the operating frequency range.

8. An acoustic device according to claim 7, comprising a pair of transducers, with each one of the pair mounted at one of the opposed positions.

9. An acoustic device according to claim 7, wherein the transducer is mounted centrally on the diaphragm so that its drive part drives the two opposed positions.

10. An acoustic device according to claim 7, wherein the suspension is located at the opposed positions.

11. An acoustic device according to claim 7, wherein the mechanical impedance is in the form of a pair of masses, one each of which is located at one of the opposed positions.

12. An acoustic device according to claim 11, comprising several pairs of masses coupled to or integral with the diaphragm.

13. An acoustic device according claim 5, wherein the diaphragm is beam-like and wherein the modes are along the long axis of the beam.

14. An acoustic device according to claim 13, wherein the drive part of the transducer and the at least one mechanical impedance is coupled to the diaphragm along the long axis of the beam.

15. An acoustic device according to claim 5, wherein the ratio of the diameter of the transducer drive part to the width of the diaphragm is such as to suppress the lowest cross-mode.

16. An acoustic device according to claim 15, wherein the ratio of the diameter of the transducer drive part to the width of the diaphragm is about 0.8.

17. An acoustic device according to claim 1, wherein the at least one mechanical impedance is coupled to or integral with the diaphragm at an average nodal position of modes in the operating frequency range.

18. An acoustic device according to claim 1, wherein the transducer is a moving coil device having a voice coil which forms the drive part and a magnet system, and the voice coil is coupled to the diaphragm at an average nodal position of modes in the operating frequency range.

19. An acoustic device according to claim 18, comprising a chassis and a resilient suspension coupling the diaphragm to the chassis, the suspension being coupled to the diaphragm at an average nodal position of modes in the operating frequency range.

20. An acoustic device according to claim 19, wherein the magnet system is grounded to the chassis.

21. An acoustic device according to claim 19, wherein the position at which the transducer drive part is coupled to the diaphragm is a different position to that at which the said suspension is coupled to the diaphragm.

22. An acoustic device according to claim 21, wherein the diaphragm has a generally circular periphery and a centre of mass.

23. An acoustic device according to claim 22, wherein the parameters of the diaphragm are such that the first diaphragm mode is below ka=2, where k is the wave number and a is the diaphragm radius.

24. An acoustic device according to claim 23, wherein the drive part of the transducer is coupled concentrically with the centre of mass of the diaphragm.

25. An acoustic device according to claim 23, wherein the suspension is coupled concentrically with the centre of mass of the diaphragm and away from its periphery.

26. An acoustic device according to claim 23, wherein the at least one mechanical impedance is in the form of an annular mass.

27. An acoustic device according to claim 26, comprising several annular masses coupled to or integral with the diaphragm at average nodal positions of modes in the operating frequency range.

28. An acoustic device according to claim 22, wherein the or each average nodal position is at an annulus and the ratio of the diameter of the annulus to the diameter of the diaphragm is dependent on the number of modes in the operating frequency range.

29. An acoustic device according to claim 28, wherein axial modes are additionally considered.

30. An acoustic device according to claim 22, comprising damping mounted to or integral with the diaphragm at a location of high diaphragm velocity to damp a mode.

31. An acoustic device according to claim 30, wherein the damping is an annular pad coupled concentrically with the centre of mass of the diaphragm.

32. An acoustic device according to claim 19, wherein the mass of the suspension is scaled to that of the transducer drive part.

33. An acoustic device according to claim 1, wherein the diaphragm is isotropic as to bending stiffness.

34. An acoustic device according to claim 1, comprising a size adaptor in the form of a lightweight rigid coupler which couples the transducer to the diaphragm.

35. An acoustic device according to claim 34, wherein the coupler is coupled to the transducer at a first diameter and is coupled to the diaphragm at a second diameter.

36. An acoustic device according to claim 34 or claim 35, wherein the coupler is frusto-conical.

37. An acoustic device according to claim 1, wherein the said diaphragm comprises an aperture.

38. An acoustic device according to claim 37, comprising a second diaphragm mounted within the aperture, the second diaphragm having an area and an operating frequency range and the second diaphragm being such that it has resonant modes in the operating frequency range, an electromechanical transducer having a drive part is coupled to the diaphragm and adapted to exchange energy with the diaphragm, and at least one mechanical impedance is coupled to or integral with the diaphragm, the positioning and mass of the drive part of the transducer and of the at least one mechanical impedance being such that the net transverse modal velocity over the area of the second diaphragm tends to zero.

39. An acoustic device according to claim 37, comprising a member mounted in the aperture, whereby the aperture is substantially acoustically sealed.

40. An acoustic device according to claim 1, wherein the diaphragm is substantially planar.

41. An acoustic device according to claim 1, wherein the acoustic device is a loudspeaker and the transducer is adapted to apply bending wave energy to the diaphragm in response to an electrical signal applied the transducer and wherein the diaphragm is adapted to radiate acoustic sound over a radiating area.

42. An acoustic device according to claim 41, comprising a baffle surrounding the radiating area of the diaphragm.

43. An acoustic device according to claim 26 or claim 12, wherein the masses reduce in value towards the centre of the diaphragm.

44. An acoustic device according to claim 43, wherein the masses are scaled to the transducer drive part mass.

45. An acoustic device according to claim 26 or claim 12, wherein the masses are scaled to the transducer drive part mass.

46. A method of making an acoustic device having a diaphragm having an area and having an operating frequency range, comprising choosing the diaphragm parameters such that it has resonant modes in the operating frequency range, coupling a drive part of an electromechanical transducer to the diaphragm to exchange energy with the diaphragm, adding at least one mechanical impedance to the diaphragm, and selecting the positioning and mass of the drive part of the transducer and the positioning and parameters of the at least one mechanical impedance so that the net transverse modal velocity over the area tends to zero.

47. A method according to claim 46, comprising mapping the velocity profiles of a freely vibrating diaphragm to those of the diaphragm.

48. A method according to claim 46 or claim 47, comprising arranging the diaphragm parameters such that there are two diaphragm modes in the operating frequency range.

49. A method according to claim 46, comprising arranging the operating frequency range to include the piston-to-modal transition and arranging the transducer to move the diaphragm in translation.

50. A method according to claim 46, comprising coupling the transducer drive part to the diaphragm at an average nodal position of modes in the operating frequency range.

51. A method according to claim 46, comprising arranging the at least one mechanical impedance to be at an average nodal position of modes of the diaphragm in the operating frequency range.

52. A method according to claim 51, comprising arranging the diaphragm to have a substantially circular periphery and a centre of mass.

53. A method according to claim 52, comprising arranging the parameters of the diaphragm such that the first diaphragm mode is below ka=2, where k is the wave number and a is the diaphragm radius.

54. A method according to claim 52 or claim 53, comprising balancing the diaphragm modes by varying the drive diameter of the diaphragm between its centre and its periphery, calculating the mean drive point admittance as the drive diameter is varied, and adding mechanical impedances at the positions given by the admittance minima.

55. A method according to claim 52, comprising arranging the or each average nodal position to be at an annulus and determining the ratio of the diameter of the annulus to the diameter of the diaphragm from the number of radial modes in the operating frequency range.

56. A method according to claim 55, comprising considering axial modes.

57. A method according to claim 52, comprising coupling the transducer drive part to the diaphragm concentrically with the centre of mass of the diaphragm.

58. A method according to claim 52, comprising coupling the suspension concentrically with the centre of mass of the diaphragm and away from its periphery.

59. A method according to claim 52, comprising arranging the at least one mechanical impedance to be an annular mass.

60. A method according to claim 59, comprising providing several annular masses.

61. A method according to claim 60, comprising arranging that the masses reduce in value towards the centre of the diaphragm.

62. A method according to claim 46, comprising arranging the diaphragm to be isotropic as to bending stiffness.

63. A method according to claim 52, comprising selecting a mode to be damped and adding damping to the diaphragm at a location of high diaphragm velocity whereby the selected mode is damped.

64. A method according to claim 63, comprising coupling damping in the form of an annular damping pad concentrically with the centre of mass of the diaphragm.

65. A method according to claim 46, wherein the transducer is a moving coil device having a voice coil which forms the drive part and a magnet system and comprising coupling the voice coil to the diaphragm at an average nodal position of modes in the operating frequency range.

66. A method according to claim 65, comprising coupling a resilient suspension to the diaphragm at an average nodal position of modes in the operating frequency range and coupling the suspension to a chassis.

67. A method according to claim 66, comprising coupling the magnet system to the chassis.

68. A method according to claim 66 or claim 67, comprising coupling the transducer drive part to the diaphragm at a different position to that at which the suspension is coupled to the diaphragm.

69. A method according to claim 66, comprising scaling the mass of the suspension to that of the transducer drive part.

70. A method according to claim 66, comprising arranging the diaphragm to be generally rectangular and have a centre of mass.

71. A method according to claim 70, comprising selecting the parameters of the diaphragm so that the first diaphragm mode is below kl=4, where k is the wave number and l is the length of the diaphragm.

72. A method according to claim 70, comprising arranging the or each average nodal position to be at a pair of opposed positions and determining the ratio of the distance of each opposition position from the centre of mass to the half-length of the diaphragm from the number of modes in the operating frequency range.

73. A method according to claim 72, comprising mounting a transducer at each opposed position.

74. A method according to claim 72, comprising mounting a transducer centrally on the diaphragm so that its drive part drives the two opposed positions.

75. A method according to claim 72, comprising locating the suspension at the opposed positions.

76. A method according to claim 72, comprising adding mechanical impedance in the form of a pair of masses and locating each mass at one of the opposed positions.

77. A method according to claim 76, comprising adding several pairs of masses to the diaphragm.

78. A method according to claim 70, comprising arranging the diaphragm to be beam-like and have modes are along the long axis of the diaphragm.

79. A method according to claim 78, comprising coupling the drive part of the transducer and the at least one mechanical impedance along the long axis of the diaphragm.

80. A method according to claim 70, comprising selecting the ratio of the diameter of the transducer drive part to the width of the diaphragm to suppress the lowest cross-mode.

81. A method according to claim 80, comprising selecting the ratio of the diameter of the transducer drive part to the width of the diaphragm to be about 0.8.

82. A method according to claim 60, claim 77 or claim 61, comprising scaling the masses to the mass of the transducer drive part.

83. A method according to claim 46, comprising coupling the transducer to the diaphragm using a size adaptor in the form of a lightweight rigid adaptor.

84. A method according to claim 83, comprising coupling the coupler to the transducer at a first diameter and coupling the coupler to the diaphragm at a second diameter.

85. A method according to claim 46, comprising providing an aperture in the said diaphragm.

86. A method according to claim 85, comprising arranging a second diaphragm within the aperture in said diaphragm, wherein the second diaphragm has an area and an operating frequency range and comprising choosing the second diaphragm parameters so it has resonant modes in the operating frequency range, coupling a transducer drive part to the second diaphragm to exchange bending wave energy therewith and applying at least one mechanical impedance to the diaphragm.

87. A method according to claim 82, comprising mounting a sealing member in the aperture whereby the aperture is substantially acoustically sealed.

88. A method according to claim 46, comprising arranging the diaphragm to be substantially planar.

89. A method according to claim 46, when dependent on claim 66, comprising scaling the mass of the suspension to that of the transducer drive part.

* * * * *